US009670867B2

(12) United States Patent
Ulrey et al.

(10) Patent No.: US 9,670,867 B2
(45) Date of Patent: Jun. 6, 2017

(54) SYSTEMS AND METHODS FOR FUEL INJECTION

(71) Applicant: Ford Global Technologies, LLC, Dearborn, MI (US)

(72) Inventors: Joseph Norman Ulrey, Dearborn, MI (US); Ross Dykstra Pursifull, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 174 days.

(21) Appl. No.: 14/750,332

(22) Filed: Jun. 25, 2015

(65) Prior Publication Data

US 2016/0377016 A1 Dec. 29, 2016

(51) Int. Cl.

| | |
|---|---|
| ***F02D 41/38*** | (2006.01) |
| ***F02M 55/02*** | (2006.01) |
| ***F02M 59/46*** | (2006.01) |
| ***F02D 41/30*** | (2006.01) |

(52) U.S. Cl.

CPC ..... *F02D 41/3845* (2013.01); *F02D 41/3094* (2013.01); *F02D 41/3809* (2013.01); *F02M 55/025* (2013.01); *F02M 59/464* (2013.01); *F02M 59/466* (2013.01); *F02D 2041/389* (2013.01); *F02D 2041/3881* (2013.01)

(58) Field of Classification Search

CPC .. F02D 41/38; F02D 41/3845; F02D 41/3809; F02D 41/3094; F02D 2041/389; F02D 2041/3881; F02M 55/025; F02M 59/464

See application file for complete search history.

(56) References Cited

U.S. PATENT DOCUMENTS

| | | | |
|---|---|---|---|
| 6,719,005 | B1 | 4/2004 | Trimble et al. |
| 7,353,798 | B2 | 4/2008 | Tokuda et al. |
| 7,380,539 | B2 | 6/2008 | Akita et al. |
| 7,392,823 | B2 | 7/2008 | Dong et al. |
| 7,568,491 | B2 | 8/2009 | Banfill et al. |
| 7,861,691 | B2 | 1/2011 | Nakata et al. |
| 9,429,097 | B2 * | 8/2016 | Pursifull ..... F02D 41/3082 |
| 2013/0118449 | A1 | 5/2013 | Marriott et al. |
| 2014/0224217 | A1 | 8/2014 | Pursifull et al. |

OTHER PUBLICATIONS

Surnilla, G. et al., "Methods and Systems for High Pressure Port Fuel Injection," U.S. Appl. No. 14/570,802, filed Dec. 15, 2014, 32 pages.

Ulrey J. et al., "Method for Cooling a Direct Injection Pump," U.S. Appl. No. 14/627,973, filed Feb. 20, 2015, 61 pages.

Pursifull R. et al., "Systems and Methods for Fuel Injection," U.S. Appl. No. 14/750,232, filed Jun. 25, 2015, 125 pages.

Basmaji J. et al., "Systems and Methods for Fuel Injection," U.S. Appl. No. 14/750,642, filed Jun. 25, 2015, 126 pages.

(Continued)

*Primary Examiner* — Hieu T Vo

(74) *Attorney, Agent, or Firm* — James Dottavio; McCoy Russell LLP

(57) ABSTRACT

Methods and systems are provided for a direct injection fuel pump. In one example, pressure in a step chamber of the direct injection fuel pump may be regulated to a substantially constant pressure during an entire pump cycle including a compression stroke and a suction stroke.

20 Claims, 32 Drawing Sheets

(56) References Cited

OTHER PUBLICATIONS

Anonymous, "Double-acting Engine-driven Fuel Injection Pump for Port Fuel Injection," IP.com No. 000242807, Published Aug. 19, 2015, 2 pages.
Anonymous, "Double-acting Engine-driven Fuel Injection Pump for Port Fuel Injection," IP.com No. 000242808, Published Aug. 19, 2015, 2 pages.

* cited by examiner

SYSTEMS AND METHODS FOR FUEL INJECTION

FIELD

The present description relates generally to systems and methods for operating a fuel pump, especially a direct injection fuel pump.

BACKGROUND/SUMMARY

Port fuel direct injection (PFDI) engines include both port injection and direct injection of fuel and may advantageously utilize each injection mode. For example, at higher engine loads, fuel may be injected into the engine using direct fuel injection for improved engine performance (e.g., by increasing available torque and fuel economy). At lower engine loads and during engine starting, fuel may be injected into the engine using port fuel injection to provide improved fuel vaporization for enhanced mixing and to reduce engine emissions. Further, port fuel injection may provide an improvement in fuel economy over direct injection at lower engine loads. Further still, noise, vibration, and harshness (NVH) may be reduced when operating with port injection of fuel. In addition, both port injectors and direct injectors may be operated together under some conditions to leverage advantages of both types of fuel delivery or in some instances, differing fuels.

In PFDI engines, a lift pump (also termed, low pressure pump) supplies fuel from a fuel tank to both port fuel injectors and a direct injection fuel pump (also termed, a high pressure pump). The direct injection fuel pump may supply fuel at a higher pressure to direct injectors. During some engine conditions, e.g. lower engine loads, fuel may not be injected to the engine via direct injectors. As such, the direct injection fuel pump may be deactivated during these conditions. Specifically, a solenoid activated check valve at an inlet to a compression chamber of the direct injection fuel pump may be held in a pass-through mode allow fuel flow into and out of the compression chamber. A potential issue during such conditions is that the direct injection pump may degrade when fuel flow through the direct injection fuel pump is stopped. Specifically, the lubrication and cooling of the direct injection pump may be reduced while the direct injection pump is deactivated, leading to degradation of the direct injection pump.

One example approach for providing lubrication during deactivation of the direct injection fuel pump is shown by Pursifull et al. in US 2014/0224217. Herein, a pressure differential is produced in the direct injection fuel pump by controlling a pressure in the compression chamber during a compression stroke when fueling via direct injectors is disabled. Specifically, the pressure in the compression chamber during the compression stroke may be increased to a pressure higher than an output pressure of the lift pump. By increasing the pressure during the compression stroke, lubrication of a cylinder and pump piston of the direct injection fuel pump may be enhanced.

The inventors herein have identified a potential issue with the above approach. As an example, lubrication of the cylinder and pump piston of the direct injection fuel pump may not occur during a suction stroke in the direct injection fuel pump. Herein, the compression chamber may be at the same pressure as a step chamber (chamber formed underneath base of pump piston) and the lack of differential pressure may result in lubrication not occurring during at least a portion of each pump stroke. Without lubrication and cooling during the suction stroke, pump degradation may continue to be a problem.

The inventors herein have recognized the above issue and identified an approach to at least partially address the issue. The approach includes an example method comprising regulating a pressure in a step chamber of a direct injection fuel pump to a substantially constant pressure during each of a compression stroke and a suction stroke in the direct injection fuel pump. In this way, a differential pressure may be obtained in the direct injection fuel pump providing lubrication.

For example, a direct injection fuel pump coupled in an engine may include a pump piston reciprocating in a bore, the pump piston being driven by a crankshaft of the engine. A compression chamber may be formed on a first side of the pump piston and a step chamber may be formed on a second side of the pump piston wherein the first side and the second side are positioned opposite each other. In one example, the compression chamber is formed vertically above a top surface of the pump piston while the step chamber is formed vertically underneath the bottom surface of the pump piston. The step chamber may be fluidically coupled to an accumulator which stores fuel enabling a pressure of the step chamber to be regulated during each of a compression stroke and a suction stroke in the direct injection fuel pump. The accumulator may enable a substantially constant pressure in the step chamber with the constant pressure being higher than an output pressure of a lift pump.

In this way, lubrication of the direct injection fuel pump may be enabled during deactivation of direct injectors. By regulating pressure in the step chamber of the direct injection fuel pump, the bore and pump piston may be lubricated. Specifically, a pressure differential may be formed across the pump piston of the direct injection fuel pump that allows fuel to flow into a clearance between the pump piston and the bore providing lubrication. Accordingly, degradation of the direct injection fuel pump may be reduced allowing an improvement in the performance of the direct injection fuel pump. Further, the approach may be applied at lower cost and complexity. Furthermore, durability of the direct injection fuel pump may be extended.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 12:
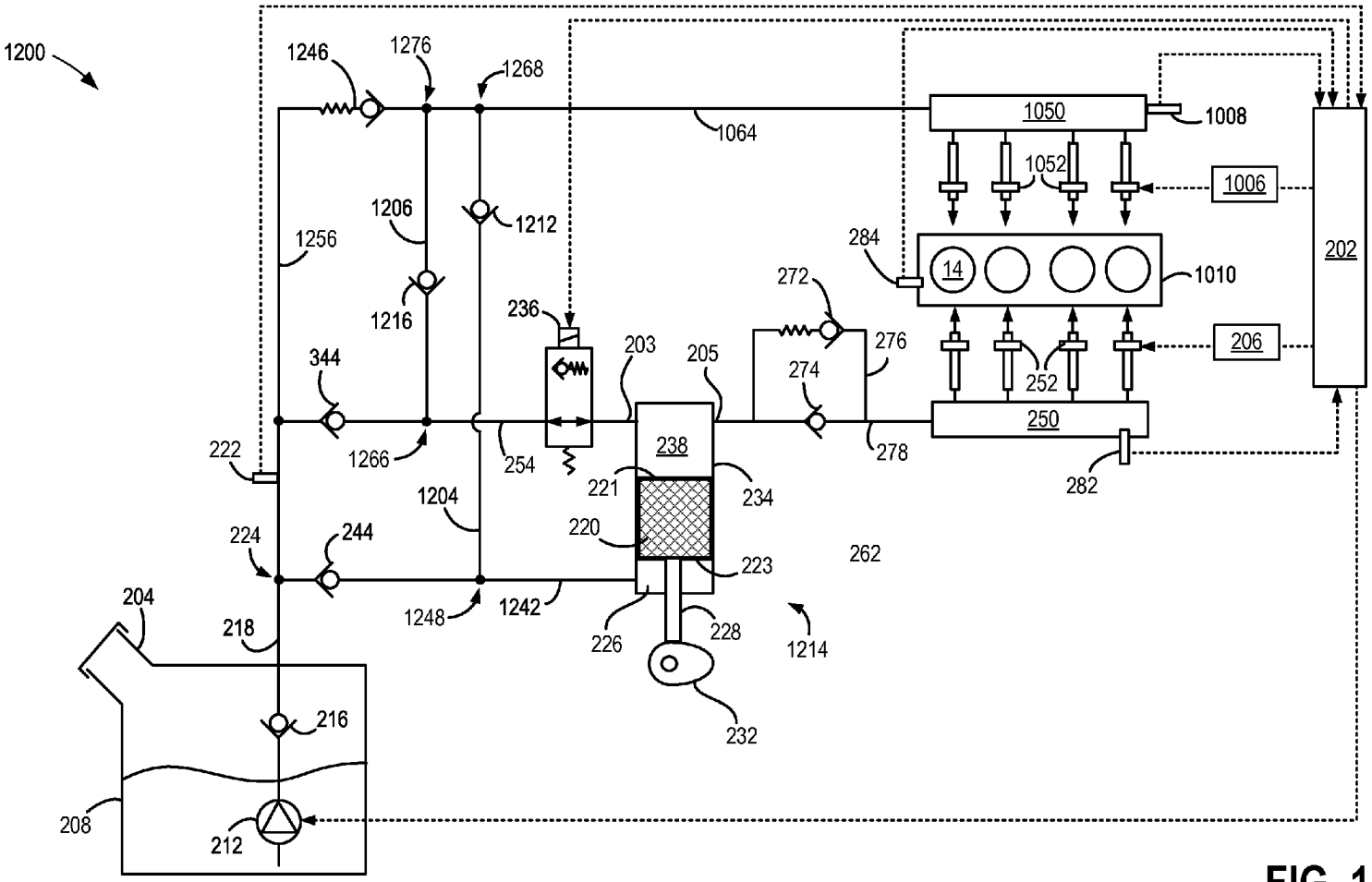
FIGS. 12, 13, and 14 schematically illustrate a sixth example embodiment, a seventh example embodiment, and an eight example embodiment respectively of the fuel system that may be included in engine of FIG. 1.
Figure 13:
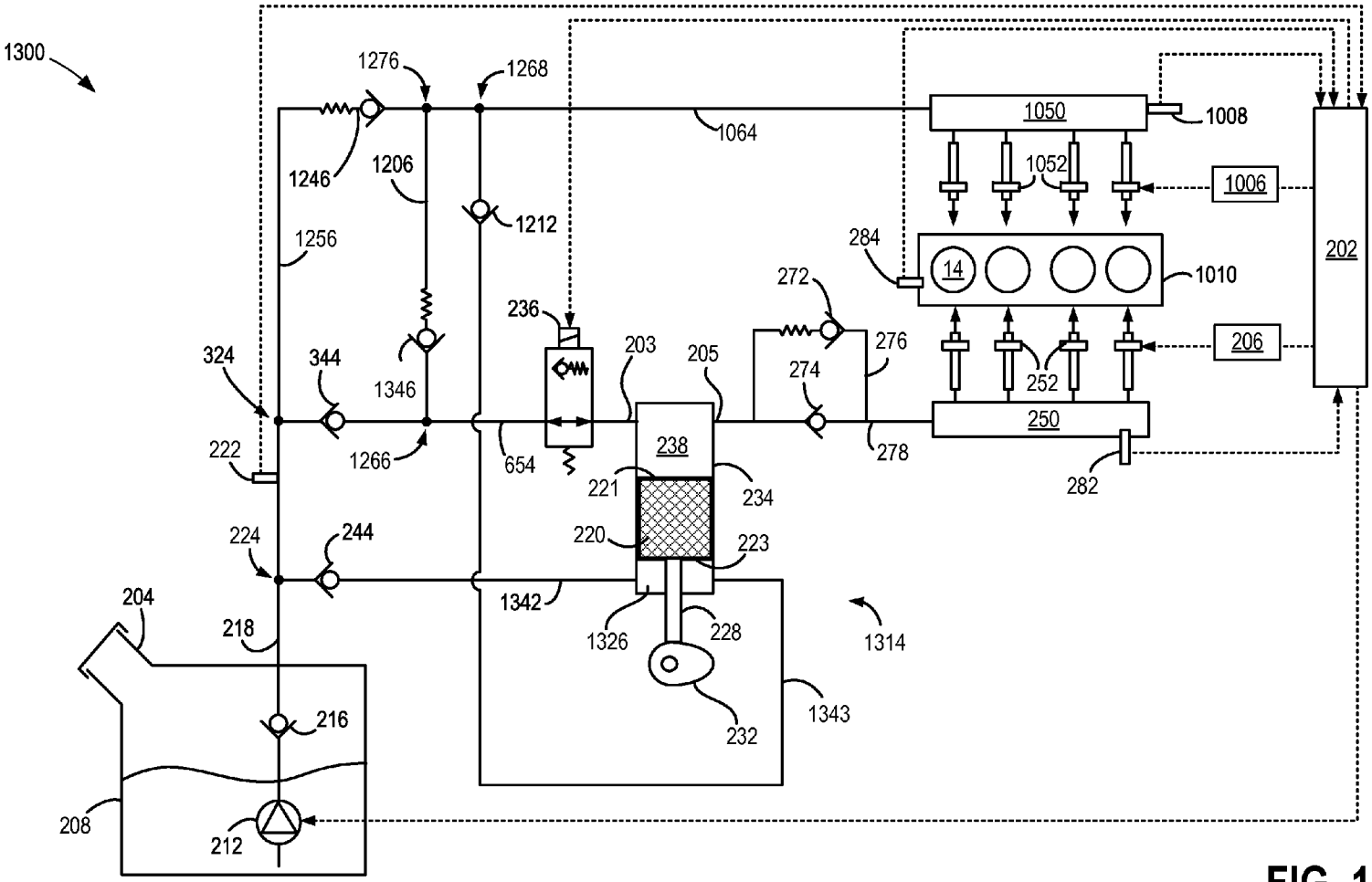
Figure 14:
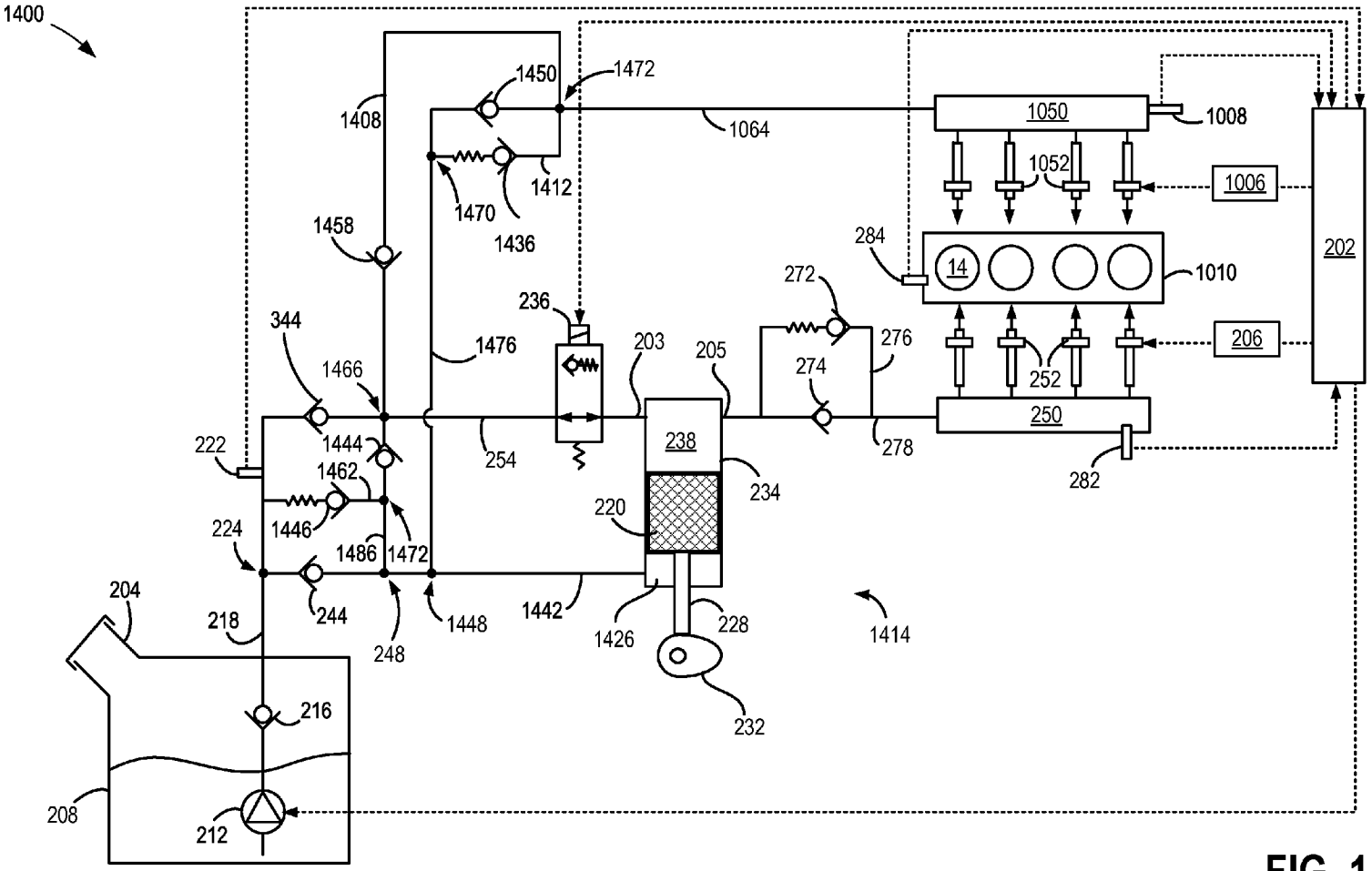
Figure 15:
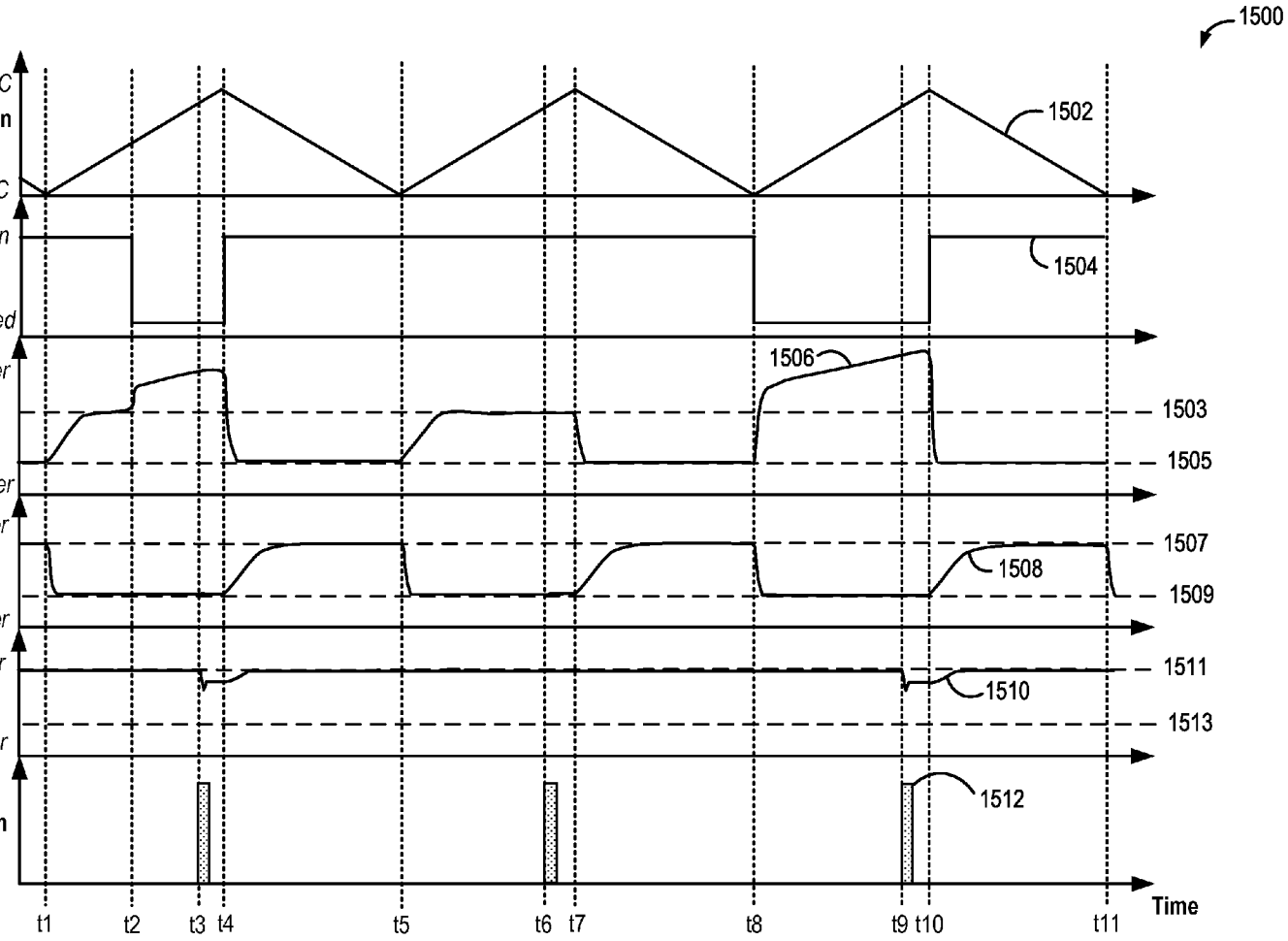
FIGS. 15, 16, and 17 depict example operating sequences in direct injection fuel pumps included in the sixth example embodiment of FIG. 12, in the seventh example embodiment of FIG. 13, and in the eighth example embodiment of FIG. 14, respectively.
Figure 16:
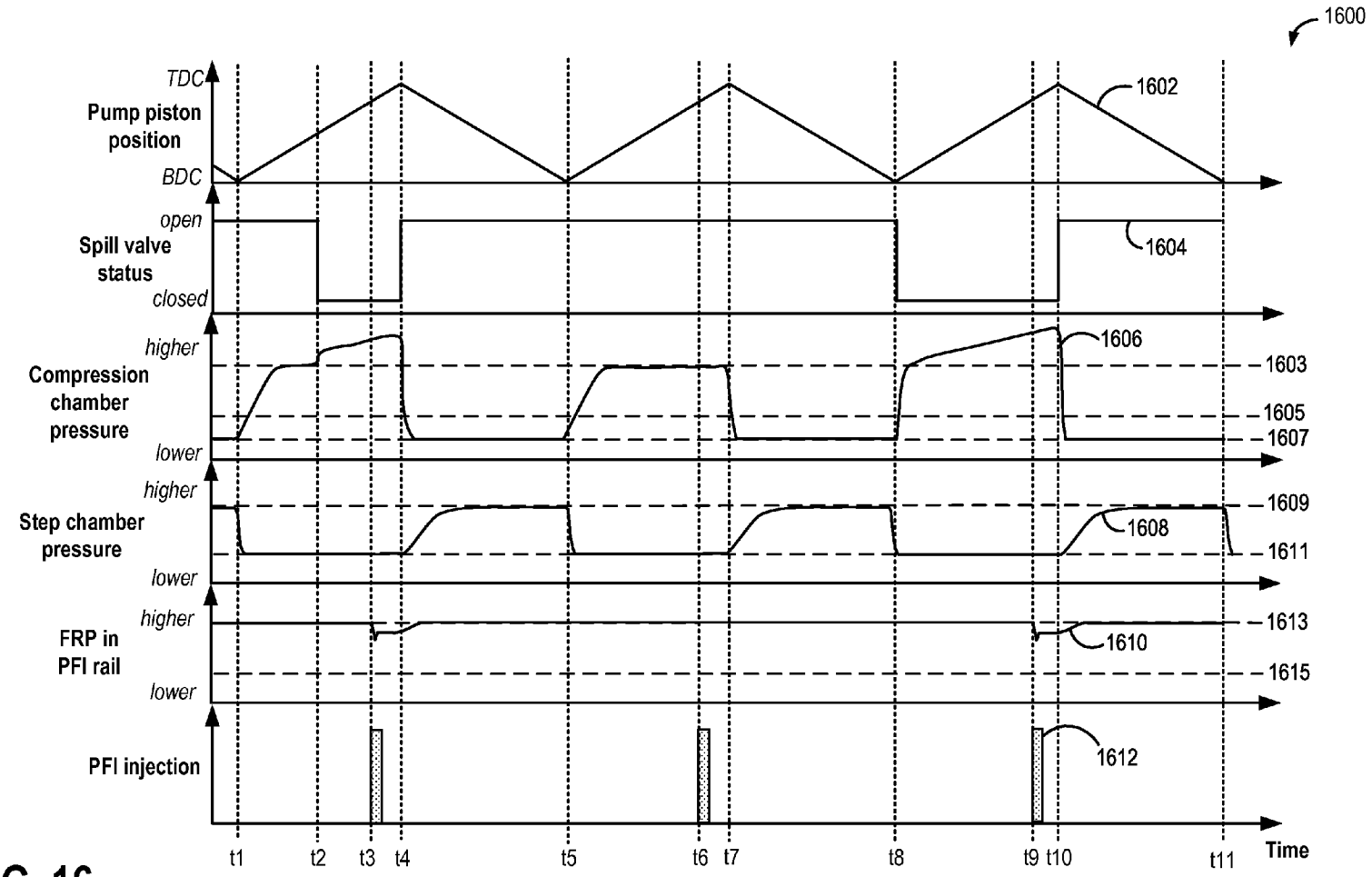
Figure 17:
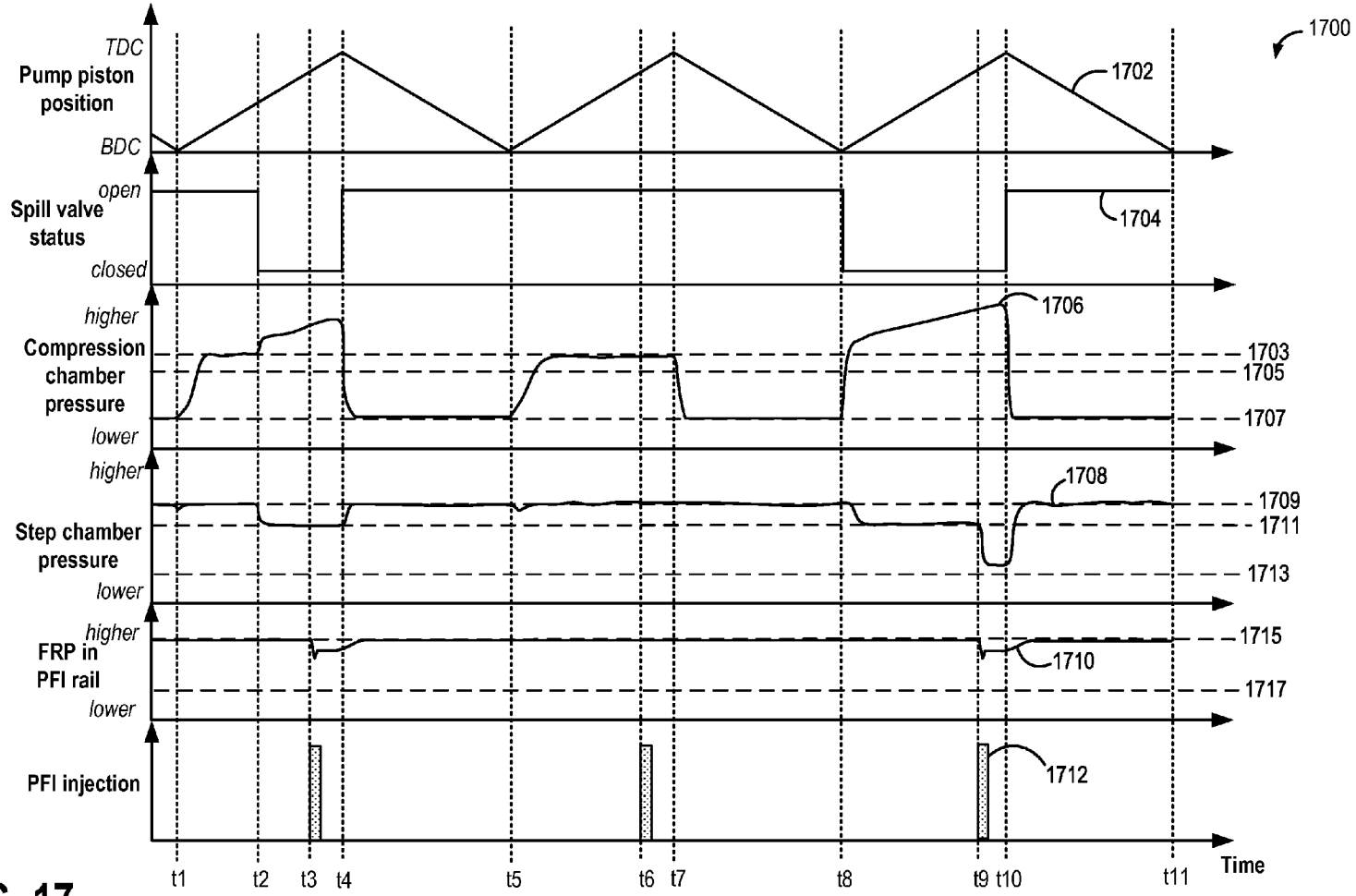
Figure 22:
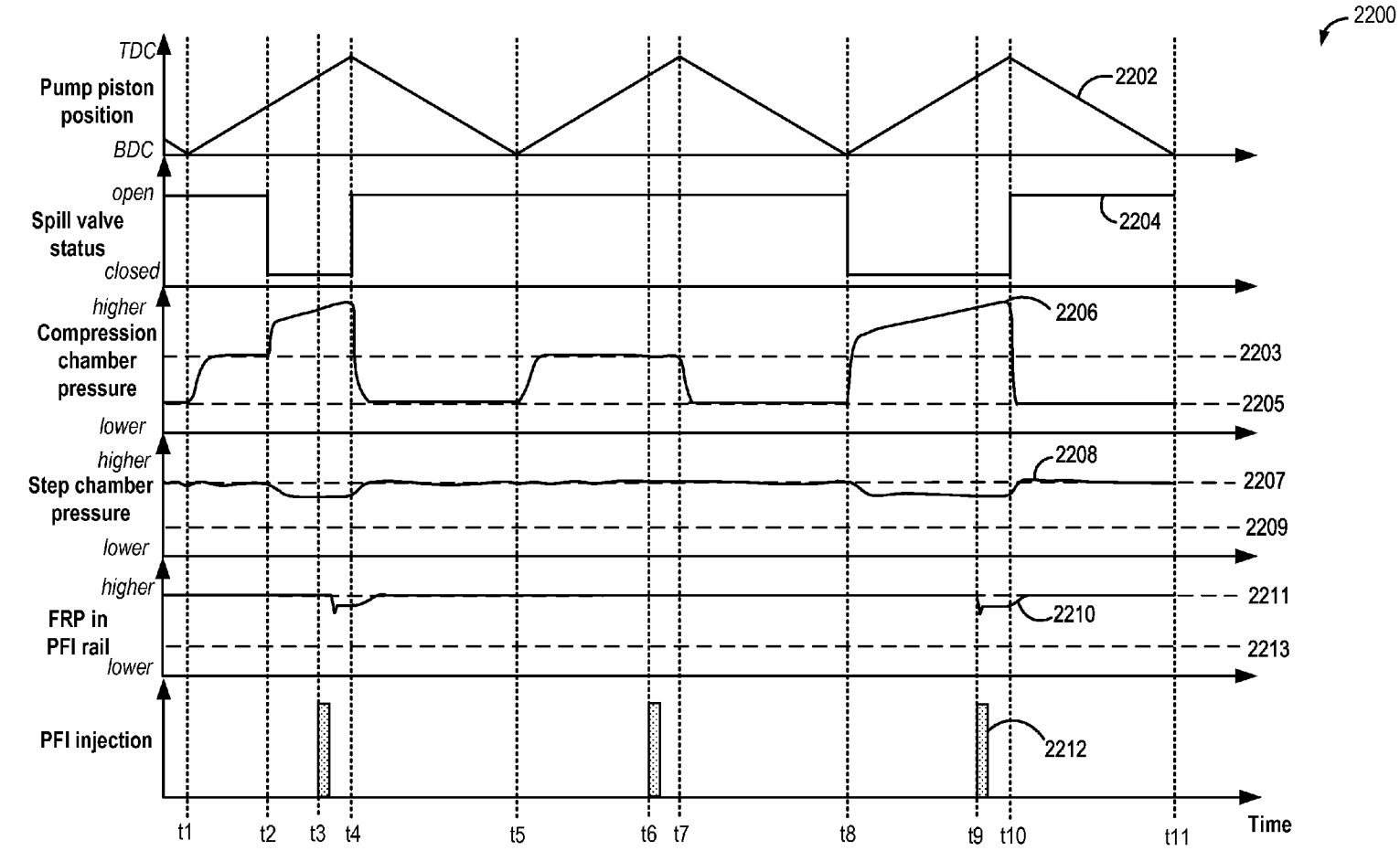
FIGS. 22 and 23 illustrate example operating sequences in direct injection fuel pumps included in the tenth example embodiment of the fuel system in FIG. 20 and the eleventh example embodiment of the fuel system of FIG. 21, respectively.
Figure 23:
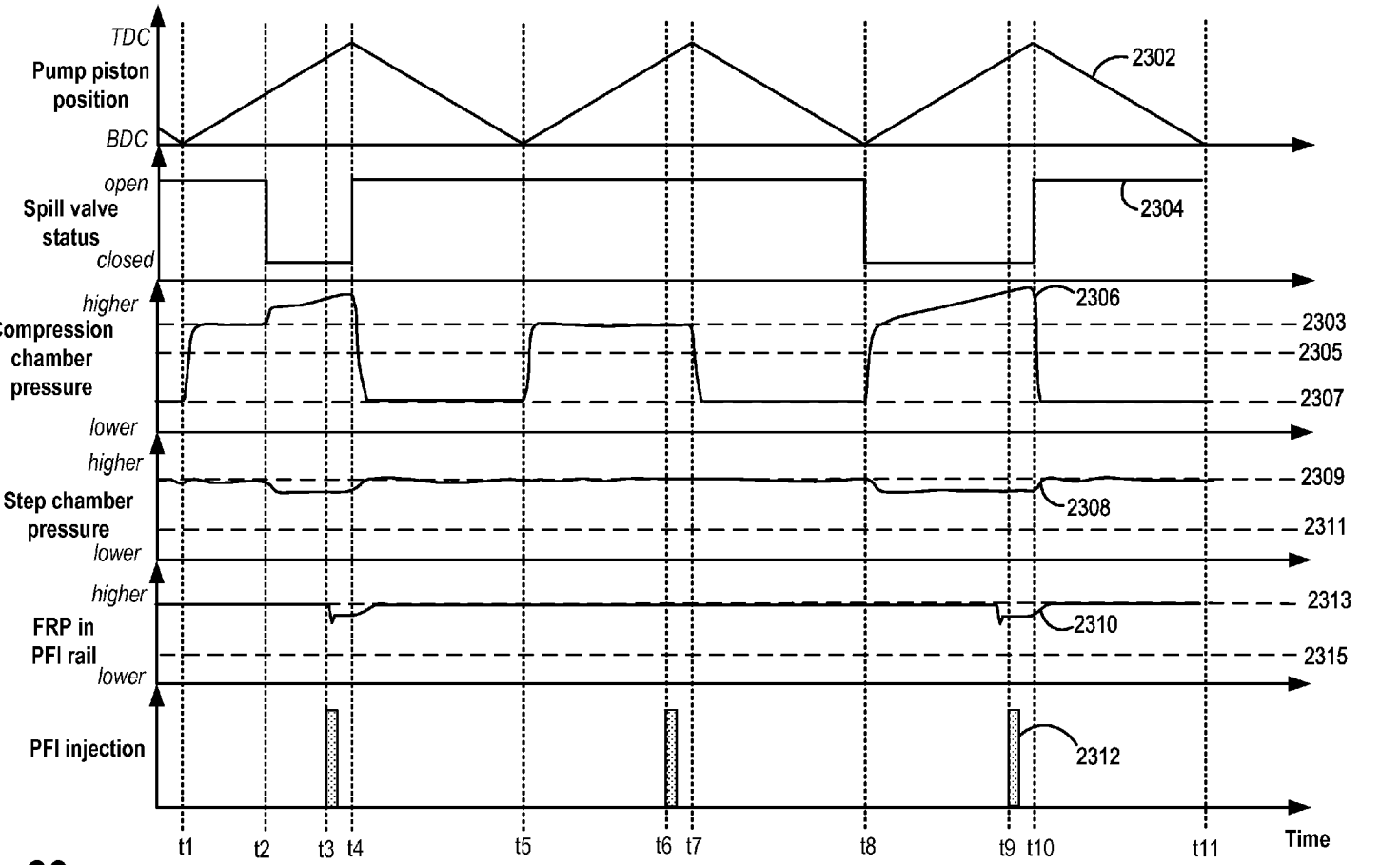

The following description relates to systems and methods for operating a direct injection fuel pump. The direct injection (DI) fuel pump may be included within an engine system, such as the engine shown in FIG. 1. The DI fuel pump may include an electronically controlled spill valve that may be regulated by a controller of the engine to an energized or a de-energized state (FIG. 24) based on engine conditions. Lubrication and cooling (as well as vapor avoidance) of the DI fuel pump may be enhanced by various methods as shown in different embodiments of a fuel system including the DI fuel pump. In one example, one or more pressure relief valves (FIGS. 2, 3, and 4) may be included in the fuel system to enable increased pressure in a step chamber (FIGS. 5, 6, and 7) of the DI fuel pump and/or a compression chamber of the DI fuel pump. In another example, the compression chamber may additionally or alternatively pressurize the step chamber (FIGS. 8, 9, 10, and 11). Alternative fuel system embodiments may include fueling a port injector fuel rail with the DI fuel pump. Specifically, each of the step chamber and the compression chamber of the DI fuel pump may provide fuel to the port injector fuel rail (FIGS. 12, 13, and 14). The fuel supplied to the port injector fuel rail may be pressurized (FIGS. 15, 16, and 17). In yet other fuel system embodiments, an accumulator (FIG. 18) or a port injector fuel rail functioning as an accumulator (FIGS. 20 and 21) may maintain the step chamber of the DI fuel pump at a constant pressure (FIGS. 19, 22, and 23). Example changes in pressure in the compression chamber and step chamber of each embodiment are described in reference to FIGS. 25, 26, 27, 28, 29, 30, 31, 32, and 33. The different embodiments of the fuel system described herein may enable improved lubrication of the DI fuel pump as well as provide sufficient pressurized fuel to the port injector fuel rail.

It will be appreciated that in the example port fuel direct injection (PFDI) systems shown in the present disclosure, the direct injectors may be deleted without departing from the scope of this disclosure.

A fuel delivery system for an engine may include multiple fuel pumps for providing a desired fuel pressure to the fuel injectors. As one example, the fuel delivery system may include a lower pressure fuel pump (also termed, lift pump) and a higher pressure (also termed, high pressure or direct injection) fuel pump arranged between a fuel tank and fuel injectors. The higher pressure fuel pump may be coupled upstream of a high pressure fuel rail in a direct injection system to raise a pressure of the fuel delivered to engine cylinders through direct injectors. As will be described further below, the higher pressure pump may also supply fuel to a port injector fuel rail. A solenoid activated inlet check valve, also termed a solenoid activated check valve or spill valve, may be coupled upstream of a compression chamber in the higher pressure (HP) pump to regulate fuel flow into the compression chamber of the high pressure pump. The spill valve is commonly electronically controlled by a controller which may be part of a control system for the engine of the vehicle. Furthermore, the controller may also have a sensory input from a sensor, such as an angular position sensor, that allows the controller to command activation of the spill valve in synchronism with a driving cam that powers the high pressure pump.

Regarding terminology used throughout this detailed description, a high pressure pump, or direct injection fuel pump, may be abbreviated as a HP pump (alternatively, HPP) or a DI fuel pump respectively. As such, DI fuel pump may also be termed DI pump. Accordingly, HPP and DI fuel pump may be used interchangeably to refer to the high pressure direct injection fuel pump. Similarly, a low pressure pump, may also be referred to as a lift pump. Further, the low pressure pump may be abbreviated as LP pump or LPP. Port fuel injection may be abbreviated as PFI while direct injection may be abbreviated as DI. Also, fuel rail pressure, or the value of pressure of fuel within the fuel rail may be abbreviated as FRP. The direct injection fuel rail may also be referred to as a high pressure fuel rail, which may be abbreviated as HP fuel rail. Also, the solenoid activated inlet check valve for controlling fuel flow into the compression chamber of the HP pump may be referred to as a spill valve, a solenoid activated check valve (SACV), electronically controlled solenoid activated inlet check valve, and also as an electronically controlled valve. Further, when the solenoid activated inlet check valve is activated, the HP pump is referred to as operating in a variable pressure mode. Further, the solenoid activated check valve may be maintained in its activated state throughout the operation of the HP pump in variable pressure mode. If the solenoid activated check valve is deactivated and the HP pump relies on mechanical pressure regulation without any commands to the electronically-controlled spill valve, the HP pump is referred to as operating in a mechanical mode or in a default pressure mode (or simply, default mode). Further, the solenoid activated check valve may be maintained in its deactivated state throughout the operation of the HP pump in default pressure mode.

Figure 1:
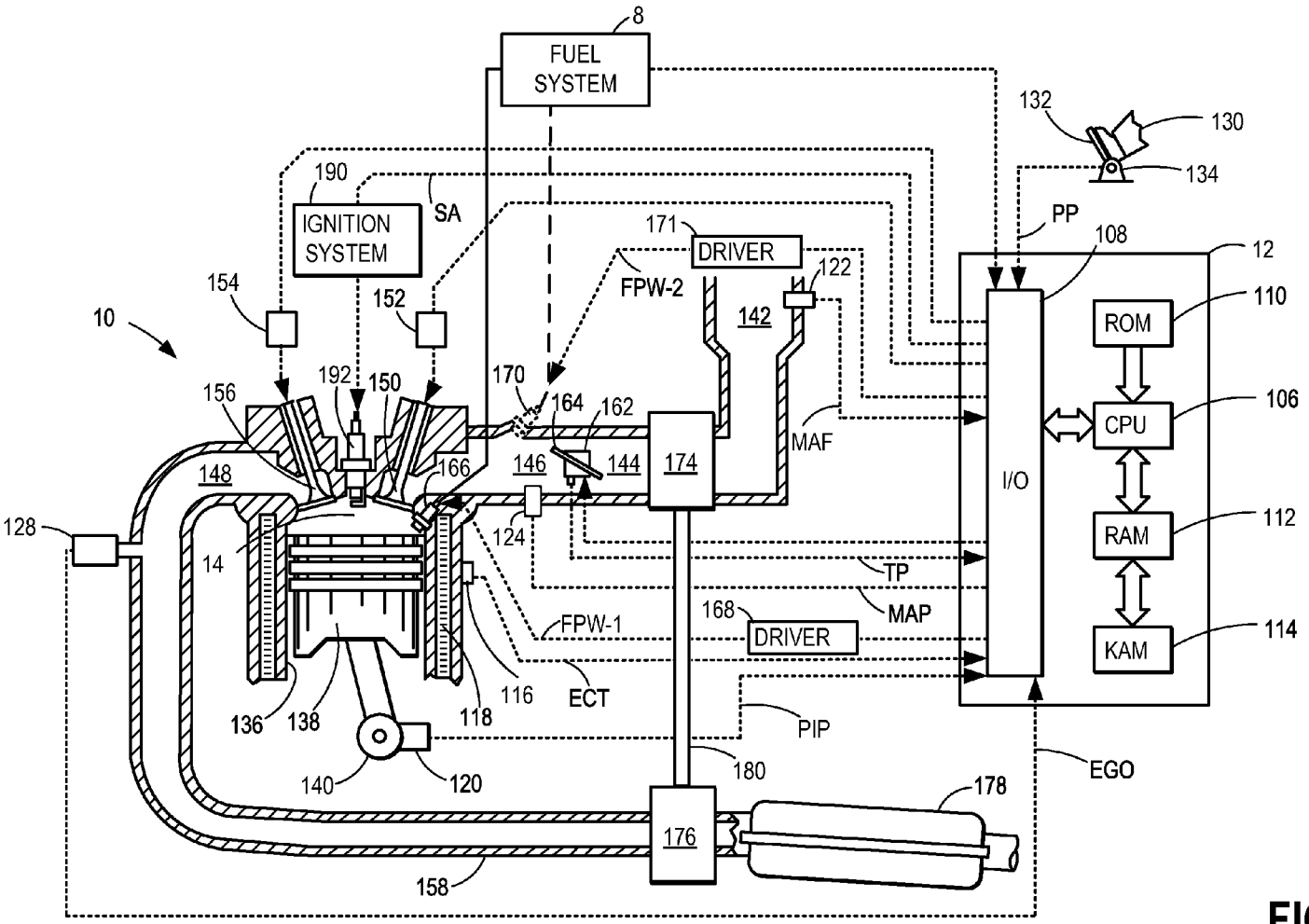
FIG. 1 depicts a schematic engine that may be fueled solely by direct injectors or that may be fueled by both direct injectors and port injectors.

FIG. 1 depicts an example of a combustion chamber or cylinder of internal combustion engine 10. Engine 10 may be controlled at least partially by a control system including controller 12 and by input from a vehicle operator 130 via an input device 132. In this example, input device 132 includes an accelerator pedal and a pedal position sensor 134 for generating a proportional pedal position signal PP. Cylinder 14 (herein also termed combustion chamber 14) of engine 10 may include combustion chamber walls 136 with piston 138 positioned therein. Piston 138 may be coupled to crankshaft 140 so that reciprocating motion of the piston is translated into rotational motion of the crankshaft. Crankshaft 140 may be coupled to at least one drive wheel of the passenger vehicle via a transmission system (not shown). Further, a starter motor (not shown) may be coupled to crankshaft 140 via a flywheel (not shown) to enable a starting operation of engine 10.

Cylinder 14 can receive intake air via a series of intake air passages 142, 144, and 146. Intake air passages 142, 144, and 146 can communicate with other cylinders of engine 10 in addition to cylinder 14. In some examples, one or more of the intake air passages may include a boosting device such as a turbocharger or a supercharger. For example, FIG. 1 shows engine 10 configured with a turbocharger including a compressor 174 arranged between intake air passages 142 and 144, and an exhaust turbine 176 arranged along exhaust passage 158. Compressor 174 may be at least partially powered by exhaust turbine 176 via a shaft 180 where the boosting device is configured as a turbocharger. However, in other examples, such as where engine 10 is provided with a supercharger, exhaust turbine 176 may be optionally omitted, where compressor 174 may be powered by mechanical input from a motor or the engine.

A throttle 162 including a throttle plate 164 may be arranged between intake air passages 144 and 146 of the engine for varying the flow rate and/or pressure of intake air provided to the engine cylinders. As shown in FIG. 1, throttle 162 may be positioned downstream of compressor 174, or alternatively may be provided upstream of compressor 174.

Exhaust manifold 148 can receive exhaust gases from other cylinders of engine 10 in addition to cylinder 14. Exhaust gas sensor 128 is shown coupled to exhaust passage 158 upstream of emission control device 178. Sensor 128 may be selected from among various suitable sensors for providing an indication of exhaust gas air/fuel ratio such as a linear oxygen sensor or UEGO (universal or wide-range exhaust gas oxygen), a two-state oxygen sensor or EGO (as depicted), a HEGO (heated EGO), a NOx, HC, or CO sensor, for example. Emission control device 178 may be a three way catalyst (TWC), NOx trap, various other emission control devices, or combinations thereof.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some examples, each cylinder of engine 10, including cylinder 14, may include at least two intake poppet valves and at least two exhaust poppet valves located at an upper region of the cylinder.

Intake valve 150 may be controlled by controller 12 via actuator 152. Similarly, exhaust valve 156 may be controlled by controller 12 via actuator 154. During some conditions, controller 12 may vary the signals provided to actuators 152 and 154 to control the opening and closing of the respective intake and exhaust valves. The position of intake valve 150 and exhaust valve 156 may be determined by respective valve position sensors (not shown). The valve actuators may be of the electric valve actuation type or cam actuation type, or a combination thereof. The intake and exhaust valve timing may be controlled concurrently or any of a possibility of variable intake cam timing, variable exhaust cam timing, dual independent variable cam timing or fixed cam timing may be used. Each cam actuation system may include one or more cams and may utilize one or more of cam profile switching (CPS), variable cam timing (VCT), variable valve timing (VVT) and/or variable valve lift (VVL) systems that may be operated by controller 12 to vary valve operation. For example, cylinder 14 may alternatively include an intake valve controlled via electric valve actuation and an exhaust valve controlled via cam actuation including CPS and/or VCT. In other examples, the intake and exhaust valves may be controlled by a common valve actuator or actuation system, or a variable valve timing actuator or actuation system.

Cylinder 14 can have a compression ratio, which is the ratio of volumes when piston 138 is at bottom dead center position or top dead center position. In one example, the compression ratio is in the range of 9:1 to 10:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock.

In some examples, each cylinder of engine 10 may include a spark plug 192 for initiating combustion. Ignition system 190 can provide an ignition spark to combustion chamber 14 via spark plug 192 in response to spark advance signal SA from controller 12, under select operating modes. However, in some embodiments, spark plug 192 may be omitted, such as where engine 10 may initiate combustion by auto-ignition or by injection of fuel as may be the case with some diesel engines.

In some examples, each cylinder of engine 10 may be configured with one or more fuel injectors for providing fuel thereto. As a non-limiting example, cylinder 14 is shown including fuel injector 166. Fuel injector 166 is shown coupled directly to cylinder 14 for injecting fuel directly therein in proportion to the pulse width of signal FPW-1 received from controller 12 via electronic driver 168. In this manner, fuel injector 166 provides what is known as direct injection (hereafter referred to as "DI") of fuel into cylinder 14. While FIG. 1 shows injector 166 positioned to one side of cylinder 14, it may alternatively be located overhead of the piston, such as near the position of spark plug 192. Such a position may improve mixing and combustion when operating the engine with an alcohol-based fuel due to the lower volatility of some alcohol-based fuels. Alternatively, the injector may be located overhead and near the intake valve to improve mixing. Fuel may be delivered to fuel injector 166 from a fuel tank of fuel system 8 via a high pressure fuel pump, and a fuel rail. Further, the fuel tank may have a pressure transducer providing a signal to controller 12.

Additionally or alternatively, engine 10 may also include optional fuel injector 170 (shown as a dashed fuel injector). Fuel injector 166 and 170 may be configured to deliver fuel received from fuel system 8. As elaborated later in the detailed description, fuel system 8 may include one or more fuel tanks, fuel pumps, and fuel rails.

Optional fuel injector 170 is shown arranged in intake air passage 146, rather than in cylinder 14, in a configuration that provides what is known as port injection of fuel into the intake port upstream of cylinder 14. Optional fuel injector 170 may inject fuel, received from fuel system 8, in proportion to the pulse width of signal FPW-2 received from controller 12 via electronic driver 171. Note that a single electronic driver 168 or 171 may be used for both fuel injection systems, or multiple drivers, for example electronic driver 168 for fuel injector 166 and electronic driver 171 for optional fuel injector 170, may be used, as depicted.

In an alternate example, each of fuel injectors 166 and 170 may be configured as direct fuel injectors for injecting fuel directly into cylinder 14. In another example, each of fuel injectors 166 and 170 may be configured as port fuel injectors for injecting fuel upstream of intake valve 150. In yet other examples, cylinder 14 may include only a single fuel injector that is configured to receive different fuels from the fuel systems in varying relative amounts as a fuel mixture, and is further configured to inject this fuel mixture either directly into the cylinder as a direct fuel injector or upstream of the intake valves as a port fuel injector. In still another example, cylinder 14 may be fueled solely by optional fuel injector 170, or solely by port injection (also termed, intake manifold injection). As such, it should be appreciated that the fuel systems described herein should not be limited by the particular fuel injector configurations described herein by way of example.

Fuel may be delivered by both injectors to the cylinder during a single cycle of the cylinder. For example, each injector may deliver a portion of a total fuel injection that is combusted in cylinder 14. Further, the distribution and/or relative amount of fuel delivered from each injector may vary with operating conditions, such as engine load, knock, and exhaust temperature, such as described herein below. The port injected fuel may be delivered during an open intake valve event, closed intake valve event (e.g., substantially before the intake stroke), as well as during both open and closed intake valve operation. Similarly, directly injected fuel may be delivered during an intake stroke, as well as partly during a previous exhaust stroke, during the intake stroke, and partly during the compression stroke, for example. As such, even for a single combustion event, injected fuel may be injected at different timings from the port and direct injector. Furthermore, for a single combustion event, multiple injections of the delivered fuel may be performed per cycle. The multiple injections may be performed during the compression stroke, intake stroke, or any appropriate combination thereof.

As described above, FIG. 1 shows only one cylinder of a multi-cylinder engine. As such, each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 1 with reference to cylinder 14.

Fuel injectors 166 and 170 may have different characteristics. These include differences in size, for example, one injector may have a larger injection hole than the other. Other differences include, but are not limited to, different spray angles, different operating temperatures, different targeting, different injection timing, different spray characteristics, different locations etc. Moreover, depending on the distribution ratio of injected fuel among fuel injectors 170 and 166, different effects may be achieved.

Controller 12 is shown in FIG. 1 as a microcomputer, including microprocessor unit 106, input/output ports 108, an electronic storage medium for executable programs and calibration values shown as non-transitory read only memory chip 110 in this particular example for storing executable instructions, random access memory 112, keep alive memory 114, and a data bus. Controller 12 may receive various signals from sensors coupled to engine 10, in addition to those signals previously discussed, including measurement of inducted mass air flow (MAF) from mass air flow sensor 122; engine coolant temperature (ECT) from temperature sensor 116 coupled to cooling sleeve 118; a profile ignition pickup signal (PIP) from Hall effect sensor 120 (or other type) coupled to crankshaft 140; throttle position (TP) from a throttle position sensor; and absolute manifold pressure signal (MAP) from sensor 124. Engine speed signal, RPM, may be generated by controller 12 from signal PIP. Manifold pressure signal MAP from a manifold pressure sensor 124 may be used to provide an indication of vacuum, or pressure, in the intake manifold.

The controller 12 receives signals from the various sensors of FIG. 1 and employs the various actuators of FIG. 1 (e.g., throttle 162, fuel injector 166, optional fuel injector 170, etc.) to adjust engine operation based on the received signals and instructions stored on a memory of the controller.

Figure 2:
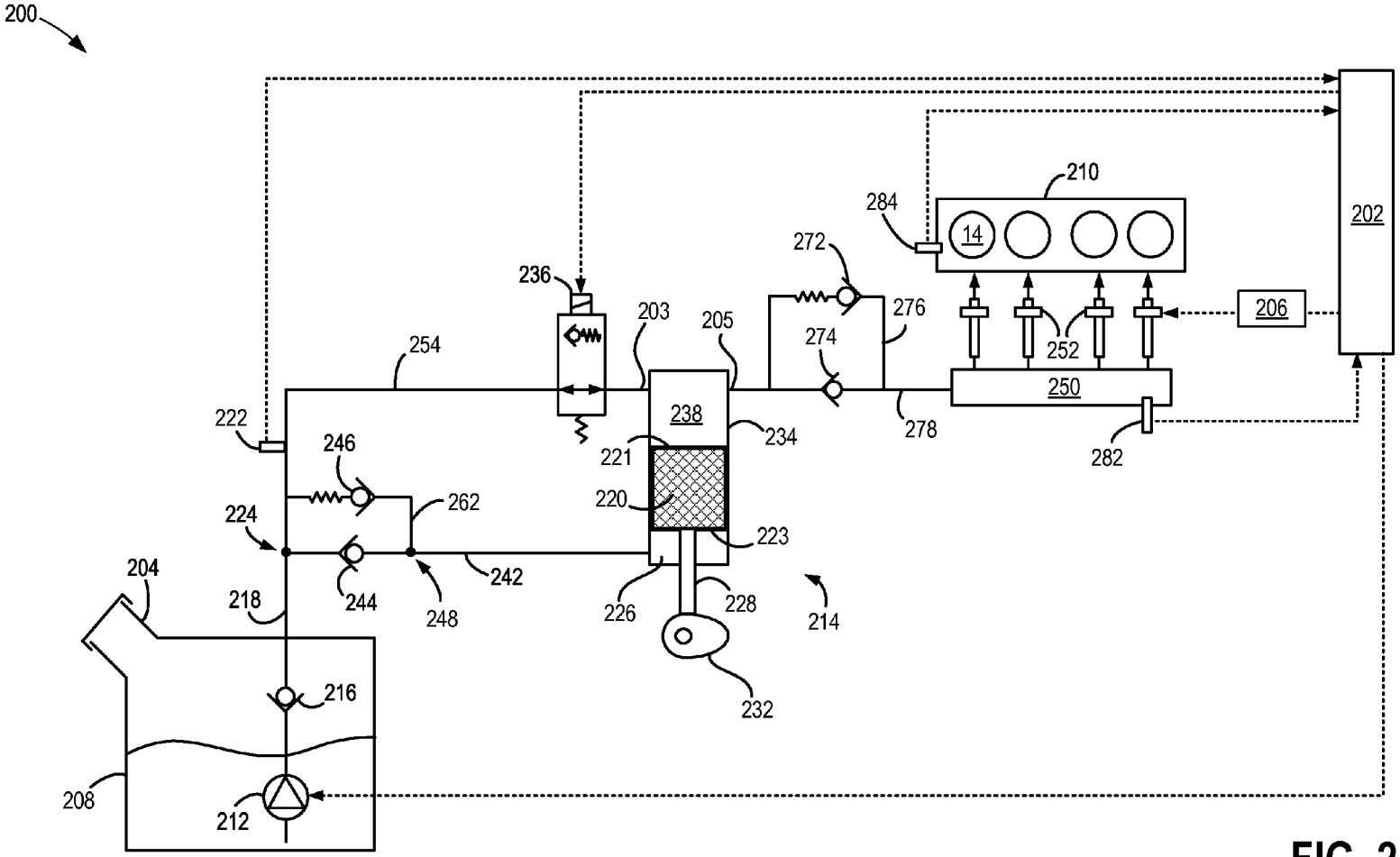
FIGS. 2, 3, and 4 schematically illustrate a first example embodiment, a second example embodiment, and a third example embodiment of a fuel system, respectively, that may be used with the engine of FIG. 1.

FIG. 2 schematically depicts a first example embodiment 200 of a fuel system, such as fuel system 8 of FIG. 1. First embodiment 200 of the fuel system may be operated to deliver fuel to an engine, such as engine 10 of FIG. 1. First embodiment 200 of the fuel system is depicted as a system including solely direct injectors. However, this is one example of the fuel system, and other embodiments may include additional components (or may include fewer components) without departing from the scope of this disclosure.

First embodiment 200 of the fuel system includes a fuel storage tank 208 for storing the fuel on-board the vehicle, a lower pressure fuel pump (LPP) 212 (herein also referred to as fuel lift pump 212), and a higher pressure fuel pump (HPP) 214 (herein also referred to as direct injection fuel pump 214 or DI pump 214). Fuel may be provided to fuel tank 208 via fuel filling passage 204. In one example, LPP 212 may be an electrically-powered lower pressure fuel pump disposed at least partially within fuel tank 208. LPP 212 may be operated by a controller 202 (e.g., similar to controller 12 of FIG. 1) to provide fuel to HPP 214 via fuel passage 218 (also termed low pressure passage 218). LPP 212 can be configured as what may be referred to as a fuel lift pump or simply a lift pump.

LPP 212 may be fluidly coupled to a filter (not shown), which may remove small impurities contained in the fuel that could potentially damage fuel handling components. A lift pump (LP) check valve 216, which may facilitate fuel delivery and maintain fuel line pressure, may be positioned downstream of LPP 212 and may be fluidically coupled to LPP 212. Further, LP check valve 216 may allow fuel flow from LPP 212 towards DI fuel pump 214 and may block fuel flow from DI fuel pump 214 to LPP 212. The LP check valve 216 may enable intermittent lift pump operation which can lower electrical power consumption of LPP 212.

A pressure relief valve (not shown) may also be situated within fuel storage tank 208 to limit the fuel pressure in low pressure passage 218 (e.g., the output from lift pump 212). In some embodiments, fuel system 8 may include additional (e.g., a series) of check valves fluidically coupled to low pressure fuel pump 212 to impede fuel from leaking back upstream of the valves. In this context, upstream flow refers to fuel flow traveling from first fuel rail 250 towards LPP 212 while downstream flow refers to the nominal fuel flow direction from the LPP towards the HPP 214 and thereon to the fuel rail(s).

Fuel lifted by LPP 212 may be supplied at a lower pressure into low pressure passage 218. Here onwards, a first portion of fuel may flow past node 224 through first check valve 244 into step room passage 242. Thereon, the first portion of fuel may flow into step chamber 226 of HP pump 214. A second portion of fuel may flow past node 224 into pump passage 254 and thereon into an inlet 203 of compression chamber 238 of HPP 214. HPP 214 may then deliver at least a part (or all) of the second portion of fuel into first fuel rail 250 coupled to one or more fuel injectors of a first group of injectors 252 (herein also referred to as a first injector group). First group of injectors 252 may be configured as direct injectors 252. As such, direct injectors 252 may deliver fuel directly into cylinders of engine 210.

It will be noted that pressure in pump passage 254 may be the same as pressure in low pressure passage 218. There may be no additional components or passages than those depicted in FIG. 2 in the first embodiment 200 of the fuel system.

The quantities of the first portion of fuel and the second portion of fuel may vary based on pump strokes in the HPP 214 as well as engine conditions. As mentioned above, the first portion of fuel may flow into step chamber 226 of HPP 214. Specifically, the first portion of fuel received via low pressure passage 218 may flow past node 224 and through first check valve 244 fluidically coupled along step room passage 242 into step chamber 226 (also termed herein as step room 226). First check vale 244 is biased to block flow from step chamber 226 towards low pressure passage 218 but allows flow from node 224 towards step chamber 226.

First pressure relief valve 246 may be fluidically coupled in a relief passage 262 such that first pressure relief valve 246 is arranged parallel to first check valve 244. First pressure relief valve 246 may include a ball and spring mechanism that seats and seals at a specified pressure differential, for example. The pressure differential set-point at which first pressure relief valve 246 may be configured to open and allow flow may assume various suitable values; as a non-limiting example the set-point may be 5 bar. As situated, first pressure relief valve 246 may allow fuel flow from step chamber 226 towards low pressure passage 218 when a pressure of the fuel flow exceeds the pressure setting of first pressure relief valve 246.

While the first fuel rail 250, also termed direct injector fuel rail 250, is shown dispensing fuel to four fuel injectors of the first injector group 252, it will be appreciated that first fuel rail 250 may dispense fuel to any suitable number of fuel injectors. As one example, first fuel rail 250 may dispense fuel to one fuel injector of first injector group 252 for each cylinder of the engine 210. As depicted, each cylinder of engine 210 may receive fuel at higher pressure from the first fuel rail via at least one direct injector of the first injector group 252. Engine 210 may be similar to example engine 10 of FIG. 1.

Controller 202 can individually actuate each of the direct injectors 252 via a first injection driver 206. The controller 202, the first injection driver 206, and other suitable engine system controllers can comprise a control system. While the first injection driver 206 is shown external to the controller 202, it should be appreciated that in other examples, the controller 202 can include the first injection river 206 or can be configured to provide the functionality of the driver 206. Controller 202 may include additional components not shown, such as those included in controller 12 of FIG. 1.

HPP 214 may be an engine-driven, positive-displacement pump. HPP 214 may be mechanically driven by the engine in contrast to the motor driven LPP 212. HPP 214 includes a pump piston 220, a pump compression chamber 238 (herein also referred to as compression chamber 238), and step room 226 (also referred to as step chamber 226). Piston stem 228 (also termed piston rod 228) of pump piston 220 receives a mechanical input from the engine crank shaft or cam shaft via driving cam 232, thereby operating the HPP according to the principle of a cam-driven single-cylinder pump. Thus, HPP 214 may be driven by the engine 210. A sensor (not shown) may be positioned near cam 232 to enable determination of the angular position of the cam (e.g., between 0 and 360 degrees), which may be relayed to controller 202. Pump piston 220 includes a piston top 221 and a piston bottom 223. The step room 226 and compression chamber 238 may include cavities positioned on opposing sides of the pump piston. For example, step room 226 may be a cavity formed underneath piston bottom 223 (also termed bottom surface 223) while compression chamber 238 may be a cavity formed above piston top 221 (also termed, top surface 221).

In one example, driving cam 232 may be in contact with piston rod 228 of the DI pump 214 and may be configured to drive pump piston 220 from bottom-dead-center (BDC) position to top-dead-center (TDC) position and vice versa, thereby creating the motion (e.g., reciprocating motion) necessary to pump fuel through compression chamber 238. Driving cam 232 includes four lobes and completes one rotation for every two engine crankshaft rotations. A return spring (not shown) keeps the piston rod 228 in contact with the driving cam or the cam's roller follower. A two-spring system may be used where one spring keeps the cam's roller follower in contact with the driving cam and a second much lighter spring keeps the pump piston in contact with the roller follower (or push rod).

Pump piston 220 reciprocates up and down within bore 234 of DI pump 214 to pump fuel. DI fuel pump 214 is in a compression stroke when pump piston 220 is traveling in a direction that reduces the volume of compression chamber 238. In other words, HPP 214 is in the compression stroke when a volume of step room 226 is increasing. Conversely, DI fuel pump 214 is in a suction or intake stroke when pump piston 220 is traveling in a direction that increases the volume of compression chamber 238. Said another way, DI fuel pump 214 is in the suction stroke when the volume of the step room 226 is decreasing. As such, the DI pump experiences compression strokes (also termed, delivery strokes) and suction strokes (also termed, intake strokes) as pump strokes in the DI fuel pump.

HPP 214 utilizes a solenoid activated check valve 236 (also termed as, fuel volume regulator, magnetic solenoid valve, spill valve, digital inlet valve, etc.) to vary the effective pump volume (e.g., duty cycle) of each pump stroke. As one example, a DI fuel pump duty cycle (also termed, duty cycle of the DI pump) may refer to a fractional amount of a full DI fuel pump volume to be pumped. Solenoid activated check valve 236 (SACV 236) is positioned, as shown in FIG. 2, upstream of inlet 203 to compression chamber 238 of DI pump 214. Controller 202 may be configured to regulate fuel flow into compression chamber 238 of HPP 214 through SACV 236 by energizing or de-energizing the SACV (based on the solenoid valve configuration) in synchronism with driving cam 232. Accordingly, the SACV 236 may be operated in a first mode (also termed, variable pressure mode or simply, the variable mode) where the SACV 236 blocks (e.g., limits) fuel traveling through the SACV 236. Specifically, fuel flow traveling upstream of the SACV 236 may be obstructed by energizing SACV 236 to closed position. In one example, a 10% DI fuel pump duty cycle may represent energizing the solenoid activated check valve such that 10% of the DI fuel pump volume may be pumped to the direct injector (DI) fuel rail. The SACV may also be operated in a second mode (termed, a default mode) where the SACV 236 is effectively disabled (e.g., de-activated) and fuel can travel both upstream and downstream of the SACV. Specifically, the SACV may be de-energized, and it functions in a pass-through mode. Furthermore, the SACV may be deactivated to the pass-through mode during the compression strokes when fuel flow to the direct injector fuel rail is ceased.

As such, SACV 236 may be configured to regulate the mass (or volume) of fuel compressed in the compression chamber of the direct injection fuel pump. In one example, controller 202 may adjust a closing timing of the SACV to regulate the mass of fuel compressed. For example, a late closing of the SACV relative to piston compression (e.g., volume of compression chamber is decreasing) may reduce the amount of fuel mass ingested into compression chamber 238 since more of the fuel displaced from the compression chamber 238 can flow through the SACV 236 before it closes. In contrast, an early closing of the SACV 236 relative to piston compression may increase the amount of fuel mass delivered from the compression chamber 238 to the pump outlet 205 (and thereon to the first fuel rail 250) since less of the fuel displaced from the compression chamber 238 can flow (in reverse direction) through the electronically controlled check valve 236 before it closes. The opening and closing timings of the SACV may be coordinated with respect to stroke timings of the direct injection fuel pump.

A lift pump fuel pressure sensor 222 may be positioned along low pressure passage 218 between lift pump 212 and HPP 214. In this configuration, readings from sensor 222 may be interpreted as indications of the fuel pressure of lift pump 212 (e.g., the outlet fuel pressure of the lift pump). Readings from sensor 222 may be used to assess the operation of various components in first embodiment 200 of the fuel system, to determine whether sufficient fuel pressure is provided to higher pressure fuel pump 214 so that the higher pressure fuel pump ingests liquid fuel and not fuel vapor, and/or to reduce the average electrical power supplied to lift pump 212. As such, the lift pump 212 may be operated at a lower power setting (e.g. minimum power setting) desired for providing liquid fuel and not fuel vapors to the HPP 214. Further, the LPP 212 may provide fuel at a lower pressure (e.g., sufficient to overcome fuel vapor pressure) to each of the compression chamber 238 and the step chamber 226 of DI pump 214. Fuel supplied by the LPP 212 may be pressurized further by the DI pump 214. By operating the lift pump at the lower power setting which provides fuel slightly above fuel vapor pressure, power consumption may be reduced and fuel economy may be improved. Further still, the DI pump may increase the pressure of the fuel received by the LPP 212 as will be described in the embodiments below. As such, the LPP may be maintained operational at a lower power setting throughout engine operation while the DI pump ensures desired pressurization of fuel being delivered to the first fuel rail 250 and, if present, a port injector fuel rail.

First fuel rail 250 (also termed, direct injector fuel rail 250 or DI fuel rail) includes a first fuel rail pressure sensor 282 for providing an indication of fuel rail pressure (FRP) in first fuel rail 250 to the controller 202. An engine speed sensor 284 can be used to provide an indication of engine speed to the controller 202. The indication of engine speed can be used to identify the speed of higher pressure fuel pump 214, since the DI fuel pump 214 is mechanically driven by the engine 210, for example, via a crankshaft or camshaft.

First fuel rail 250 is fluidically coupled to pump outlet 205 of HPP 214 (also termed, outlet 205 of compression chamber 238) via outlet fuel passage 278. An outlet check valve 274 and an outlet pressure relief valve 272 may be positioned between the pump outlet 205 of the HPP 214 and the first fuel rail 250. In the depicted example, outlet check valve 274 may be provided in outlet fuel passage 278 to reduce or prevent back-flow of fuel from first fuel rail 250 into DI fuel pump 214. In addition, outlet pressure relief valve 272, arranged parallel to outlet check valve 274 in bypass passage 276, may reduce the pressure in outlet fuel passage 278, downstream of HPP 214 and upstream of first fuel rail 250. For example, outlet pressure relief valve 272 may limit the pressure in outlet fuel passage 278 to 200 bar. Outlet check valve 274 allows fuel to flow from the outlet 205 of compression chamber 238 into first fuel rail 250 while blocking reverse flow from first fuel rail 250 to pump outlet 205.

First pressure relief valve 246 allows fuel flow out of step room 226 toward the LPP 212 when pressure between first pressure relief valve 246 and step chamber 226 is greater than a predetermined pressure (e.g., 5 bar). For example, during a suction stroke in DI pump 214, fuel in the step room 226 may be pushed out through step room passage 242 and may flow through first pressure relief valve 246 when pressure is greater than the pressure relief set-point of first pressure relief valve 246. Accordingly, pressure in the step chamber 226 rises to greater than that of the pressure relief set-point of the first pressure relief valve 246 during the suction stroke. For example, if first pressure relief valve 246 has a pressure relief setting of 5 bar, the pressure in step chamber 226 becomes 8 bar because the pressure relief setting of 5 bar is added to the 3 bar of lift pump pressure. In another example, output pressure of the lift pump may be 5 bar. Herein, step chamber pressure during the suction stroke may become 10 bar. As such, pressure in the step chamber is increased to higher than the output pressure of the lift pump 212 during the suction strokes. Thus, first pressure relief valve 246 may be biased to regulate pressure in step chamber 226 to a regulation pressure of a combination of lift pump output pressure and relief setting of the first pressure relief valve 246.

Further, first pressure relief valve 246 may regulate pressure in step chamber 226, particularly during the suction stroke of the DI pump, to a single substantially constant pressure (e.g., regulation pressure±0.5 bar) based on relief setting of first pressure relief valve 246 (e.g., 5 bar). Specifically, pressure in the step room 226 is increased during the suction stroke of the DI pump 214 relative to the output pressure of the low pressure pump 212. In one example, pressure in the step room increases towards (e.g., at) the beginning of the suction stroke. In another example, step room pressure may be at the regulation pressure before midpoint of the suction stroke. Herein, pressurization of the step room may occur at the beginning of the suction stroke and be maintained until an end of the suction stroke.

Thus, by incorporating first pressure relief valve 246 as shown in the first embodiment 200 of the fuel system, a self-pressurizing step chamber is obtained. Specifically, the step chamber may have a pressure greater than lift pump output pressure during at least one of the two strokes (e.g., compression stroke and suction stroke) in the DI pump 214.

As such, pressure in step chamber 226 may be greater than the output pressure of lift pump 212 during the suction stroke of the DI pump 214.

Regulating the pressure in the step chamber 226 allows a pressure differential to form between the piston top 221 and the piston bottom 223. The pressure in the compression chamber 238 is at the pressure of the outlet of the low pressure pump (e.g., 3 bar) during the suction stroke while the pressure in the step chamber is at pressure relief valve regulation pressure (e.g., 8 bar, based on relief setting of first pressure relief valve 246 being 5 bar). The pressure differential allows fuel to seep from the piston bottom to the piston top through the clearance between the piston and the bore, thereby lubricating HPP 214. Further, the piston-bore interface in HPP 214 may be cooled due to fuel seepage past the clearance between the piston and the bore of HPP 214. Thus, during at least the suction stroke of direct injection fuel pump 214, lubrication is provided to the pump. During the compression stroke, pressure in the step room 226 drops to a pressure at or about the output pressure of the lift pump 212. In the first example embodiment 200 of the fuel system, pressure in the compression chamber during the compression stroke may vary between output pressure of the lift pump and a desired pressure in the first fuel rail 250, based on the position of the SACV 236.

Lubrication of DI pump 214 may occur when a difference in pressure exists between compression chamber 238 and step room 226. This difference in pressures may also contribute to pump lubrication when controller 202 deactivates solenoid activated check valve 236. As such, while the direct injection fuel pump is operating, flow of fuel therethrough ensures sufficient pump lubrication and cooling. However, during conditions when direct injection fuel pump operation is not requested, such as when no direct injection of fuel is requested, the direct injection fuel pump may be sufficiently lubricated at least during a part of the pump stroke, e.g., during the suction stroke.

As such, fuel flow into compression chamber 238 during the suction stroke in the DI pump 214 may include flowing fuel from LPP 212 via low pressure passage 218, past node 224, into pump passage 254, through SACV 236 into compression chamber 238. Further, fuel may exit the step chamber 226 during the suction stroke via step room passage 242, past step node 248 into relief passage 262 through first pressure relief valve 246 into low pressure passage 218. During the compression stroke, fuel from LPP 212 may flow past node 224 into step room 226 via step room passage 242 and through first check valve 244. Further, if SACV 236 is de-energized to the pass-through mode, fuel may exit the compression chamber during the compression stroke through the SACV 236 into pump passage 254 towards LPP 212. Once the SACV is energized to close, the compression stroke builds fuel pressure in the compression chamber 238 as fuel exits the compression chamber 238 via outlet check valve 274 towards first fuel rail 250.

Figure 5:
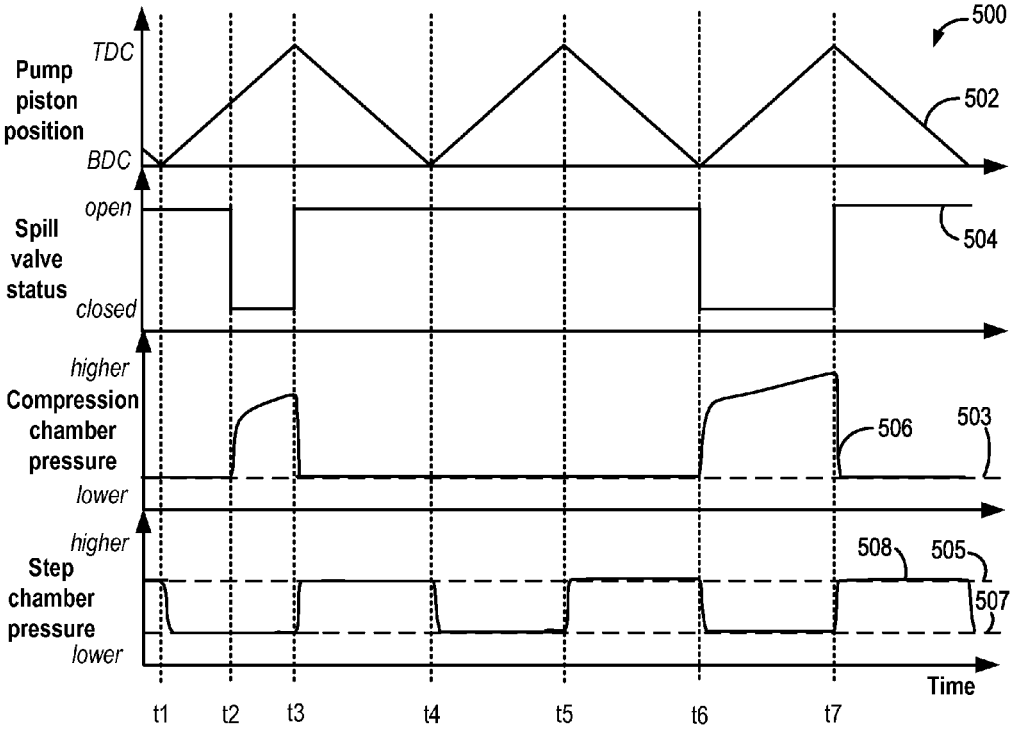
FIGS. 5, 6, and 7 portray example operating sequences of a direct injection fuel pump coupled in each of the first example embodiment of FIG. 2, the second example embodiment of FIG. 3, and the third example embodiment of FIG. 4, respectively.

Referring now to FIG. 5, it depicts an example operating sequence 500 of the DI pump 214 of FIG. 2. As such, operating sequence 500 will be described with relation to DI pump 214 shown in FIG. 2, but it should be understood that similar operating sequences may occur with other systems without departing from the scope of this disclosure.

Operating sequence 500 includes time plotted along the horizontal axis and time increases from the left to the right of the horizontal axis. Operating sequence 500 depicts pump piston position at plot 502, a spill valve (e.g., SACV 236) position at plot 504, compression chamber pressure at plot 506, and step chamber pressure at plot 508. Pump piston position may vary between the top dead center (TDC) and bottom-dead-center (BDC) positions of pump piston 220 as indicated by plot 502. For the sake of simplicity, the spill valve position of plot 504 is shown in FIG. 5 as either open or closed. The open position occurs when SACV 236 is de-energized or deactivated. The closed position occurs when SACV 236 is energized or activated. It will be understood that the closed position of the SACV is used for simplicity whereas in actuality, the SACV may be at a checked position. In other words, when the SACV is energized, the SACV functions as a check valve blocking the flow of fuel from the compression chamber of the DI pump towards pump passage 254. Line 503 represents an output pressure of the lift pump (e.g., LPP 212) relative to compression chamber pressure, line 505 represents a regulation pressure of the step chamber which may be the combined pressure of the pressure relief set-point of first pressure relief valve 246 and the lift pump pressure, and line 507 represents the output pressure of the lift pump (e.g., LPP 212) relative to step chamber pressure. As such, separate numbers (and lines) are used to indicate the lift pump pressure for enabling clarity. However, the output pressure of the lift pump is the same whether represented by line 503 or line 507. Furthermore, while the plot of pump piston position 502 is shown as a straight line, this plot may exhibit more oscillatory behavior. It is recognized that driving cam profiles are generally rounded and thus may not have sharp apexes. For the sake of simplicity and clarity, straight lines are used in FIG. 5 while it is understood that other plot profiles are possible.

Prior to t1, a suction stroke may be coming to an end. Pressure in the step chamber may be at the regulation pressure that may be a total of the pressure of the lift pump and the pressure relief set-point of the first pressure relief valve in FIG. 2 prior to t1.

At t1, pump piston may be at the BDC position (plot 502) and the spill valve (e.g., SACV 236) is de-energized and open to allow fuel to flow out of compression chamber 238 as a compression stroke begins. Thus, at t1, the pump piston commences a compression stroke as pump piston moves towards TDC. Since the spill valve is open, pressure in the compression chamber may substantially be at the output pressure of the LPP (line 503). Further, fuel in the compression chamber may be ejected towards the LPP 212 when the spill valve is open. Specifically, fuel may be pushed by pump piston backwards through SACV 236, through pump passage 254 into low pressure passage 218 towards the lift pump 212. The spill valve may be open during the compression stroke if fuel flow to the direct injector fuel rail is not desired. Pressure in the step chamber reduces to that of the output pressure of the lift pump (line 507) at t1 and remains at LPP pressure through the compression stroke between t1 and t3.

At t2, the spill valve may be energized into the closed position and fuel flow through the SACV 236 may be terminated. Herein, the SACV may be energized in response to an indication of desired fuel flow into the direct injector fuel rail. Specifically, a desired volume of fuel may be trapped within the compression chamber of the DI fuel pump. As pump piston continues towards TDC, compression chamber pressure rises sharply towards fuel rail pressure. The fuel rail pressure may be a desired fuel rail pressure in the DI fuel rail. Between the energizing of solenoid spill valve 236 at t2 and attaining TDC position at t3, the remaining fuel (or trapped volume) in compression chamber 238 is pressurized and sent through outlet check valve 274. The amount of fuel pressurized between time t2 and TDC position at t3 may be dependent on the commanded fractional trapping volume. In the example shown, solenoid spill valve 236 is energized to close about halfway through the compression stroke of the pump piston (halfway between BDC and TDC). Accordingly, the trapping volume (and duty cycle) commanded may be 50%. In other examples, trapping volume may be smaller (e.g., 15%). In yet other examples, commanded duty cycles may be higher (e.g., 75%).

Between t2 and t3, a differential pressure exists between the compression chamber and the step chamber since the step room is at a pressure similar to the lift pump pressure while pressure in the compression chamber is higher than the lift pump pressure, as depicted. Accordingly, fuel may leak past the piston-bore interface in the DI pump from the compression chamber into the step chamber. Further, lubrication and cooling of the piston-bore interface in the DI pump may occur during a portion of the compression stroke in the DI pump.

At t3, the compression stroke ends as the pump piston is at TDC and a subsequent suction stroke commences in the DI pump as the pump piston begins traveling towards BDC. At t3, the spill valve may be de-energized to conserve electrical energy. Whether energized or not, the spill valve may open to allow fresh fuel to enter the compression chamber. Accordingly, pressure in the compression chamber reduces to that of the lift pump output pressure. The step chamber, however, witnesses a rapid increase in pressure as the pump piston moves towards BDC expelling fuel from the step chamber 226 towards the low pressure passage 218 of FIG. 2 via first pressure relief valve 246. As depicted, the increase in pressure in the step room occurs immediately after the suction stroke begins or at the beginning of the suction stroke. Throughout the suction stroke, the step room may be pressurized to the single regulation pressure (line 505) that is a combination of the pressure relief set-point of the first pressure relief valve 246 and the lift pump output pressure. It will be appreciated that pressurized, herein, indicates an increase in positive pressure. A differential pressure again exists between the compression chamber and the step chamber during the suction stroke since the compression chamber is at the output pressure of the lift pump while the step room is at a higher pressure (e.g., single regulation pressure of combination of relief setting of first pressure relief valve and lift pump pressure). Consequently, fuel may leak along the piston-bore interface (e.g., from step chamber to compression chamber) providing lubrication and cooling to the DI pump during the suction stroke of the DI pump, e.g., between t3 and t4.

At t4, the suction stroke ends as the pump piston reaches BDC and a subsequent compression stroke may ensue as the pump piston begins travel towards TDC from BDC. The subsequent compression stroke may be performed in default mode of the HPP as the spill valve is maintained de-energized and open throughout the compression stroke between t4 and t5 (plot 504). Accordingly, each of the compression chamber and the step chamber may be at similar pressures e.g. lift pump output pressure. During the compression stroke between t4 and t5, there may be no appreciable pressure difference across the pump piston.

The compression stroke in the default mode of the HPP ends at t5 and a suction stroke may follow as the pump piston commences travel from TDC towards BDC. The spill valve is open and the compression chamber pressure remains substantially at (e.g., within 5% of) the LPP output pressure. However, as in the previous suction stroke (between t3 and t4), pressure in the step room rises to that of the regulation pressure (line 505) which is higher than LPP output pressure (line 507). Thus, lubrication of the piston-bore interface occurs during the suction stroke between t5 and t6.

The pump piston reaches BDC at t6 at the end of the suction stroke and begins the subsequent compression stroke. At t6, a 100% duty cycle may be commanded to the DI pump such that the spill valve is energized at the start of the compression stroke allowing substantially 100% of the fuel in the compression chamber to be trapped, and delivered to the direct injector fuel rail 250. Accordingly, spill valve is closed at t6 and compression chamber pressure increases significantly as the compression stroke begins. The step room, on the other hand, may have a lower pressure as fuel is drawn into the step chamber from the lift pump. Specifically, the step room may now be at a similar pressure as the output pressure of the low pressure pump 212. The difference in pressures between the compression chamber and the step chamber enables lubrication of the piston-bore interface in the DI pump. The ensuing suction stroke after t7 may be similar to the suction strokes between t3 and t4, and between t5 and t6.

Thus, the step room may be provided a positive pressure that is higher than lift pump output pressure during the suction stroke. As shown in FIG. 5, the pressure in the step room may increase to that of the regulation pressure (e.g., set by the first pressure relief valve) at the beginning of the suction stroke. By pressurizing the step room to a pressure higher than the output pressure of the lift pump, fuel vaporization may be diminished. As such, since the output pressure of the lift pump may be at or slightly higher than fuel vapor pressure, the pressure in the step room may be higher than fuel vapor pressure, even at higher temperatures. Further, by pressurizing the step room, during the suction stroke as shown in FIG. 5, lubrication of the DI pump may occur during the suction stroke as well.

Figure 3:
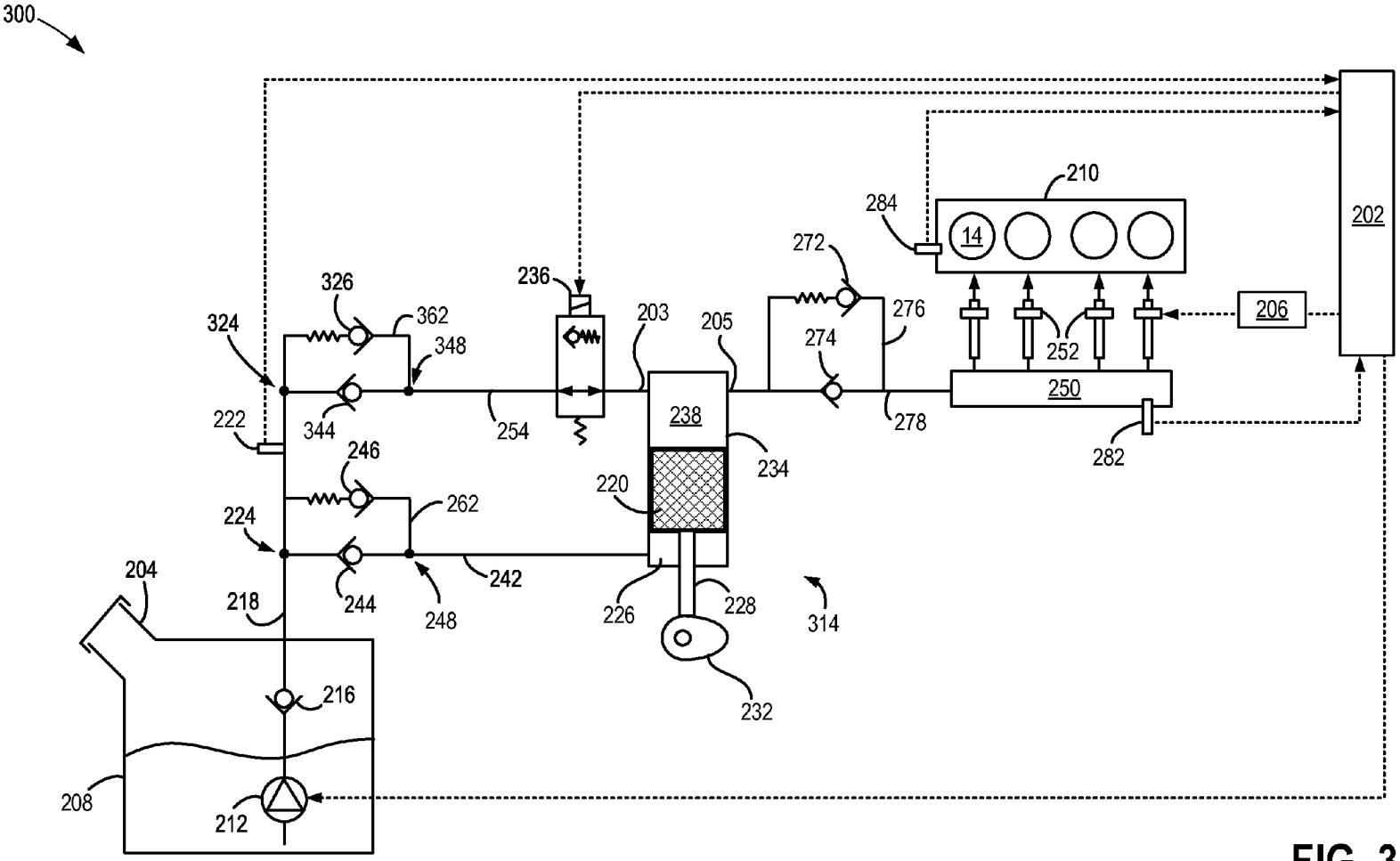

Turning now to FIG. 3, it schematically shows a second example embodiment 300 of a fuel system. The second example embodiment 300 may be similar to the first embodiment 200 of the fuel system of FIG. 2. Specifically, second embodiment 300 may include multiple components that are present in the first example embodiment 200 of FIG. 2. Accordingly, components previously introduced in FIG. 2 are numbered similarly in FIG. 3 and not reintroduced. Second embodiment 300, however, includes additional components not included in FIG. 2.

Specifically, second embodiment 300 enables a default pressure in the compression chamber 238 of the DI pump 314 by positioning a second pressure relief valve 326 biased to regulate pressure in the compression chamber of the DI pump 314. Further, fuel at the default pressure may be provided to the DI fuel rail 250, when desired.

As such, DI fuel pump 314 of FIG. 3 may be similar to DI fuel pump 214 of FIG. 2, and may differ primarily in the inclusion of the second pressure relief valve 326 and a second check valve 344. Second check valve 344 is positioned upstream of SACV 236 along pump passage 254. Second check valve 344 may be biased to inhibit fuel flow out of SACV 236 towards low pressure passage 218. However, second check valve 344 allows flow from the low pressure fuel pump 212 to SACV 236. Specifically, second portion of fuel received from LPP 212 past node 224 may flow past node 324 through second check valve 344 past node 348 into SACV 236, and thereon into inlet 203 of compression chamber 238 of DI pump 314.

Second check valve 344 may be coupled in parallel with second pressure relief valve 326. Second pressure relief valve 326 may be fluidically coupled to second relief passage 362 at a location upstream of SACV 236. As such, each of second check valve 344 and second pressure relief valve 326 may be fluidically coupled to compression chamber 238 of DI pump 314. Second pressure relief valve 326 allows fuel flow out of SACV 236 towards the low pressure fuel pump 212 when pressure between second pressure relief valve 326 and SACV 236 is greater than a predetermined pressure (e.g., 10 bar). The predetermined pressure may be a pressure relief set-point of second pressure relief valve 326. When SACV 236 is deactivated (e.g., not electrically energized), SACV 236 operates in the pass-through mode and second pressure relief valve 326 regulates pressure in compression chamber 238 to a single regulation pressure based on relief setting of second pressure relief valve 326.

To elaborate, when SACV 236 is in the pass-through mode and pump piston 220 is traveling towards TDC position, reflux fuel may exit compression chamber 238 towards node 348. Since second check valve 344 blocks fuel flow towards low pressure passage 218, reflux fuel may then enter second relief passage 362 from node 348. Herein, reflux fuel may flow through second pressure relief valve 326 towards low pressure passage 218 only when pressure of the fuel exceeds the relief pressure setting of the second pressure relief valve 326.

An effect of this regulation method is that the compression chamber 238 and direct injector fuel rail 250 is regulated to approximately the pressure relief setting of second pressure relief valve 326. This regulation may occur during the compression stroke when the SACV is in pass-through mode. Thus, if second pressure relief valve 326 has a pressure relief setting of 10 bar, the compression chamber pressure (and fuel rail pressure in first fuel rail 250) becomes 13 bar because the 10 bar of the second pressure relief valve 326 is added to 3 bar of lift pump pressure. Thus, compression chamber pressure during the compression stroke may be higher than lift pump pressure. In this way, the fuel pressure in compression chamber 238 may be regulated during the compression stroke of direct injection fuel pump 314.

It will be noted that pressure in pump passage 254 may be different and dissimilar from that in the low pressure passage 218 during certain portions of the pump strokes. For example, during the compression stroke, the presence of second check valve 344 and second pressure relief valve 326 may cause a different pressure (e.g., higher) than that in the low pressure passage 218.

Similar to first embodiment 200 of FIG. 2, second embodiment 300 of fuel system also includes first pressure relief valve 246 which may be biased to regulate pressure in step room 226 of DI pump 314. However, pressure relief setting of first pressure relief valve 246 may be distinct and dissimilar from pressure relief setting of second pressure relief valve 326. In one example, pressure relief setting of first pressure relief valve 246 may be 5 bar while pressure relief setting of second pressure relief valve 326 may be 10 bar. In another example, pressure relief setting of first pressure relief valve 246 may be 8 bar while pressure relief setting of second pressure relief valve 326 may be 15 bar. Other pressure relief settings may be possible without departing from the scope of this disclosure. For example, the pressure relief setting of first pressure relief valve 246 may be higher than that of the second pressure relief valve 326.

In this way, each of the compression chamber and the step chamber may be pressurized by their respective pressure relief valves. Specifically, the compression chamber may be pressurized during the compression stroke while the step room is pressurized (e.g., increase in positive pressure) during the suction stroke.

Figure 6:
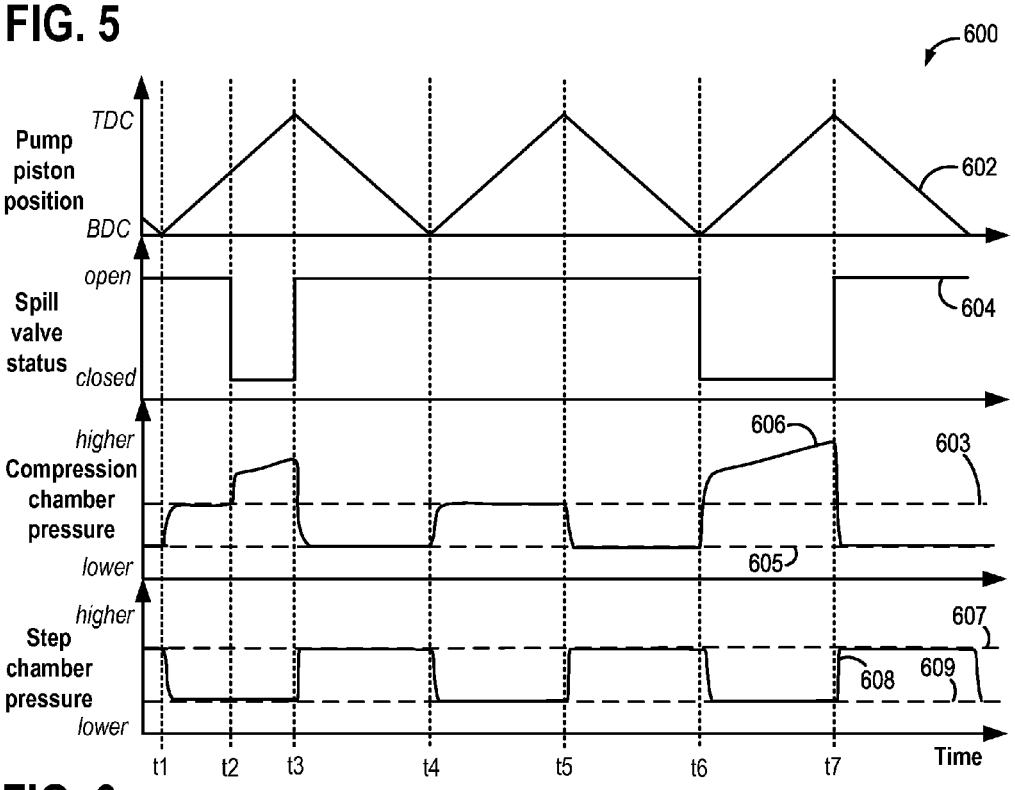

Turning now to FIG. 6, it illustrates an example operating sequence 600 of the DI pump 314 of FIG. 3. As such, operating sequence 600 will be described with relation to DI pump 314 shown in FIG. 3, but it should be understood that similar routines may be used with other systems without departing from the scope of this disclosure.

Operating sequence 600 includes time plotted along the horizontal axis and time increases from the left to the right of the horizontal axis. Operating sequence 600 depicts pump piston position at plot 602, a spill valve (e.g., SACV 236) position at plot 604, compression chamber pressure at plot 606, and step chamber pressure at plot 608. Pump piston position may vary between the top-dead-center (TDC) and bottom-dead-center (BDC) positions of pump piston 220 as indicated by plot 602. For the sake of simplicity, the spill valve position of plot 604 is shown in FIG. 6 as either open or closed, similar to that in FIG. 5. The open position occurs when SACV 236 is de-energized or deactivated. The closed position occurs when SACV 236 is energized or activated. It will be understood that the closed position of the SACV is used for simplicity whereas in actuality, the SACV may be at a checked position. In other words, when the SACV is energized, the SACV functions as a check valve blocking the flow of fuel from the compression chamber of the DI pump towards pump passage 254. Line 603 represents regulation pressure of compression chamber 238 of DI pump 314 (e.g., pressure relief setting of second pressure relief valve 326+ lift pump output pressure), line 605 represents an output pressure of the lift pump (e.g., LPP 212) relative to compression chamber pressure, line 607 represents a regulation pressure of the step room e.g., combined pressure of the pressure relief set-point of first pressure relief valve 246 and the lift pump pressure, and line 609 represents the output pressure of the lift pump (e.g., LPP 212) relative to step chamber pressure. As such, separate numbers (and lines) are used to indicate the lift pump pressure for enabling clarity. However, the output pressure of the lift pump is the same whether represented by line 605 or line 609. Furthermore, while the plot of pump piston position 602 is shown as a straight line, this plot may exhibit more oscillatory behavior. For the sake of simplicity, straight lines are used in FIG. 6 while it is understood that other plot profiles are possible.

Similar to operating sequence 500 of FIG. 5, operating sequence 600 of FIG. 6 includes three compression strokes, e.g., from t1 to t3, from t4 to t5, and from t6 to t7. The first compression stroke (from t1 to t3) comprises holding the spill valve at open (e.g. de-energized) for a first half of the first compression stroke and closing it at t2 (e.g., by energizing) for the remainder of the first compression stroke. The second compression stroke from t4 to t5 includes holding the spill valve at open (e.g., de-energized) through the entire second compression stroke while the third compression stroke from t6 to t7 includes maintaining the spill valve at closed (e.g., energized) through the complete third compression stroke. A 100% duty cycle may be commanded to the DI pump during the third compression stroke such that the spill valve is energized at the start of the third compression stroke allowing substantially 100% of the fuel in the compression chamber to be trapped, and delivered to the direct injector fuel rail 250. Operating sequence 600, like operating sequence 500, also includes three suction strokes (from t3 to t4, from t5 to t6, and from t7 till end of plot). Each suction stroke ensues a preceding corresponding compression stroke as shown in FIG. 6.

Operating sequence 600 illustrates pressurizing the step room (e.g., increasing positive pressure in the step room of DI pump 314) to the regulation pressure of the step room (line 607), such as the combined pressure of the pressure relief set-point of first pressure relief valve 246 and the lift pump pressure, during each of the three suction strokes. As depicted, the increase in pressure in the step room occurs immediately after each suction stroke begins, and the step room may be pressurized throughout each suction stroke. The compression chamber receives fuel from the LPP 212 during each suction stroke and is therefore, at the LPP pressure during each suction stroke.

Pressure in the compression chamber is at the regulation pressure of the compression chamber (line 603) throughout the second compression stroke since the spill valve is in pass-through mode the entire duration. In the third compression stroke, pressure in the compression chamber is higher than the regulation pressure since the spill valve is closed through the entire duration. Specifically, compression chamber pressure may reach a desired fuel rail pressure for the first fuel rail 250. In the first compression stroke, compression chamber pressure is at the regulation pressure while the spill valve is open, but once the spill valve is closed, compression chamber pressure rises to higher than the regulation (or default) pressure. The step room may be at substantially (e.g., within 5% of) the lift pump pressure through each of the compression strokes.

Thus, in the second embodiment 300 of the fuel system including DI pump 314, a pressure differential may exist across the pump piston during each pump stroke (e.g., each compression stroke and each suction stroke). During the compression stroke, the compression chamber has a higher pressure than the step room (whether spill valve is open or closed), and during the suction stroke, the step room has a higher pressure than the compression chamber. Specifically, a difference in pressure is produced between the compression chamber and the step chamber during each compression stroke and suction stroke in the DI pump. The differential pressure across the pump piston enables a leak flow of fuel in the piston-bore interface allowing lubrication and cooling of the piston-bore interface of the DI pump through all pump strokes in DI pump 314. Further, similar to the first embodiment 200, the step room may be provided a positive pressure during each suction stroke. By pressurizing the step room to a pressure higher than the output pressure of the lift pump, fuel vaporization may be diminished. Further still, by pressurizing the step room by using a pressure relief valve (e.g., first pressure relief valve 246), the pressure in the step room may be controlled (e.g., limited) to reduce leaks at the seal of the step room. The lift pump can be operated at a lower power setting and may not be used to pump a higher pressure to the step room. Herein, the step room may self-pressurize via the pressure relief valve.

An example method for operating a high pressure fuel pump in an engine may, thus, comprise regulating a pressure in a step chamber of the high pressure fuel pump to a single pressure during a suction stroke, the pressure greater than an output pressure of a low pressure pump supplying fuel to the direct injection fuel pump. The pressure in the step chamber may be regulated by a first pressure relief valve (such as, first pressure relief valve 246 of FIG. 2 and FIG. 3), the first pressure relief valve fluidically coupled to the step chamber. The method may also comprise regulating a pressure in a compression chamber of the high pressure fuel pump to a single pressure during a compression stroke in the high pressure fuel pump. Herein, the pressure in the compression chamber may be regulated via a second pressure relief valve (in one example, second pressure relief valve 326 of FIG. 3), the second pressure relief valve fluidically coupled to the compression chamber of the high pressure pump, and not fluidically coupled to the step chamber of the high pressure fuel pump. A differential pressure may be produced between the compression chamber and the step chamber during each of the suction stroke and the compression stroke.

Thus, an example system may comprise an engine including a cylinder, a direct injection fuel pump including a piston, a compression chamber, a step chamber arranged below a bottom surface of the piston, a cam for moving the piston, and a solenoid activated check valve (Such as SACV 236) positioned at an inlet of the compression chamber of the direct injection fuel pump, a lift pump fluidically coupled to each of the compression chamber and the step chamber of the direct injection fuel pump, a first pressure relief valve (such as first pressure relief valve 246) fluidically coupled to the step chamber of the direct injection fuel pump, the first pressure relief valve biased to regulate pressure in the step chamber, a second pressure relief valve (such as second pressure relief valve 326 of FIG. 3) positioned upstream of the solenoid activated check valve and fluidically coupled to the compression chamber of the direct injection fuel pump, the second pressure relief valve biased to regulate pressure in the compression chamber, a direct injector fuel rail fluidically coupled to the compression chamber of the direct injection fuel pump, and a direct injector providing fuel to the cylinder, the direct injector receiving fuel from the direct injector fuel rail.

The step chamber may be pressurized during a suction stroke in the direct injection fuel pump, wherein the step chamber is pressurized to a pressure higher than an output pressure of the lift pump during the suction stroke in the direct injection fuel pump (as shown in operating sequence 600 between t3 and t4, for example). The step chamber may substantially be, e.g., within 5%, at the output pressure of the lift pump during a compression stroke in the direct injection fuel pump (as shown in operating sequence 600 between t4 and t5, for example). The compression chamber may be pressurized during the compression stroke in the direct injection fuel pump, wherein the compression chamber is pressurized to a pressure higher than the output pressure of the lift pump during the compression stroke in the direct injection fuel pump (as shown in operating sequence 600 between t4 and t5, for example). The compression chamber may be pressurized during the compression stroke when the solenoid activated check valve is open and/or closed. The example system may also include a controller with computer-readable instructions stored on non-transitory memory for adjusting a status of the solenoid activated check valve to regulate pressure in the direct injector fuel rail (such as at t2 and t6 in operating sequence 600). The controller may include instructions for closing the solenoid activated check valve to increase pressure in the compression chamber of the direct injection fuel pump to higher than a setting of the second pressure relief valve based on a desired fuel rail pressure in the direct injector fuel rail (such as at t2 and at t6 in operating sequence 600).

Figure 4:
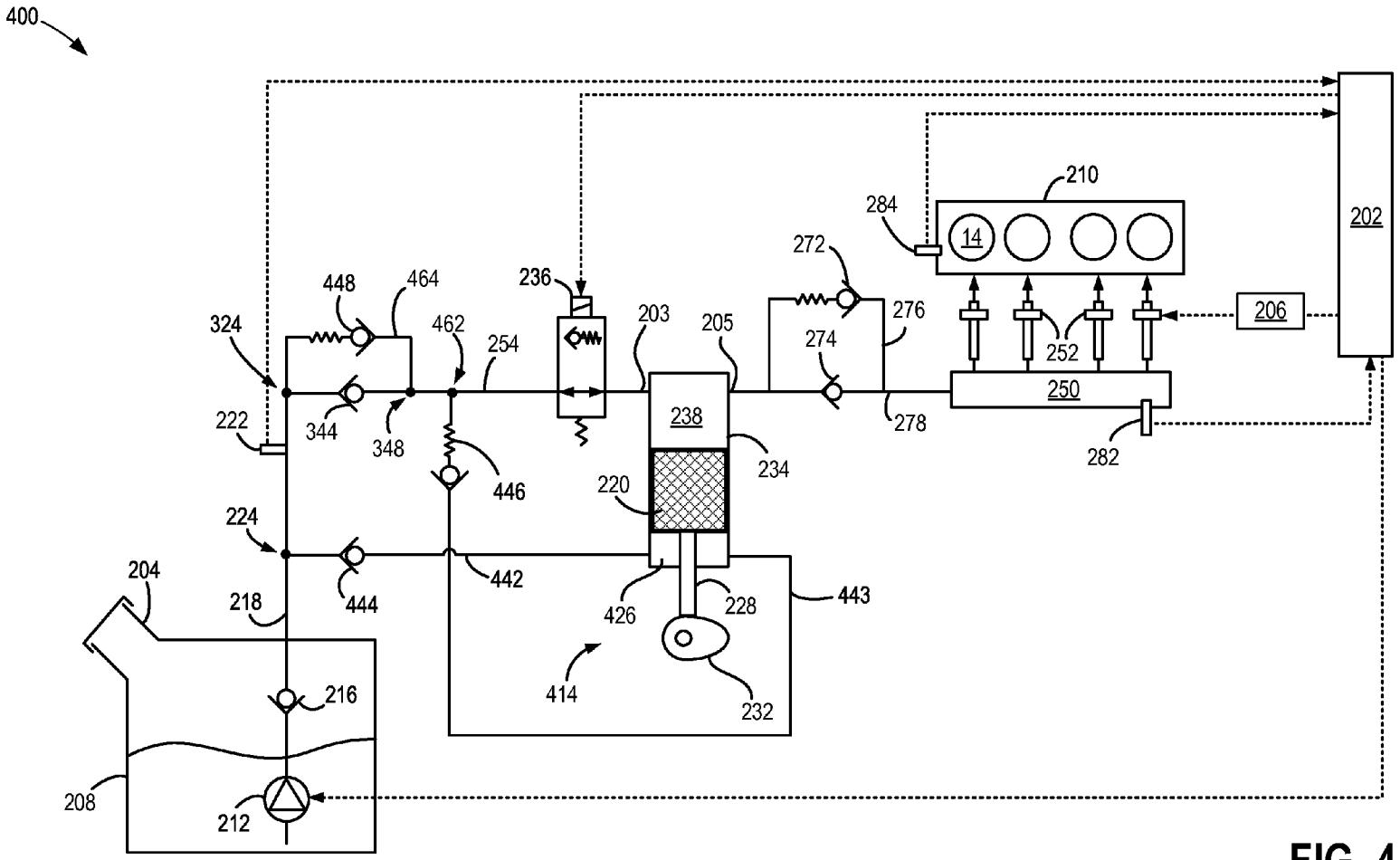

Referring now to FIG. 4, an example third embodiment 400 of the fuel system is presented. The third embodiment 400 may be similar to the second embodiment 300 of FIG. 3 except that the step chamber 426 of DI pump 414 experiences circulation of fuel. Circulation of fuel may allow the fuel to remain isothermal. In comparison, fuel in step chamber of DI pump 314 may not be isothermal and may instead dissipate energy into heat. Many components of FIG. 4 are similar to those shown in FIGS. 2 and 3, and are similarly numbered and not reintroduced.

Third embodiment 400 of the fuel system includes DI pump 414 which may experience enhanced circulatory flow of fuel in the step chamber 426 while providing similar technical effects as DI pump 314 of second embodiment 300.

Circulation in step chamber 426 of DI pump 414 may be provided by flowing the first portion of fuel from LPP 212 via node 224, through check valve 444 coupled in step room passage 442 into step chamber 426. Further, the first portion of fuel may then exit step chamber 426 via second step room passage 443. As depicted, step room passage 442 may be coupled to step room 426 at a location that is opposite to a location where second step room passage 443 is coupled to the step room 426. Circulation of fuel in the step chamber 426 is provided by ensuring that fuel entry into the step room occurs at a location that is different from where fuel exits the step room.

Pressure relief valve 446 may be fluidically coupled to second step room passage 443. Pressure relief valve 446 may be coupled to second step room passage 443 at other locations than that shown in FIG. 4. As such, pressure relief valve 446 may be the same as first pressure relief valve 246 of FIGS. 2 and 3, and may have the same pressure relief setting as first pressure relief valve 246. As shown, pressure relief valve 446 may be biased to regulate pressure in the step chamber 426.

During a suction stroke, fuel may exit step chamber 426 via second step room passage 443 through pressure relief valve 446, past node 462, to merge into pump passage 254. This fuel received from step chamber 426 into pump passage 254 may then flow through SACV 236 into compression chamber 238 of DI pump 414 during the continuing suction stroke.

Meanwhile, pressure relief valve 448 fluidically coupled to compression chamber 238 may be biased to regulate pressure in the compression chamber 238 during a compression stroke. Pressure relief valve 448 may enable a default pressure (e.g., regulation pressure) in DI pump 414 when SACV 236 is in pass-through mode during the compression stroke and the direct injectors are deactivated. As such, the relief setting of pressure relief valve 448 may be different from that of second pressure relief valve 326 of second embodiment 300 in FIG. 3. Alternatively, the pressure set-point of pressure relief valve 448 may be similar to the relief setting of second pressure relief valve 326 of second embodiment 300 in FIG. 3.

DI pump 414 of third embodiment 400 of the fuel system may be lubricated during each of the compression strokes and the suction strokes in the DI pump, similar to DI pump 314. It will be noted that pressure relief settings of pressure relief valve 448 and pressure relief valve 446 may be dissimilar, in one example.

Figure 7:
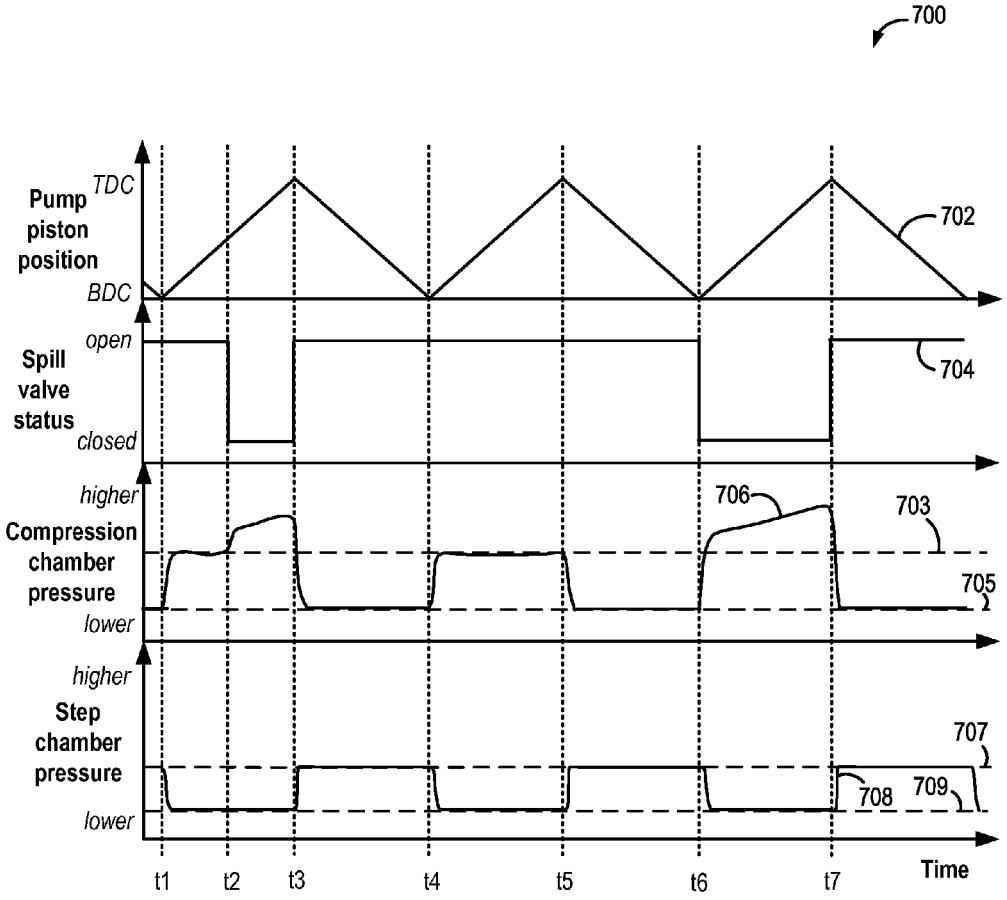

FIG. 7 illustrates an example operating sequence 700 of DI pump 414 of third embodiment 400 of the fuel system. Operating sequence 700 includes time plotted along the horizontal axis and time increases from the left to the right of the horizontal axis. Operating sequence 700 depicts pump piston position at plot 702, a spill valve (e.g., SACV 236) position at plot 704, compression chamber pressure at plot 706, and step chamber pressure at plot 708. Pump piston position may vary between the top-dead-center (TDC) and bottom-dead-center (BDC) positions of pump piston 220 as indicated by plot 702. For the sake of simplicity, the spill valve position of plot 704 is shown in FIG. 7 as either open or closed, similar to that in FIGS. 5 and 6. The open position occurs when SACV 236 is de-energized or deactivated. The closed position occurs when SACV 236 is energized or activated. The SACV may function as a check valve when energized. Specifically, the SACV when energized blocks the flow of fuel from the compression chamber towards the pump passage 254.

Line 703 represents regulation pressure of compression chamber 238 of DI pump 414 (e.g., pressure relief setting of pressure relief valve 448+lift pump output pressure), line 705 represents an output pressure of the lift pump (e.g., LPP 212) relative to compression chamber pressure, line 707 represents a regulation pressure of the step room e.g., combined pressure of the pressure relief set-point of pressure relief valve 446 and the lift pump pressure, and line 709 represents the output pressure of the lift pump (e.g., LPP 212) relative to step chamber pressure. As such, separate numbers (and lines) are used to indicate the lift pump pressure for enabling clarity. However, the output pressure of the lift pump is the same whether represented by line 705 or line 709. Furthermore, while the plot of pump piston position 702 is shown as a straight line, this plot may exhibit more oscillatory behavior. For the sake of simplicity and clarity, straight lines are used in FIG. 7 while it is understood that other plot profiles are possible.

The operating sequence 700 may be substantially similar to the operating sequence 600 of FIG. 6 and therefore is not elaborated herein. Similar to operating sequence 600, the compression chamber of DI pump 414 in operating sequence 700 is regulated to a single regulation pressure (line 703) during the compression strokes when the spill valve is open. Further, compression chamber pressure is significantly higher when the spill valve is closed with a trapped volume of fuel in the compression chamber. Pressure in the step chamber is reduced to that of lift pump pressure during each compression stroke. Further still, the step chamber is regulated to a single regulation pressure of the step chamber (line 707) during the suction strokes in the DI pump 414. Furthermore, pressure in the compression chamber is reduced to that of lift pump pressure during each suction stroke.

Thus, a pressure differential may exist across the pump piston in DI pump 414 during each pump stroke (e.g., each compression stroke and each suction stroke). During the compression stroke, the compression chamber has a higher pressure than the step room (whether spill valve is open or closed), and during the suction stroke, the step room has a higher pressure than the compression chamber. Fuel may thus leak past the piston-bore interface within the DI pump during each pump stroke providing cooling and lubrication.

Overall, in each of the second and third embodiments of the fuel system (and DI pump), lubrication and cooling of the piston-bore interface in the DI pump may be ensured due to the presence of differential pressure across the pump piston during each of the compression and suction strokes in the DI pump.

Lubrication of the DI fuel pump may be largely ensured when the pump piston experiences a pressure greater than vapor pressure in its forward direction of motion. Thus, in the compression stroke in DI pump 314 and DI pump 414, the forward direction of pump piston 220 may include towards compression chamber. Herein, the pump piston 220 experiences a pressure greater than vapor pressure (e.g., lift pump output pressure) in the compression chamber (due to second pressure relief valve 326 and pressure relief valve 448, respectively). While in the suction stroke, the forward direction of pump piston 220 may be towards the step chamber 226 of DI pump 314 and step chamber 426 of DI pump 414. In the suction stroke in DI pump 314 and DI pump 414, the pump piston 220 experiences a pressure greater than vapor pressure (e.g., lift pump output pressure) in the step chamber (due to first pressure relief valve 246 in DI pump 314, and pressure relief valves 446 and 448 in DI pump 414 respectively).

Another approach to providing lubrication is by exposing the pump piston to a higher pressure in the direction of motion than in the trailing direction. In the compression stroke in DI pump 314 and DI pump 414, the direction of motion of pump piston 220 may be towards compression chamber 238 while the trailing direction may be the step chamber. Herein, the pump piston 220 is exposed to a higher pressure in the compression chamber than in the step chamber 226 (as shown between t1 and t3, t4 and t5, and t6 and t7 of operating sequences 600 and 700). In the suction stroke, direction of motion of pump piston 220 may be towards the step chamber 226 in DI pump 314, and towards step room 426 in DI pump 414. In the suction stroke in each of DI pump 314 and DI pump 414, the pump piston 220 experiences a higher pressure in the step chamber than in the trailing direction of the compression chamber 238 (as depicted between t3 and t4, t5 and t6, and t7 onwards till end of plot in operating sequences 600 and 700).

Figure 8:
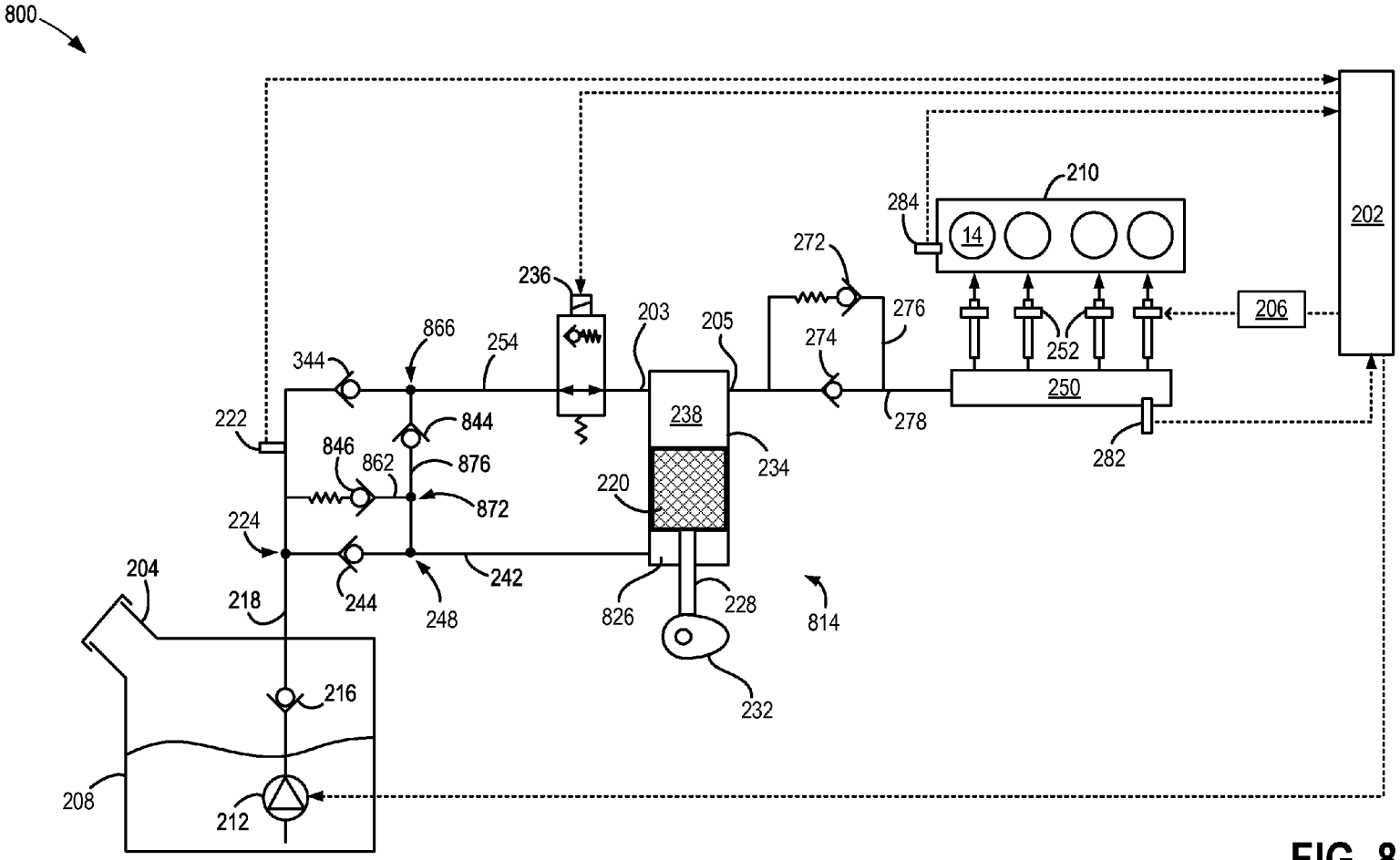
FIG. 8 shows a fourth example embodiment of the fuel system.

Turning now to FIG. 8, it schematically presents a fourth embodiment 800 of the fuel system including DI pump 814. Many components of fourth embodiment 800 are similar to those described earlier (and included) in first embodiment 200 and second embodiment 300 of the fuel system. Accordingly, these common components may be numbered similarly and may not be re-introduced.

As such, fourth embodiment 800 is distinct from each of first embodiment 200 and second embodiment 300 in that fourth embodiment 800 includes a common pressure relief valve 846, biased to regulate pressure in each of the compression chamber 238 and step chamber 826 of DI pump 814. As such, common pressure relief valve 846 may be the sole pressure relief valve utilized in the fourth embodiment 800. Furthermore, step chamber 826 is fluidically coupled to compression chamber 238 in the fourth embodiment. Thus, the step chamber 826 may receive fuel from compression chamber 238 during a compression stroke in the DI pump 814 when SACV 236 is in pass-through state.

Common pressure relief valve 846 is coupled parallel to first check valve 246 in relief passage 862. Further, common pressure relief valve 846 may have a distinct pressure relief setting relative to those of first pressure relief valve 246 in respective first and second embodiments 200 and 300, second pressure relief valve 326 in second embodiment 300, and pressure relief valves 446 and 448 in third embodiment 400. In one example, the pressure relief set-point of common pressure relief valve 846 may be 6 bar. In another example, the pressure relief set-point of common pressure relief valve 846 may be 8 bar.

During a compression stroke in DI pump 814, if SACV 236 is open and in the pass-through mode, reflux fuel may exit compression chamber 238 via SACV 236 towards pump passage 254. Further, this reflux fuel, being blocked along pump passage 254 by second check valve 344 may be diverted at node 866 to flow through third check valve 844. As shown, third check valve 844 may be coupled in bypass passage 876, and may allow flow from pump passage 254 to relief passage 862 and/or step room passage 242. Specifically, bypass passage 876 fluidically couples pump passage 254 to each of relief passage 862 and step room passage 242. As such, pump passage 254 may be fluidically coupled to step chamber via bypass passage 876 and step room passage 242.

A portion of the reflux fuel from compression chamber 238 may flow into step chamber 826 via bypass passage 876, across nodes 872 and 248, and through step room passage 242. As such, step chamber may not receive fuel from LPP 212 across first check valve 244 while receiving fuel from compression chamber 238. Further still, the compression chamber may supply fuel to the step chamber as long as the spill valve (SACV 236) is open. Fuel may be supplied at a regulation pressure set by common pressure relief valve 846. Further, as the pressure in bypass passage 876 increases to overcome the relief setting of common pressure relief valve 846, another portion of reflux fuel may flow through bypass passage 876, past node 872 into relief passage 862, and through common pressure relief valve 846 towards LPP 212. If the spill valve closes before the completion of the compression stroke, the step chamber may receive fuel from the LPP 212 through low pressure passage 218, past first check valve 244, into step room passage 242, and thereon into step room 826.

It will be appreciated herein that additional components to those described here may not be included in bypass passage 876. Accordingly, no intervening components than those described above may be included in the passages.

Common pressure relief valve 846 may regulate pressure in the compression chamber to a single pressure based on the relief setting of the common pressure relief valve. Similar to first embodiment 200 of FIG. 2, fourth embodiment 800 of fuel system also includes pressurizing the step room 826 via common pressure relief valve 846 to a regulation pressure that is higher than lift pump pressure. In one example, pressure relief setting of common pressure relief valve 846 may be 8 bar. Thus, regulation pressure in compression chamber 238 during compression stroke may be the sum of lift pump pressure and pressure relief setting of common pressure relief valve 846, e.g., 13 bar (5 bar+8 bar, respectively). Similarly, regulation pressure of step chamber during the suction stroke may be 13 bar, the combination of lift pump pressure and pressure relief setting of common pressure relief valve 846. Thus, common pressure relief valve 846 may regulate the compression chamber to the same regulation pressure during the compression stroke as it does the step room in the suction stroke.

Thus, an example method for a direct injection fuel pump in an engine may include increasing a pressure in a step chamber of the direct injection fuel pump during at least a portion of a pump stroke in the direct injection fuel pump, the pressure increased to higher than an output pressure of a lift pump. The portion of the pump stroke, in one example, includes a portion of a suction stroke in the direct injection fuel pump. For example, the pressure in the step chamber may be increased during the suction stroke at the beginning of the suction stroke. Alternatively, the pressure in the step room may be increased just after the beginning of the suction stroke. The increase in pressure in the step chamber during the suction strokes may be maintained for the entire duration of the suction stroke such that the pressure in the step chamber is increased at the end of the suction stroke. The method includes increasing pressure in the step chamber via a first pressure relief valve (e.g., 246 of FIGS. 2, 3, 446 of FIG. 4, and 846 of FIG. 8), the first pressure relief valve fluidically coupled to the step chamber. In another example, the portion of the pump stroke includes a portion of a compression stroke in the direct injection fuel pump, the portion based on a duration that a spill valve positioned at an inlet to a compression chamber of the direct injection fuel pump is held open. In the fourth embodiment 800, pressure in the step chamber is also increased during the compression stroke when the SACV is open. The pressure in the step chamber may be increased via delivering pressurized fuel from a compression chamber of the direct injection fuel pump to the step chamber of the direct injection fuel pump. The lift pump may supply fuel to the direct injection fuel pump, the direct injection fuel pump driven by the engine and the lift pump being an electrical pump.

In an example representation, an example system may comprise an engine including a cylinder, a direct injection fuel pump including a piston, a compression chamber, a step chamber arranged below a bottom surface of the piston, a cam for moving the piston, and a solenoid activated check valve positioned at an inlet of the direct injection fuel pump, a lift pump fluidically coupled to each of the compression chamber and the step chamber of the direct injection fuel pump, a pressure relief valve biased to regulate pressure in each of the compression chamber and the step chamber (e.g., common pressure relief valve 846), a direct injector fuel rail fluidically coupled to the compression chamber of the direct injection fuel pump, and a direct injector providing fuel to the cylinder, the direct injector coupled to and receiving fuel from the direct injector fuel rail.

Figure 9:
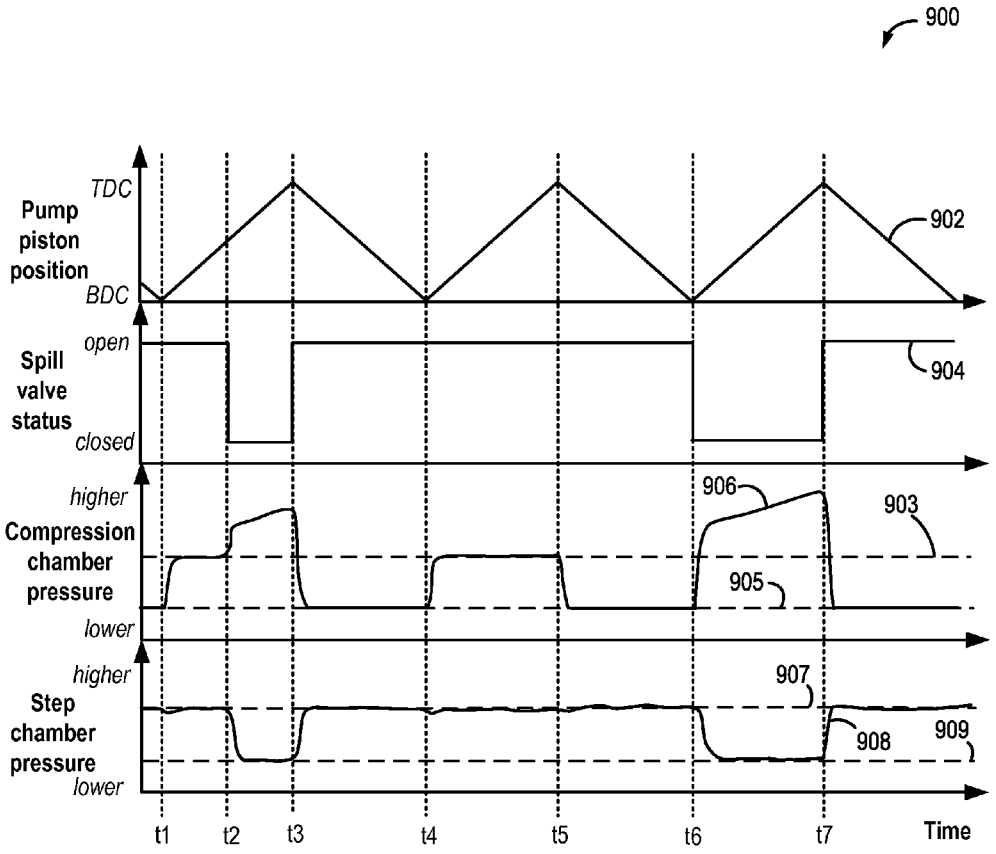
FIG. 9 depicts an example operating sequence of a direct injection fuel pump of the fourth example embodiment of the fuel system.

Referring now to FIG. 9, it depicts example operating sequence 900 of DI pump 814 included in fourth embodiment 800 of the fuel system. Operating sequence 900 includes time plotted along the horizontal axis and time increases from the left to the right of the horizontal axis. Operating sequence 900 depicts pump piston position at plot 902, a spill valve (e.g., SACV 236) position at plot 904, compression chamber pressure at plot 906, and step chamber pressure at plot 908. Pump piston position may vary between the top-dead-center (TDC) and bottom-dead-center (BDC) positions of pump piston 220 as indicated by plot 902. For the sake of simplicity, the spill valve position of plot 904 is shown in FIG. 9 as either open or closed, similar to that in FIGS. 5 and 6. The open position occurs when SACV 236 is de-energized or deactivated. The closed position occurs when SACV 236 is energized or activated. It will be understood that the closed position of the SACV is used for simplicity whereas in actuality, the SACV may be at a checked position. In other words, when the SACV is energized, the SACV functions as a check valve blocking the flow of fuel from the compression chamber of the DI pump towards pump passage 254.

Line 903 represents regulation pressure of compression chamber 238 of DI pump 814 (e.g., pressure relief setting of common pressure relief valve 846+lift pump output pressure), line 905 represents an output pressure of the lift pump (e.g., LPP 212) relative to compression chamber pressure, line 907 represents a regulation pressure of the step room e.g., combined pressure of the pressure relief set-point of common pressure relief valve 846 and the lift pump pressure, and line 909 represents the output pressure of the lift pump (e.g., LPP 212) relative to step chamber pressure. As such, separate numbers (and lines) are used to indicate the lift pump pressure for enabling clarity. However, the output pressure of the lift pump is the same whether represented by line 905 or line 909. It will be noted that the regulation pressure in each of the compression chamber and the step chamber may be the same, though represented as distinct lines 903 and 907. However, in some cases, if third check valve 844 has intentional or unintentional flow resistance, third check valve 844 may raise regulation pressure of compression chamber (line 903) to higher than regulation pressure of step chamber (line 907). Furthermore, while the plot of pump piston position 902 is shown as a straight line, this plot may exhibit more oscillatory behavior. For the sake of simplicity and clarity, straight lines are used in FIG. 9 while it is understood that other plot profiles are possible.

Similar to operating sequence 500 of FIG. 5 and operating sequence 600 of FIG. 6, operating sequence 900 of FIG. 9 includes three compression strokes, e.g., from t1 to t3, from t4 to t5, and from t6 to t7. The first compression stroke (from t1 to t3) comprises holding the spill valve at open (de-energized) for a first half of the first compression stroke and closing it at t2 (energizing) for the remainder half of the first compression stroke. The second compression stroke from t4 to t5 includes holding the spill valve at open (e.g., de-energized) through the entire second compression stroke while the third compression stroke from t6 to t7 includes maintaining the spill valve at closed (energized) through the complete third compression stroke. A 100% duty cycle may be commanded to the DI pump during the third compression stroke such that the spill valve is energized at the start of the third compression stroke allowing substantially 100% of the fuel in the compression chamber to be trapped, and delivered to the direct injector fuel rail 250. Operating sequence 900, like operating sequences 500 and 600, also includes three suction strokes (from t3 to t4, from t5 to t6, and from t7 till end of plot). Each suction stroke ensues a preceding corresponding compression stroke as shown in FIG. 9.

Operating sequence 900 illustrates pressurizing the step room (e.g., increasing positive pressure in the step room of DI pump 814) to the regulation pressure of the step room (line 907), e.g., the combined pressure of the pressure relief set-point of common pressure relief valve 846 and the lift pump pressure, during each of the three suction strokes. As depicted, the increase in pressure in the step room occurs immediately after each suction stroke begins (as shown at t3 and t7), and the step room may be pressurized throughout each suction stroke. The compression chamber receives fuel from the LPP 212 during each suction stroke and is therefore, at the LPP pressure during each suction stroke.

Pressure in the compression chamber is at the regulation pressure of the compression chamber (line 903) throughout the second compression stroke since the spill valve is in pass-through mode the entire duration. In the third compression stroke, pressure in the compression chamber is higher than the regulation pressure since the spill valve is closed through the entire duration. Specifically, compression chamber pressure may be at the desired fuel rail pressure for the first fuel rail 250. In the first compression stroke, compression chamber pressure is at the regulation pressure while the spill valve is open, but once the spill valve is closed, compression chamber pressure rises to higher than the regulation (e.g., default) pressure.

The fourth embodiment 800 also includes pressurizing the step room during a compression stroke as long as the spill valve is in pass-through mode. During the second compression stroke, the step room may be at substantially (e.g., within 5% of) the regulation pressure since the spill valve is open and step chamber receives fuel at the compression chamber pressure from the compression chamber. However, during the third compression stroke, since the spill valve is closed at the beginning of the third compression stroke, step room pressure does not receive fuel from the compression chamber. Accordingly, pressure in the step chamber reduces to that of the output pressure of the LPP, as shown at t6, as the step room receives fuel from the lift pump between t6 and t7. During the first compression stroke, the step room is pressurized to the regulation pressure (between t1 and t2) as long as the spill valve is open and pressurized fuel enters the step room from the compression chamber. Once the spill valve closes (at t2), step room pressure drops to that of LPP output pressure (between t2 and t3). Thus, the duration that the step room is pressurized by the compression chamber during a compression stroke may be based on how long the spill valve is held open. Accordingly, when the spill valve is closed at the beginning of the third compression stroke, the step chamber is not pressurized during the third compression stroke, whereas in the default mode, the step room is pressurized throughout the compression stroke (e.g., second compression stroke). Further, the step room is pressurized only during the first half of first compression stroke until the spill valve is energized to close.

In this way, the step room in fourth embodiment 800 of FIG. 8 may be pressurized during each of the compression stroke and the suction stroke. During the suction stroke, the common pressure relief valve enables an increase in pressure in the step room to the regulation pressure (e.g., higher than LPP pressure). During the compression stroke, pressure in the step room is higher than the output pressure of the LPP as long as the SACV is open to pass-through state. As such, the compression chamber can pressurize the step chamber during the compression stroke when the SACV is opened. Lubrication of the DI pump 814 may be enhanced in each pump stroke since the pump piston experiences a pressure higher than fuel vapor pressure in its direction of motion.

An example method for operating a high pressure fuel pump in an engine may, thus, comprise regulating a pressure in a step chamber of the high pressure fuel pump to a single pressure during a suction stroke, the pressure greater than an output pressure of a low pressure pump supplying fuel to the direct injection fuel pump. The pressure in the step chamber may be regulated by a first pressure relief valve (in one example, common pressure relief valve 846 of FIG. 8), the first pressure relief valve fluidically coupled to the step chamber. The method may also comprise regulating a pressure in a compression chamber of the high pressure fuel pump to a single pressure during a compression stroke in the high pressure fuel pump. Herein, the pressure in the compression chamber may be regulated via the first pressure relief valve, the first pressure relief valve fluidically coupled to the compression chamber as well as the step chamber of the high pressure pump. Specifically, the first pressure relief valve may be biased to regulate pressure in each of the step chamber and the compression chamber of the high pressure pump.

Figure 10:
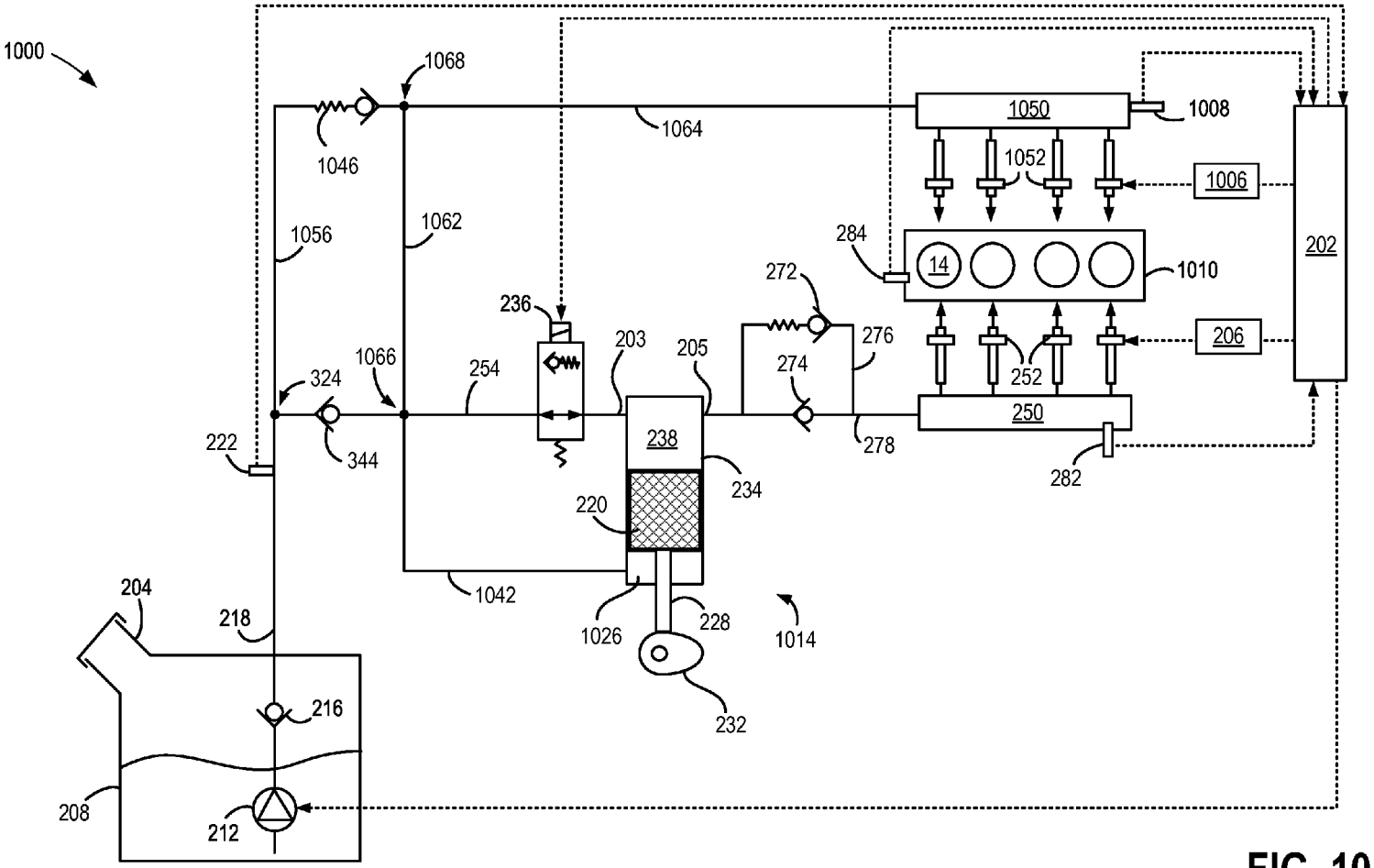
FIG. 10 shows a fifth example embodiment of the fuel system including port injectors and direct injectors.

FIG. 10 includes a fifth example embodiment 1000 of the fuel system including DI pump 1014. Many components of fifth embodiment 1000 are similar to those described earlier (and included) in first embodiment 200 and second embodiment 300 of the fuel system. Accordingly, these common components may be numbered similarly and may not be re-introduced.

The fifth embodiment 1000 includes a second fuel rail 1050 fluidically coupled to each of the HPP 1014 and LPP 212. In the depicted example, second fuel rail 1050 may be a port injector fuel rail 1050 supplying fuel to a plurality of port injectors 1052. Thus, cylinders of engine 1010 may be fueled by port injectors as well as direct injectors. Thus, engine 1010 may be a PFDI engine.

Controller 202 can individually actuate each of the port injectors 1052 via a second injection driver 1006. The controller 202, the second injection driver 1006, the first injection driver 206, and other suitable engine system controllers can comprise a control system. While the second injection driver 1006 is shown external to the controller 202, it should be appreciated that in other examples, the controller 202 can include the second injection driver 1006 or can be configured to provide the functionality of the second injection driver 1006. Controller 202 may include additional components not shown, such as those included in controller 12 of FIG. 10.

It will be noted that though second fuel rail 1050 is depicted as fueling four port injectors 1052, the port injector fuel rail 1050 may fuel additional or fewer port injectors without departing from the scope of this disclosure.

Fifth embodiment 1000 includes second check valve 344 coupled to pump passage 254, as in previously described embodiments. Step chamber 1026 in DI pump 1014 can receive fuel from compression chamber 238 during a compression stroke in the DI pump when the SACV is open via pump passage 254, through node 1066, and along step room passage 1042. Additional fuel, if desired, may be supplied to the step chamber during the compression stroke from the lift pump 212 via low pressure passage 218, past node 324, through second check valve 344, past node 1066, and into step room passage 1042. The additional fuel from the lift pump may be received in the step chamber 1026 after SACV 236 is energized to close during the compression stroke.

Further still, the compression chamber 238 may also supply fuel to the port injector fuel rail 1050 (also termed, PFI rail 1050) during the compression stroke as long as the SACV 236 is open. As such, fuel may be supplied to the second fuel rail 1050 after the step chamber 1026 is filled and pressurized. Thus, on the compression stroke (with SACV un-energized) the fuel volume that is pushed toward the PFI rail 1050 from the compression chamber is the difference of the compression chamber displacement (e.g., 0.25 cc) and the step chamber displacement (e.g. 015 cc). Herein, the net displacement is 0.10 cc, and therefore, 0.1 cc of fuel may be delivered into PFI rail 1050. Step chamber displacement is a function of the size of the piston stem 228. Accordingly, if the diameter of the piston rod 228 is increased, the net displacement may also be increased.

Fuel flow from compression chamber 238 to second fuel rail 1050 may occur as reflux fuel exits compression chamber 238 via SACV 236, into pump passage 254, via node 1066 towards port passage 1062, past node 1068 and into port supply passage 1064, and thereon into port injector fuel rail 1050.

Third pressure relief valve 1046 is coupled in relief passage 1056 to allow fuel flow in the direction of lift pump 212 when pressure at node 1068 is greater than the pressure relief setting of third pressure relief valve 1046. The pressure relief setting of third pressure relief valve 1046 may be different and distinct from pressure relief settings of previously introduced pressure relief valves in previous embodiments. It will be noted that third pressure relief valve 1046 may be biased to regulate pressure in the compression chamber 238, and in the PFI rail 1050.

During a suction stroke in DI pump 1014, fuel from the step chamber may flow from step room 1026 thru step room passage 1042 towards node 1066. At node 1066, fuel may be diverted towards SACV 236 and compression chamber 238, and may not flow into port passage 1062. Thus, the step room may not be pressurized by third pressure relief valve 1046 during the suction stroke. As such, the step room may be pressurized by the compression chamber during the compression stroke alone when the SACV is open. At the same time, the step chamber may not supply fuel to PFI rail 1050.

Figure 11:
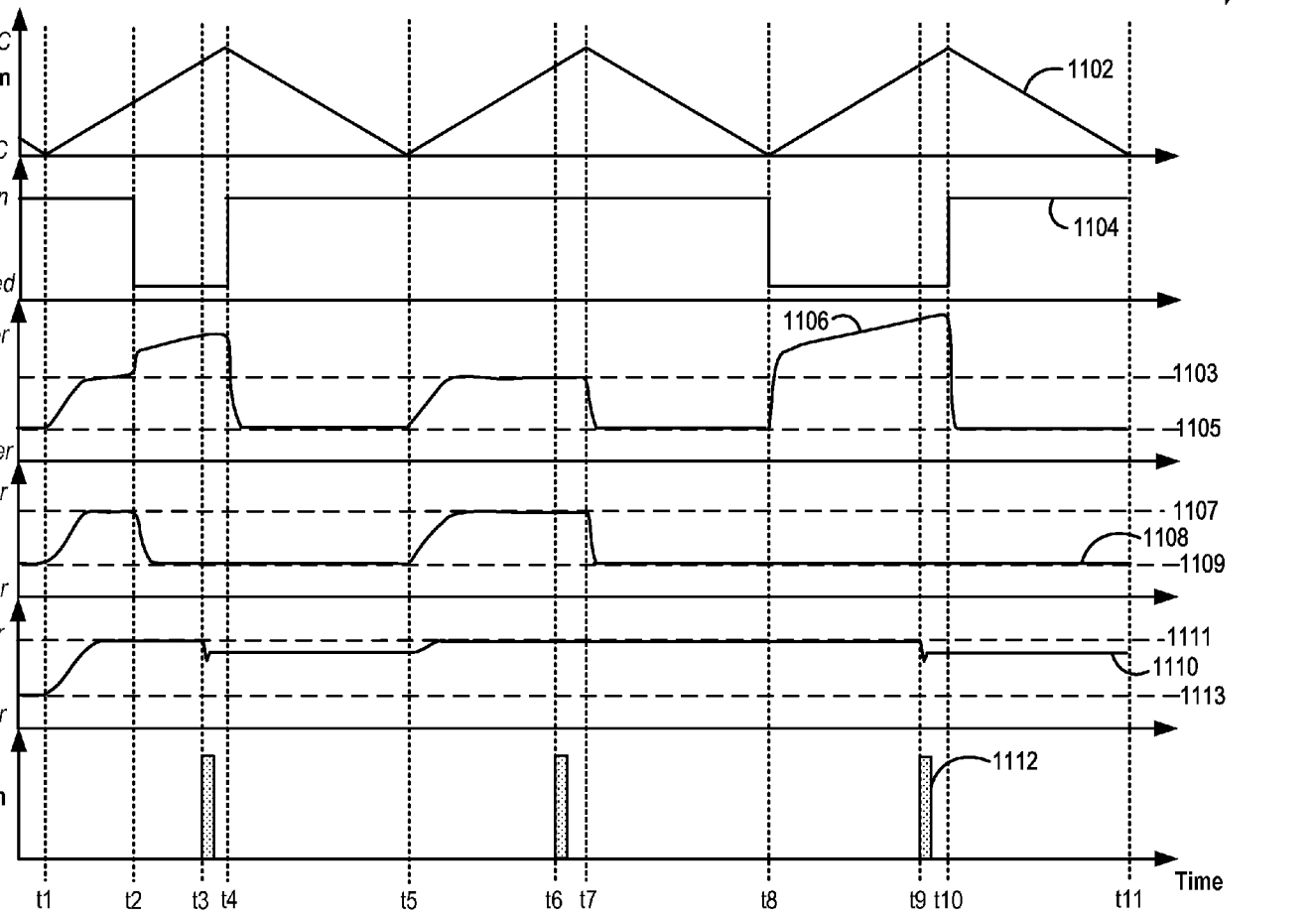
FIG. 11 depicts an example operating sequence of a direct injection fuel pump in the fifth example embodiment of the fuel system.

Turning now to FIG. 11, an example operating sequence 1100 in DI fuel pump 1014 is depicted. Operating sequence 1100 includes time plotted along the horizontal axis and time increases from the left to the right of the horizontal axis. Operating sequence 1100 depicts pump piston position at plot 1102, a spill valve (e.g., SACV 236) position at plot 1104, compression chamber pressure at plot 1106, step chamber pressure at plot 1108, changes in fuel rail pressure (FRP) in the port injector (PFI) fuel rail at plot 1110, and port injections at plot 1112. Pump piston position may vary between the top-dead-center (TDC) and bottom-dead-center (BDC) positions of pump piston 220 as indicated by plot 1102. For the sake of simplicity, the spill valve position of plot 1104 is shown in FIG. 11 as either open or closed, similar to that in FIGS. 5 and 6. The open position occurs when SACV 236 is de-energized or deactivated. The closed position occurs when SACV 236 is energized or activated. As such, the SACV is termed as closed when energized for the sake of simplicity. It will be understood that the SACV functions as a check valve preventing fuel flow from the compression chamber into the pump passage when energized.

Line 1103 represents regulation pressure of compression chamber 238 of DI pump 1014 (e.g., pressure relief setting of third pressure relief valve 1046+lift pump output pressure), line 1105 represents an output pressure of the lift pump (e.g., LPP 212) relative to compression chamber pressure, line 1107 represents a regulation pressure of the step room which may be similar to the regulation pressure of the compression chamber e.g., combined pressure of the pressure relief set-point of third pressure relief valve 1046 and the lift pump pressure, and line 1109 represents the output pressure of the lift pump (e.g., LPP 212) relative to step chamber pressure. Line 1111 represents the regulation pressure of the PFI rail which may be similar to the regulation pressure of the compression chamber (line 1103). Line 1113 represents the output pressure of the lift pump (e.g., LPP 212) relative to PFI rail pressure. As such, separate lines are used to indicate the lift pump pressure for enabling clarity. However, the output pressure of the lift pump is the same whether represented by line 1105, line 1113, or line 1109. It will be noted that the regulation pressure in each of the compression chamber, the PFI rail, and the step chamber may be the same, though represented as distinct lines 1103, 1111, and 1107. Furthermore, while the plot 1102 of pump piston position is shown as a straight line, this plot may exhibit more oscillatory behavior. For the sake of simplicity, straight lines are used in FIG. 11 while it is understood that other plot profiles are possible.

Operating sequence 1100 of FIG. 11 includes three compression strokes, e.g. from t1 to t4, from t5 to t7, and from t8 to t10. The first compression stroke (from t1 to t4) comprises holding the spill valve at open (e.g., de-energized) for a first half of the first compression stroke and closing it at t2 (e.g., energized to close) for the remainder of the first compression stroke. The second compression stroke from t5 to t7 includes holding the spill valve at open (e.g. de-energized) through the entire second compression stroke while the third compression stroke from t8 to t10 includes maintaining the spill valve at closed (e.g., energized) through the complete third compression stroke. A 100% duty cycle may be commanded to the DI pump during the third compression stroke such that the spill valve is energized at the start of the third compression stroke allowing substantially 100% of the fuel in the compression chamber to be trapped, and delivered to the direct injector fuel rail 250.

Operating sequence 1100 also includes three suction strokes (from t4 to t5, from t7 to t8, and from t10 till t11). Each suction stroke ensues a preceding corresponding compression stroke as shown in FIG. 11. Since engine 1010 is depicted as a four cylinder engine, each pump cycle (including one compression stroke and one suction stroke) may comprise a single port injection. Accordingly, a port injection is shown at t3 during the first compression stroke, at t6 during the second compression stroke, and at t9 during the third compression stroke.

Operating sequence 1100 illustrates pressurizing each of the step room (e.g., increasing pressure in the step room of DI pump 1014) and the PFI rail during each compression stroke. Specifically, each of the step room and the PFI rail receive pressurized fuel from the compression chamber during the compression stroke when the spill valve is open. Thus, each of the step room and the PFI rail is pressurized to the regulation pressure when the SACV is open. During the first compression stroke, pressure in each of the compression chamber, the step room, and the PFI rail may be the same pressure as long as the spill valve is open. The regulation pressure is attained in each of the compression chamber, the step room, and the PFI rail towards the beginning of the compression stroke. As depicted, the pressure rise may not be immediate but may be gradual, since the compression chamber supplies fuel to both the step chamber and the PFI rail. Once the spill valve is closed at t2, pressure in the compression chamber rises sharply to the desired fuel rail pressure in the direct injector rail. Pressure in the PFI rail may stay at the regulation pressure but pressure in the step room reduces to that of the lift pump pressure after t2 (once the SACV is energized). Further, when a port injection occurs at t3, FRP in the PFI rail drops to lower than the regulation pressure.

During the second compression stroke, since the spill valve is open throughout, each of the compression chamber, the step room, and the PFI rail may be at the same pressure throughout the second compression stroke. Fuel injection via a port injector at t6 may not reduce FRP in the PFI rail since the compression chamber supplies additional fuel to the fuel rail and maintains regulation pressure. In the third compression stroke, the step room pressure does not rise to the regulation pressure since fuel supply from the compression chamber may not be received. However, the step room may receive fuel from the lift pump during the third compression stroke, and therefor may be at the lift pump pressure during the third compression stroke. The PFI rail may be at the regulation pressure since the previous port injection at t6. However, FRP of the PFI rail reduces in response to delivering the port injection at t9 since additional fuel may not be received from the compression chamber until the subsequent compression stroke.

Pressure in the compression chamber, the step chamber, and the port injector fuel rail may be at the lift pump pressure through each of the three suction strokes.

In this way, the step room in fifth embodiment 1000 of FIG. 10 may be pressurized via the compression chamber during the compression stroke if the spill valve is in pass-through mode. At the same time, the PFI rail may also be pressurized via the compression chamber as long as the SACV is open. The step room and the compression chamber may be at the lift pump pressure during the suction strokes. Lubrication may be enhanced and fuel evaporation may be reduced during the compression strokes in fifth embodiment 1000.

Turning now to FIG. 12, it portrays a sixth embodiment 1200 of the fuel system including DI fuel pump 1214. Many components of sixth embodiment 1200 may be similar to those described in fifth embodiment 1000 as well as those introduced in first embodiment 200 and second embodiment 300 of the fuel system. Accordingly, these common components may be numbered similarly and may not be re-introduced.

Specifically, sixth embodiment includes PFDI engine 1010 as well as port injector (PFI) rail 1050. Herein, PFI rail 1050 is fluidically coupled to each of compression chamber 238 and step chamber 226 of DI pump 1214. To elaborate, PFI rail 1050 may receive fuel from compression chamber 238 during a compression stroke when SACV 236 is open. Herein, reflux fuel may exit compression chamber 238 through SACV 236 into pump passage 254, and flow past node 1266 into first port conduit 1206, through fourth check valve 1216, past node 1276 and node 1268, through port supply passage 1064 into PFI rail 1050. PFI rail 1050 may also receive fuel from step chamber 226 during a suction stroke. During the suction stroke, fuel exiting step room 226 may flow through step room passage 242, past node 1248 into second port conduit 1204, past fifth check valve 1212, across node 1268, into port supply passage 1064, and thereon into PFI rail 1050. Each of fourth check valve 1216 and fifth check valve 1212 may block fuel flow from nodes 1276 and 1268, respectively, towards node 1266 and node 1248 respectively.

It will be noted though that DI rail 250 receives fuel only from the compression chamber 238 during a compression stroke in the DI pump 1214.

Fourth pressure relief valve 1246 fluidically coupled in relief passage 1256 may be biased to regulate pressure in each of the compression chamber 238, the step chamber 226, and the PFI rail of the sixth embodiment 1200. Relief setting of fourth pressure relief valve 1246 may be distinct from relief settings of previously introduced pressure relief valves in earlier embodiments. Thus, when pressure at either node 1276 or node 1268 exceeds the pressure relief setting of fourth pressure relief valve 1246, fuel may flow into relief passage 1256, through fourth pressure relief valve 1246 towards low pressure passage 218 (across node 324).

As such, fourth pressure relief valve 1246 may be a common pressure relief valve in this embodiment enabling a default pressure in the compression chamber and the DI fuel rail, as well as a default pressure in the PFI rail, and enabling a regulation pressure in the step chamber that is higher than lift pump pressure. Specifically, the regulation pressure for each of the PFI rail, the step room, and the compression chamber may be the same. Further, since the step room is pressurized by the fourth pressure relief valve 1246, pressurized fuel is supplied to PFI rail 1050 during the suction stroke. Similarly, when the SACV is open, the compression chamber may be pressurized to the regulation pressure allowing pressurized fuel to be supplied to the PFI rail 1050.

In another representation, an example system may comprise a port fuel direct injection (PFDI) engine, a direct injection fuel pump including a piston, a compression chamber, a step chamber arranged below a bottom surface of the piston, a cam for moving the piston, and a solenoid activated check valve positioned at an inlet of the compression chamber of the direct injection fuel pump, a lift pump fluidically coupled to each of the compression chamber and the step chamber of the direct injection fuel pump, a direct injector fuel rail fluidically coupled to the compression chamber of the direct injection pump, a port injector fuel rail fluidically coupled to each of the compression chamber and the step chamber of the direct injection fuel pump, and a common pressure relief valve (such as fourth pressure relief valve 1246 in FIG. 12) positioned upstream of the port injector fuel rail, the common pressure relief valve biased to regulate pressure in each of the port injector fuel rail, the step chamber, and the compression chamber. The common pressure relief valve may be biased to regulate pressure in the compression chamber of the direct injection fuel pump during a compression stroke in the direct injection fuel pump when the solenoid activated check valve is in a pass-through state. Further, the common pressure relief valve may also be biased to regulate pressure in the step chamber during a suction stroke in the direct injection fuel pump. The system may include a controller having executable instructions stored in a non-transitory memory for activating the solenoid activated check valve to a closed position during the compression stroke of the direct injection fuel pump based on a fuel rail pressure of the direct injector fuel rail.

FIG. 13 includes seventh embodiment 1300 of the fuel system depicting DI fuel pump 1314. Seventh embodiment 1300 of the fuel system differs from sixth embodiment 1200 of FIG. 12 in two ways. As one example, circulation of the step room 1326 may occur due to presence of circulation passage 1343. Fuel entering step room from the lift pump 212 may flow past first check valve 244 into step room passage 1342 into step chamber 1326. Fuel may exit the step chamber 1326 during a suction stroke through circulation passage 1343 towards port supply passage 1064. Fifth check valve 1212 may be fluidically coupled to circulation passage 1343 to allow flow from step room 1326 towards port supply passage 1064 while blocking flow from port supply passage 1064 towards step chamber 1326. Seventh embodiment 1300 may also include a fifth pressure relief valve 1346 located in first port conduit 1206. Fifth pressure relief valve 1346 may be biased to regulate pressure only in the compression chamber while fourth pressure relief valve 1246, as in FIG. 12, is biased to regulate pressure in each of the compression chamber, the step chamber, and the PFI rail. In the seventh embodiment, a common regulation pressure may be established for step room 1326 and PFI rail 1050. In one example, this common regulation pressure may be 9 bar. Further, a higher default pressure (regulation pressures) may be provided for the compression chamber 238 of DI pump 1314 since both fourth pressure relief valve 1246 and fifth pressure relief valve 1346 regulate the pressure in the compression chamber. At the same time, a higher default pressure may be provided to DI rail 250. As an example, default pressure to the DI rail 250 may be in a range of 20 to 40 bar.

In this way, in each of the sixth embodiment 1200 and the seventh embodiment 1300 of the fuel system, both sides of the pump piston 220 in respective DI fuel pumps 1214 and 1314 are used to pump to the PFI rail 1050. As such, pumping volume of the DI fuel pump to the PFI rail may be increased significantly (e.g., approximately doubled). Specifically, piston top 221 may impel fuel from compression chamber 238 towards the PFI rail 1050 when SACV 236 is in pass-through mode during a compression stroke. Further, piston bottom 223 may be used to force fuel from step chamber 226 of DI pump 1214 to fuel PFI rail 1050 during a suction stroke. Similarly, piston bottom 223 of pump piston 220 may force fuel from step chamber 1326 of DI pump 1314 to PFI rail 1050 during the suction strokes. Furthermore, piston top 221 may pump fuel to DI rail 250 during the compression stroke following closing the SACV 236. Thus, the port injector fuel rail may be provided sufficient pressure to enable atomization of fuel. Further still, even at higher fuel flow rates, the PFI rail pressure (as well as volume) can be provided by the DI pump. Accordingly, the lift pump can be operated at a lower power setting (e.g. minimum power) providing a more efficient fuel system.

An example system may comprise a port fuel direct injection (PFDI) engine, a direct injection fuel pump including a piston, a compression chamber, a step chamber arranged below a bottom surface of the piston, a cam for moving the piston, and a solenoid activated check valve positioned at an inlet of the compression chamber of the direct injection fuel pump, a lift pump fluidically coupled to each of the compression chamber and the step chamber of the direct injection fuel pump, a first pressure relief valve (e.g., fifth pressure relief valve 1346) positioned in a first line coupled to the compression chamber of the direct injection fuel pump, a direct injector fuel rail fluidically coupled to the compression chamber of the direct injection pump, a port injector fuel rail fluidically coupled to each of the compression chamber and the step chamber of the direct injection fuel pump, and a second pressure relief valve (e.g., fourth pressure relief valve 1246) positioned upstream of the port injector fuel rail, the second pressure relief valve biased to regulate pressure in each of the port injector fuel rail, the step chamber, and the compression chamber. The lift pump may be electrically actuated, and the direct injector fuel pump may be driven by the PFDI engine, and may not be electrically actuated. Each of the first pressure relief valve and the second pressure relief valve may be biased to regulate pressure in the compression chamber of the direct injection fuel pump during a compression stroke in the direct injection fuel pump when the solenoid activated check valve is in a pass-through state. However, the second pressure relief valve may be biased to regulate pressure in the step chamber during a suction stroke in the direct injection fuel pump. The system may include a controller having executable instructions stored in a non-transitory memory for activating the solenoid activated check valve to a closed position during the compression stroke of the direct injection fuel pump based on a fuel rail pressure of the direct injector fuel rail.

Turning now to FIG. 15, an example operating sequence 1500 in DI fuel pump 1214 of FIG. 12 is depicted. Operating sequence 1500 includes time plotted along the horizontal axis and time increases from the left to the right of the horizontal axis. Operating sequence 1500 depicts pump piston position at plot 1502, a spill valve (e.g., SACV 236) position at plot 1504, compression chamber pressure at plot 1506, step chamber pressure at plot 1508, changes in fuel rail pressure (FRP) in the port injector (PFI) fuel rail at plot 1510, and port injections at plot 1512. Pump piston position may vary between the top-dead-center (TDC) and bottom-dead-center (BDC) positions of pump piston 220 as indicated by plot 1502. For the sake of simplicity, the spill valve position of plot 1504 is shown in FIG. 15 as either open or closed. The open position occurs when SACV 236 is de-energized or deactivated. The closed position occurs when SACV 236 is energized or activated.

Line 1503 represents regulation pressure of compression chamber 238 of DI pump 1214 (e.g., pressure relief setting of fourth pressure relief valve 1246+lift pump output pressure), line 1505 represents an output pressure of the lift pump (e.g., LPP 212) relative to compression chamber pressure, line 1507 represents a regulation pressure of the step room e.g., combined pressure of the pressure relief set-point of fourth pressure relief valve 1246 and the lift pump pressure, and line 1509 represents the output pressure of the lift pump (e.g., LPP 212) relative to step chamber pressure. Line 1511 represents the regulation pressure of the PFI rail which may be similar to the regulation pressure of the compression chamber (line 1503) and the regulation pressure of the step chamber (line 1507). Line 1513 represents the output pressure of the lift pump (e.g., LPP 212) relative to PFI rail pressure. As such, separate lines are used to indicate the lift pump pressure for enabling clarity. However, the output pressure of the lift pump is the same whether represented by line 1505, line 1509, or line 1513. It will be noted that the regulation pressure in each of the compression chamber, the PFI rail, and the step chamber may be the same (e.g., combined pressure of pressure relief setting of fourth pressure relief valve 1246 and lift pump output pressure), though represented as distinct lines 1503, 1507, and 1511. Furthermore, while the plot of pump piston position 1502 is shown as a straight line, this plot may exhibit more oscillatory behavior. For the sake of simplicity, straight lines are used in FIG. 15 while it is understood that other plot profiles are possible.

Operating sequence 1500 of FIG. 15 includes three compression strokes, e.g., from t1 to t4, from t5 to t7, and from t8 to t10. The first compression stroke (from t1 to t4) comprises holding the spill valve at open (e.g., de-energized) for a first half of the first compression stroke and closing it at t2 (e.g., energized to close) for the remainder (e.g., a second half) of the first compression stroke. The second compression stroke from t5 to t7 includes holding the spill valve at open (e.g., de-energized) through the entire second compression stroke while the third compression stroke from t8 to t10 includes maintaining the spill valve at closed (e.g., energized) throughout the duration of the third compression stroke. A 100% duty cycle may be commanded to the DI pump during the third compression stroke such that the spill valve is energized at the start of the third compression stroke allowing substantially 100% of the fuel in the compression chamber to be trapped, and delivered to the direct injector fuel rail 250.

Operating sequence 1500 also includes three suction strokes (from t4 to t5, from t7 to t8, and from t10 till t11). Each suction stroke ensues a preceding corresponding compression stroke as shown in FIG. 15. Since engine 1010 is depicted as a four cylinder engine, each pump cycle (including one compression stroke and one suction stroke) may comprise a single port injection. Accordingly, example port injections are shown at t3 during the first compression stroke, at t6 during the second compression stroke, and at t9 during the third compression stroke.

Operating sequence 1500 illustrates pressurizing the step room (e.g., increasing positive pressure in the step room of DI pump 1214) during each suction stroke to the regulation pressure (line 1507). Further, the PFI rail is also pressurized (e.g., supplied pressurized fuel) by the step chamber during each suction stroke. Specifically, regulation pressure of the PFI rail may be attained during each suction stroke in the DI pump 1214.

Further still, pressure in the step room reduces to that of the lift pump during each compression stroke as the step chamber receives fuel from the lift pump. The step chamber does not supply fuel to the PFI rail during the compression stroke. The PFI rail also receives pressurized fuel during each compression stroke as long as the spill valve is open (e.g., de-energized). However, if the spill valve is closed the PFI rail does not receive fuel (nor pressurization) from the compression chamber. At the same time, the PFI rail also does not receive fuel from the step chamber during the compression stroke.

Accordingly, during the first compression stroke, pressure in each of the compression chamber and the PFI rail may be the same pressure (e.g., respective regulation pressure) as long as the spill valve is open. The regulation pressure may be attained in each of the compression chamber and the PFI rail towards (e.g., at or just after) the beginning of the compression stroke. As depicted, the pressure rise in the compression chamber may not be immediate (e.g., at the commencement of the compression stroke) but may be gradual, since the compression chamber supplies fuel to the PFI rail. Once the spill valve is closed at t2, pressure in the compression chamber rises sharply to the desired fuel rail pressure in the direct injector rail. Pressure in the PFI rail stays at the regulation pressure. However, when a port injection occurs at t3, FRP in the PFI rail drops to lower than the regulation pressure (and remains there until t4) since the PFI rail is not receiving pressurized fuel from the compression chamber since the spill valve is closed. The ensuing suction stroke at t4 causes an increase in FRP of the PFI rail (plot 1510) to regulation pressure just after t4 since PFI rail receives pressurized fuel from the step chamber.

During the second compression stroke, since the spill valve is open throughout, the compression chamber and the PFI rail may be at the same pressure throughout the second compression stroke. Fuel injection via a port injector at t6 may not reduce FRP in the PFI rail since the compression chamber supplies additional fuel to the port injector fuel rail and maintains regulation pressure in the PFI rail. At the beginning of the third compression stroke (at t8), the PFI rail may be at its regulation pressure due to the previous suction stroke (from t7 to t8). However, FRP of the PFI rail reduces in response to delivering the port injection at t9 since the PFI rail does not receive supplementary fuel from the compression chamber since the spill is closed. Pressure in the compression chamber may be significantly higher during the third compression stroke since 100% of the fuel is trapped and delivered to the DI rail Pressure in the compression chamber may be at the lift pump pressure through each of the three suction strokes. Pressure in the step chamber may be at the lift pump pressure through each of the three compression strokes.

In this way, the DI pump 1214 in sixth embodiment 1200 of FIG. 12 provides fuel at desired higher pressures to the PFI rail using both sides of the pump piston. Specifically, the PFI rail is pressurized by the step chamber as well as the compression chamber. To elaborate, a reduction in FRP of the PFI rail in response to a port injection may occur solely during a compression stroke when the spill valve is closed. Thus, the PFI rail pressure may not reduce to the lift pump pressure and fuel delivered via port injectors may be completely vaporized providing enhanced power and reduced emissions. Further still, the DI pump may be well lubricated during the full pump cycle since a differential pressure exists across the pump piston in the DI pump through each cycle.

An example method for an engine may comprise supplying fuel to each of a port injector fuel rail and a direct injector fuel rail from a direct injection fuel pump, the fuel supplied to the port injector fuel rail during each of a compression stroke and a suction stroke in the direct injection fuel pump and the fuel supplied to the direct injector fuel only during the compression stroke in the direct injection fuel pump. Herein, the fuel supplied to the port injector fuel rail may be at a pressure higher than an output pressure of a lower pressure pump, the lower pressure pump delivering fuel to the direct injection fuel pump, and wherein the pressure of the fuel supplied to the port injector fuel rail may be regulated by a pressure relief valve. Fuel may be supplied to the port injector fuel rail during the compression stroke when an electronically controlled solenoid valve is deactivated to a pass-through mode. The electronically controlled solenoid valve may be deactivated to the pass-through mode in response to ceasing fuel flow to the direct injector fuel rail during the compression stroke. The method may further comprise providing a differential pressure in the direct injection fuel pump between a top of a pump piston and a bottom of the pump piston during at least the suction stroke.

Turning now to FIG. 16, an example operating sequence 1600 in DI fuel pump 1314 of FIG. 13 is depicted. Operating sequence 1600 includes time plotted along the horizontal axis and time increases from the left to the right of the horizontal axis. Operating sequence 1600 depicts pump piston position at plot 1602, a spill valve (e.g., SACV 236) position at plot 1604, compression chamber pressure at plot 1606, step chamber pressure at plot 1608, changes in fuel rail pressure (FRP) in the port injector (PFI) fuel rail at plot 1610, and port injections at plot 1612. Pump piston position may vary between the top-dead-center (TDC) and bottom-dead-center (BDC) positions of pump piston 220 as indicated by plot 1602. For the sake of simplicity, the spill valve position of plot 1604 is shown in FIG. 16 as either open or closed. The open position occurs when SACV 236 is de-energized or deactivated. The closed position occurs when SACV 236 is energized or activated.

Line 1603 represents regulation pressure of compression chamber 238 of DI pump 1314 (e.g., combination of pressure relief setting of fourth pressure relief valve 1246, pressure relief setting of fifth pressure relief valve 1346, and lift pump output pressure), line 1605 represents a combination of pressure relief setting of fourth pressure relief valve 1246 and lift pump pressure, line 1607 represents an output pressure of the lift pump (e.g., LPP 212) relative to compression chamber pressure, line 1609 represents a regulation pressure of the step room e.g. combined pressure of the pressure relief set-point of fourth pressure relief valve 1246 and the lift pump pressure, and line 1611 represents the output pressure of the lift pump (e.g., LPP 212) relative to step chamber pressure. Line 1613 represents the regulation pressure of the PFI rail which may be similar to the regulation pressure of the step chamber (line 1609). Line 1615 represents the output pressure of the lift pump (e.g., LPP 212) relative to PFI rail pressure. As such, separate lines are used to indicate the lift pump pressure for enabling clarity. However, the output pressure of the lift pump is the same whether represented by line 1607, line 1611, or line 1615. It will be noted that the regulation pressure in each of the PFI rail and the step chamber may be the same (e.g., combined pressure of pressure relief setting of fourth pressure relief valve 1246 and lift pump output pressure), though represented as distinct lines 1613 and 1609 (respectively). It will also be noted that the regulation pressure of the compression chamber in DI pump 1314 may be higher than the regulation pressures of the step chamber and the PFI rail (due to the additional fifth pressure relief valve 1346). Furthermore, while the plot of pump piston position 1502 is shown as a straight line, this plot may exhibit more oscillatory behavior. For the sake of simplicity, straight lines are used in FIG. 15 while it is understood that other plot profiles are possible.

Operating sequence 1600 of FIG. 16 is substantially similar to operating sequence 1500 of FIG. 15 except that the pressure in compression chamber of DI pump 1314 rises to a higher regulation pressure than the compression chamber of DI pump 1214 when the SACV is open (in pass-through mode). This higher pressure in the compression chamber of DI pump 1314 may be attained because of the combined pressure settings of fourth pressure relief valve 1246 and fifth pressure relief valve 1346.

Similar to the DI pump 1214 in sixth embodiment 1200 of FIG. 12, DI pump 1314 of seventh embodiment 1300 of FIG. 13 provides fuel at desired higher pressures to the PFI rail using both sides of the pump piston. Specifically, the PFI rail is pressurized by the step chamber as well as the compression chamber. Further still, the DI pump may be well lubricated and cooled during the full pump cycle since a differential pressure exists across the pump piston of the DI pump through each cycle.

Referring now to FIG. 14, it depicts eighth embodiment 1400 of the fuel system including DI pump 1414. The eight embodiment 1400 of the fuel system may include multiple components described earlier in first embodiment 200 of FIG. 2, fourth embodiment 800 in FIG. 8 as well as components of sixth embodiment 1200 of FIG. 12. These components may be numbered similarly and may not be reintroduced.

The eighth embodiment 1400 includes a combination of fueling the PFI rail 1050 via both sides of the pump piston 220 in DI pump 1414, pressurizing the step room and the compression chamber via one or more pressure relief valves as well as fueling the step chamber 1426 by compression chamber 238. In the eighth embodiment 1400, step chamber 1426 may be fluidically coupled to compression chamber 238 in DI pump 1414. Accordingly, additional check valves and pressure relief valves may be included that may not be included in earlier embodiments.

The step chamber 1426 and PFI rail 1050 may each receive fuel from the compression chamber 238 of DI pump 1414 during a compression stroke when SACV 236 is in pass-through mode. Reflux fuel from compression chamber may exit backwards through SACV 236 along pump passage 254 towards node 1466. At node 1466, reflux fuel may flow at first towards step chamber 1426 via conduit 1486 past node 1472 to node 248, and thereon into step room passage 1442, and into step chamber 1426. Herein, reflux fuel may flow into step chamber 1426 if fuel pressure is lower than the pressure relief setting of sixth pressure relief valve 1446. If pressure of the fuel is greater than the pressure relief set-point of the sixth pressure relief valve 1446, fuel flowing through conduit 1486 may be diverted at node 1472 into relief passage 1462, and through sixth pressure relief valve 1446 into low pressure passage 218. Sixth check valve 1444 coupled along conduit 1486 may allow fuel flow from node 1466 and pump passage 254 towards nodes 1472 and 248, and step room passage 1442. However, sixth check valve 1444 may obstruct fuel flow from node 1472 (and node 248 and step room 1426) towards node 1466. Sixth pressure relief valve 1446 may be biased to regulate pressure in each of the compression chamber 238 and the step chamber 1426 of DI pump 1414. Sixth pressure relief valve 1446 may not be biased to regulate pressure in the PFI rail 1050.

As such, reflux fuel flowing out of compression chamber 238 at the beginning of the compression stroke may flow towards the step chamber 1426 first. After step chamber 1426 is substantially filled, reflux fuel exiting compression chamber 238 through SACV 236 may enter conduit 1408 at node 1466 and flow towards port injector rail 1050. As such, fuel may be supplied to the port injector rail 1050 after the step chamber 1426 is filled and pressurized. Similar to the fifth embodiment 1000 of the fuel system, on the compression stroke (with SACV un-energized) the fuel volume that is pushed toward the PFI rail 1050 from the compression chamber is the difference of the compression chamber displacement and the step chamber displacement.

Reflux fuel from pump passage 254 entering conduit 1408 at node 1466 may flow through seventh check valve 1458 coupled in conduit 1408 towards node 1472 and thereon into port supply passage 1064 towards PFI rail 1050. If pressure of the reflux fuel at node 1472 is higher than pressure relief setting of seventh pressure relief valve 1436, the reflux fuel may flow through relief passage 1412 and through seventh pressure relief valve 1436 towards node 1470, and therethrough into conduit 1476 towards node 1448. Once the pressure of the reflux fuel is higher than the pressure relief setting of sixth pressure relief valve 1446, the reflux fuel arriving at node 1448 from seventh pressure relief valve 1436 may enter relief passage 1462 through sixth pressure relief valve 1446 towards lift pump 212.

The pressure relief points for sixth pressure relief valve 1446 and seventh pressure relief valve 1436 may be added to regulate pressure in the embodiment depicted in FIG. 14. In one example, pressure relief set-point of sixth pressure relief valve 1446 may be higher than the pressure relief set-point of the seventh pressure relief valve 1436. Further still, seventh pressure relief valve 1436 may be biased to regulate pressure in each of the PFI rail, the step chamber, and the compression chamber of DI pump 1414.

If the spill valve is closed before the step chamber is filled, the step chamber 1426 may receive additional fuel from lift pump 212 through first check valve 244, past nodes 248 and 1448 along step room passage 1442.

During a suction stroke, downward motion of pump piston 220 may expel fuel from step chamber 1426 through step room passage 1442. If the pressure of the fuel is lower than sixth pressure relief valve 1446, fuel exiting the step chamber 1426 may flow through node 1448 into conduit 1476, past node 1470, and thereon through eighth check valve 1450 into port supply passage 1064, and thereon into PFI rail 1050. Specifically, step room 1426 may fuel the PFI rail 1050 during the suction stroke. Eighth check valve 1450 blocks fuel flow from port supply passage 1064 to conduit 1476. Fuel with pressure higher than the relief setting of seventh pressure relief valve 1436 may exit port supply passage 1064 through relief passage 1412 and through seventh pressure relief valve 1436 back through conduit 1476 towards step room passage 1442.

If fuel pressure at node 1448 (whether directly exiting step chamber 1426 or fuel received from seventh pressure relief valve 1436) is higher than the relief setting of sixth pressure relief valve 1446, the fuel may flow through node 248, into conduit 1486, past node 1472 into relief passage 1462, and through sixth pressure relief valve 1446 into low pressure passage 218.

Referring now to operating sequence 1700 of FIG. 17 which shows an example operating sequence of DI pump 1414 in eighth embodiment 1400 of FIG. 14. Operating sequence 1700 includes time plotted along the horizontal axis and time increases from the left to the right of the horizontal axis. Operating sequence 1700 depicts pump piston position at plot 1702, a spill valve (e.g., SACV 236) position at plot 1704, compression chamber pressure at plot 1706, step chamber pressure at plot 1708, changes in fuel rail pressure (FRP) in the port injector (PFI) fuel rail at plot 1710, and port injections at plot 1712. Pump piston position may vary between the top-dead-center (TDC) and bottom-dead-center (BDC) positions of pump piston 220 as indicated by plot 1702. For the sake of simplicity, the spill valve position of plot 1704 is shown in FIG. 17 as either open or closed. The open position occurs when SACV 236 is de-energized or deactivated. The closed position occurs when SACV 236 is energized or activated. As mentioned in previous operating sequences, when the SACV is energized, it functions as a check valve impeding the flow of fuel from the compression chamber of the DI pump towards the pump passage via the SACV. However, for simplicity, operating sequence depicts this position as closed instead of "checked".

Line 1703 represents regulation pressure of compression chamber 238 of DI pump 1414 (e.g., combination of pressure relief setting of sixth pressure relief valve 1446, pressure relief setting of seventh pressure relief valve 1436, and lift pump output pressure), line 1705 represents a combination of pressure relief setting of seventh pressure relief valve 1436 and lift pump pressure (line 1705 provided for comparison), line 1707 represents an output pressure of the lift pump (e.g., LPP 212) relative to compression chamber pressure, line 1709 represents a regulation pressure of the step room e.g., combined pressure of pressure relief setting of sixth pressure relief valve 1446, pressure relief setting of seventh pressure relief valve 1436, and lift pump output pressure, line 1711 represents a combination of pressure relief setting of seventh pressure relief valve 1436 and lift pump pressure, and line 1713 indicates the output pressure of the lift pump (e.g., LPP 212) relative to step chamber pressure. Line 1715 represents the regulation pressure of the PFI rail which may be a combination of pressure relief setting of seventh pressure relief valve 1436 and lift pump pressure, similar to line 1705 and 1711. Line 1717 represents the output pressure of the lift pump (e.g., LPP 212) relative to PFI rail pressure. As such, separate lines are used to indicate the lift pump pressure for enabling clarity. However, the output pressure of the lift pump is the same whether represented by line 1707, line 1713, or line 1717. It will be noted that the regulation pressure of the compression chamber in DI pump 1414 may be higher than the regulation pressure of the PFI rail. Furthermore, while the plot of pump piston position 1502 is shown as a straight line, this plot may exhibit more oscillatory behavior. For the sake of simplicity, straight lines are used in FIG. 17 while it is understood that other plot profiles are possible.

Operating sequence 1700 of FIG. 17 includes three compression strokes, e.g., from t1 to t4, from t5 to t7, and from t8 to t10. The first compression stroke (from t1 to t4) comprises holding the spill valve at open (e.g., de-energized) for a first half of the first compression stroke and closing it at t2 (e.g., energized to close) for the remainder of the first compression stroke. The second compression stroke from t5 to t7 includes holding the spill valve at open (e.g., de-energized) through the entire second compression stroke while the third compression stroke from t8 to t10 includes maintaining the spill valve at closed (e.g., energized) throughout the duration of the third compression stroke. A 100% duty cycle may be commanded to the DI pump during the third compression stroke such that the spill valve is energized at the start of the third compression stroke allowing substantially 100% of the fuel in the compression chamber to be trapped, and delivered to the direct injector fuel rail 250.

Operating sequence 1700 also includes three suction strokes (from t4 to t5, from t7 to t8, and from t10 till t11). Each suction stroke ensues a preceding corresponding compression stroke as shown in FIG. 17. Since engine 1010 is depicted as a four cylinder engine, each pump cycle (including one compression stroke and one suction stroke) may comprise a single port injection. Accordingly, example port injections are shown at t3 during the first compression stroke, at t6 during the second compression stroke, and at t9 during the third compression stroke.

Operating sequence 1700 depicts pressurization of the step chamber (e.g., increase in pressure to regulation pressure) during each of the suction strokes. The step chamber is also pressurized during the compression strokes when the spill valve is open. This is because the step chamber receives pressurized fuel from the compression chamber when the SACV is open. Thus, in the first compression stroke, pressure in the step room increases to the regulation pressure of line 1709 (similar to regulation pressure represented by line 1703) when the spill valve is open. At t2, when the spill valve is energized to close, pressure in the step room reduces to that of the combined pressure of pressure relief setting of seventh pressure relief valve 1436 and lift pump pressure since pressurized fuel is not received from the compression chamber. However, during the succeeding suction stroke, step room pressure increases to the regulation pressure of line 1709.

In the second compression stroke, pressure in the step chamber is maintained at the higher regulation pressure of combined pressure of pressure relief setting of sixth pressure relief valve 1446, pressure relief setting of seventh pressure relief valve 1436, and lift pump output pressure throughout the second compression stroke. This is because the step chamber receives pressurized fuel from the compression chamber due to the open spill valve. During the third compression stroke, since the spill valve is closed at the beginning of the third compression stroke, pressure in the step room decreases initially to the combined pressure of pressure relief setting of seventh pressure relief valve 1436 and lift pump pressure (line 1711) and may decrease further to lift pump pressure if fuel is received from the lift pump.

Pressure in the compression chamber is at or higher than the regulation pressure of the compression chamber during the compression strokes, and at LPP pressure during the suction strokes, as described in previous operating sequences. Meanwhile, FRP in the PFI rail may be at the regulation pressure of the PFI rail (e.g., combined pressure of pressure relief setting of seventh pressure relief valve 1436 and lift pump pressure) when the PFI rail receives fuel from either the compression chamber or the step chamber. This is because seventh pressure relief valve 1436 is biased to regulate pressure in the PFI rail. FRP in the PFI rail drops at t3 in response to a port injection since additional fuel may not be received from the compression chamber during the first compression stroke after spill valve closes at t2. The ensuing suction stroke replenishes fuel in the PFI rail and FRP rises to the regulation pressure soon after suction stroke beings at t4. The port injection at t6 may not cause a drop in FRP since fuel is supplied from the compression chamber via the open spill valve. During the third compression stroke, port injection at t9 again causes a reduction in FRP in the PFI rail since the compression chamber may not supply supplementary fuel to the PFI rail with the spill valve closed.

In this way, the eighth embodiment 1400 of FIG. 14 may have sufficient lubrication during the entire cycle of the pump since the step chamber is pressurized to higher than lift pump pressure by the pressure relief valves as well as by receiving pressurized fuel from the compression chamber. Further, the PFI rail also receives pressurized fuel (e.g., enabling higher pressure port injection) from both the compression chamber and the step chamber of the DI pump 1414.

Thus, an example method for an engine may comprise delivering pressurized fuel to a port injector fuel rail from each of a compression chamber of a direct injection fuel pump and a step chamber of the direct injection fuel pump. In one example, a pressure of the pressurized fuel is regulated via a pressure relief valve, wherein the pressure of the pressurized fuel is higher than an output pressure of a lift pump. As such, the lift pump may be an electrical pump. Further, the lift pump may supply fuel to each of the compression chamber and the step chamber of the direct injection pump. Further still, the lift pump may be operated at a lower power setting. The method may further comprise delivering pressurized fuel to a direct injector fuel rail from only the compression chamber of the direct injection fuel pump. Herein, a pressure of the pressurized fuel delivered to the direct injector fuel rail may be regulated by a solenoid activated check valve. Furthermore, pressurized fuel may be delivered to the direct injector fuel rail from the compression chamber of the direct injection fuel pump when the solenoid activated check valve is energized to fully closed. Pressurized fuel may be delivered to the port injector fuel rail from the compression chamber of the direct injection fuel pump when the solenoid activated check valve is in a pass-through state. The direct injection fuel pump is operated by the engine.

Figure 18:
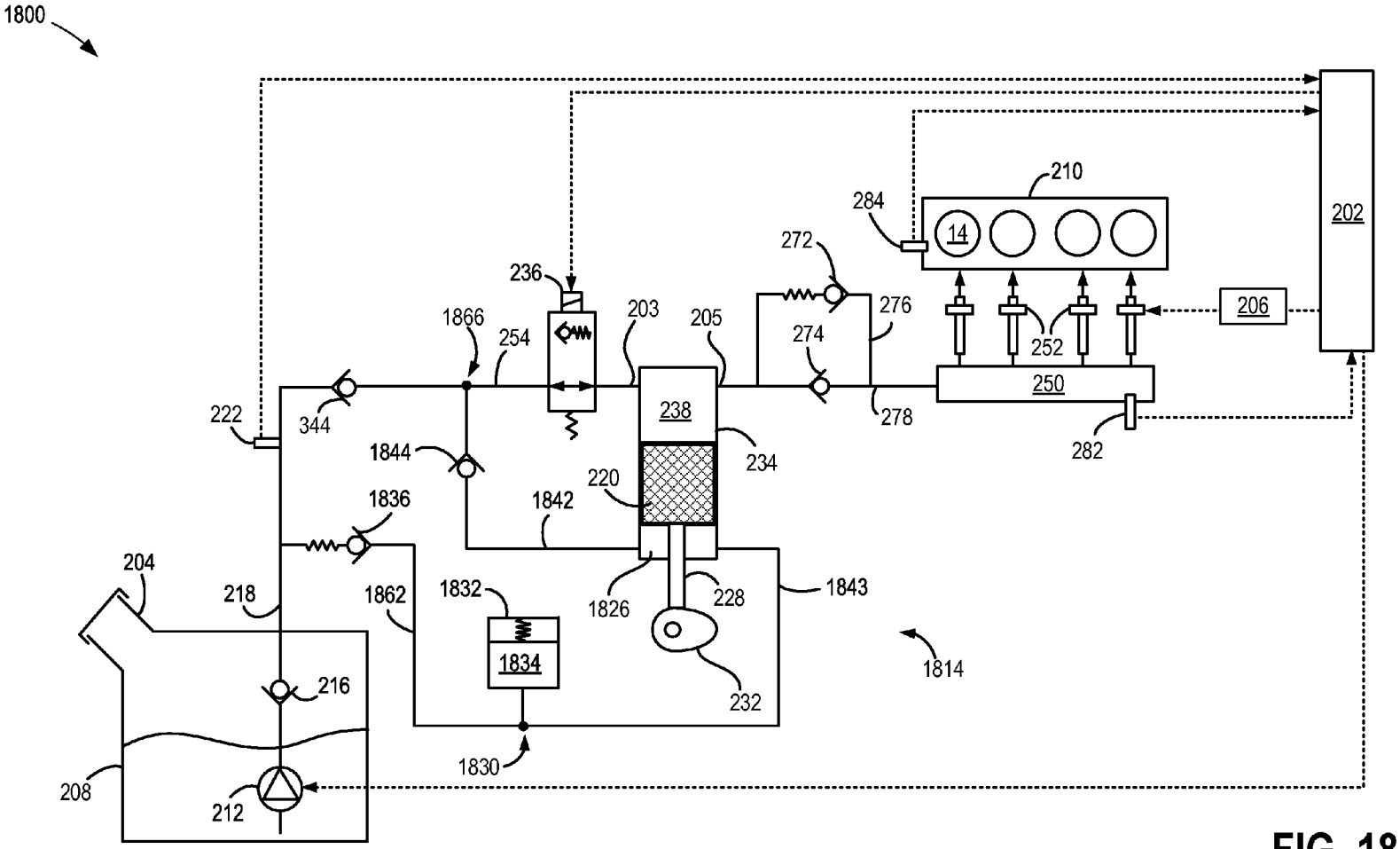
FIG. 18 is a ninth example embodiment of the fuel system and includes an accumulator.
Figure 19:
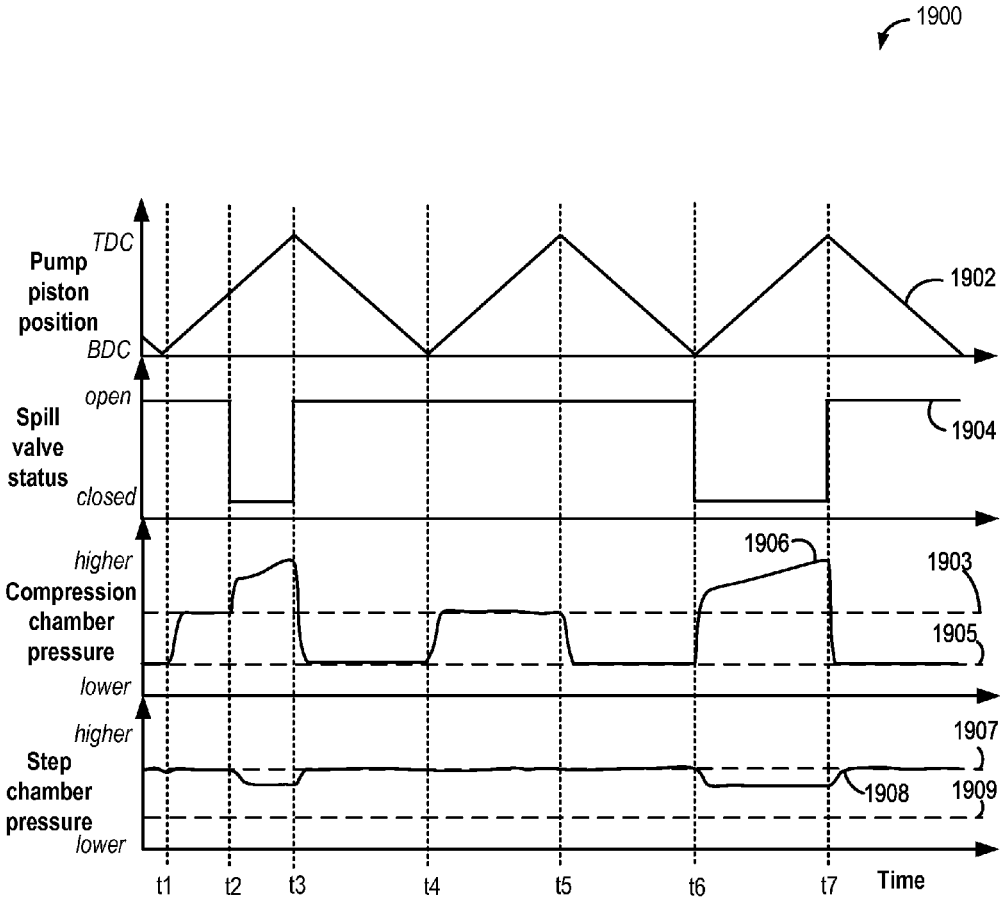
FIG. 19 is an example operating sequence in the direct injection fuel pump included in the ninth example embodiment of the fuel system.

Turning now to FIG. 18, it portrays ninth embodiment 1800 of the fuel system including DI pump 1814. Multiple components of DI pump 1814 and ninth embodiment 1800 of the fuel system may be similar to those introduced in first embodiment 200 of FIG. 2 of the fuel system. Accordingly, these components may be numbered similarly and will not be reintroduced herein. It will be noted that ninth embodiment 1800 of the fuel system is coupled to a DI engine 210 as in FIG. 2. Further, the ninth embodiment 1800 of the fuel system includes utilizing an accumulator to supply fuel to the step chamber of the DI pump 1814.

Lift pump 212 may supply fuel to compression chamber 238 of DI pump 1814 during a suction stroke wherein fuel from LPP 212 flows via low pressure passage 218 through second check valve 344 into pump passage 254, past node 1866 and thereon via SACV 236 into compression chamber 238. Further, during the suction stroke, fuel may be expelled from the step chamber 1826 into passage 1843 towards accumulator 1832. As such, fuel from the step chamber 1826 may not enter step room passage 1842 since ninth check valve 1844 coupled in step room passage 1842 blocks fuel flow from step chamber 1826 towards node 1866. However, ninth check valve 1844 may allow fuel to flow from node 1866 towards step chamber 1826.

Fuel expelled from step chamber 1826 during the suction stroke may enter accumulator chamber 1834 of accumulator 1832 and may be stored within. Accumulator 1832 is arranged, as depicted, downstream of step chamber 1826, and may be fluidically coupled to step chamber 1826 via passage 1843. Fuel exiting step chamber 1826 flows along passage 1843 towards node 1830, and at node 1830, fuel may enter accumulator 1832. As such, a spring within accumulator 1832 may be compressed as an amount of fuel stored within accumulator chamber 1834 increases. While accumulator 1832 may not be pre-loaded, alternative examples may include a pre-loaded accumulator. Eighth pressure relief valve 1836 positioned downstream of accumulator 1832 may establish an upper limit on accumulator pressure. As such, when accumulator 1832 is filled to its largest extent (e.g. maximum fill), pressure in the accumulator may be substantially similar (e.g., within 5% of) the relief setting of the eighth pressure relief valve 1836. If the accumulator 1832 has lower fuel fill, accumulator pressure may be lower than the pressure relief set-point of the eighth pressure relief valve 1836.

As a non-limiting example, the pressure relief set-point of the eighth pressure relief valve may be 5 bar. As situated, eighth pressure relief valve 1836 may allow fuel flow from accumulator 1832 towards low pressure passage 218 when pressure between eighth pressure relief valve 1836 and accumulator 1832 (in relief passage 1862) is greater than a predetermined pressure (e.g., 5 bar). As shown, eighth pressure relief valve 1836 may be fluidically coupled to accumulator 1832 via relief passage 1862.

Thus, during the suction stroke, if fuel exiting step chamber 1826 fills up accumulator chamber 1834, excess fuel may exit towards the low pressure passage 218 through relief passage 1862 once fuel pressure is higher than the relief setting of eighth pressure relief valve 1836. Specifically, accumulator 1832 may be filled prior to fuel exiting via relief passage 1862. Eighth pressure relief valve 1836 may be biased to regulate pressure in each of the compression chamber 238 and the step chamber 1826. As in previous examples, the regulation pressure of the compression chamber and the suction chamber may be based on the relief setting of the eighth pressure relief valve 1836 and the lift pump pressure. Thus, if the relief setting of the eighth pressure relief valve 1836 is 5 bar, in one example, the regulation pressure of the compression chamber 238 and the step chamber 1826 may be 8 bar (sum of relief setting 5 bar of the eighth pressure relief valve 1836 and lift pump pressure of 3 bar).

During a compression stroke, if the spill valve 236 is open, reflux fuel exiting compression chamber 238 through spill valve 236 into pump passage 254 may be diverted at node 1866 towards step room passage 1842 since second check valve 344 blocks flow from node 1866 to low pressure passage 218. Thus, step room 1826 may be filled (and pressurized) by reflux fuel from compression chamber 238 when the SACV 236 is open. The increase in pressure of the fuel may occur due to the presence of eighth pressure relief valve 1836. Once the spill valve is closed during the compression stroke, the step chamber 1826 may be filled by fuel from the accumulator 1832. The fuel may be at a substantially constant pressure (e.g., with a variation of 5%) based on accumulator pressure as well as relief setting of the eighth pressure relief valve 1836.

Thus, in the ninth embodiment 1800 of FIG. 18, the step room 1926 may be regulated to a substantially constant pressure, e.g. within 5% range, during each of the compression stroke and the suction stroke. Specifically, the regulation pressure of the step chamber may be higher than lift pump pressure. Further details will be described in reference to operating sequence 1900 below. During the suction stroke, step chamber is pressurized as fuel flows out of the step room into the accumulator, and during the compression stroke, the step room may be fueled by either the compression chamber (when spill valve is open) or the accumulator (when spill valve is closed).

Referring now to FIG. 19, it depicts example operating sequence 1900 of DI pump 1814 of ninth embodiment 1800 of the fuel system. Operating sequence 1900 includes time plotted along the horizontal axis and time increases from the left to the right of the horizontal axis. Operating sequence 1900 depicts pump piston position at plot 1902, a spill valve (e.g., SACV 236) position at plot 1904, compression chamber pressure at plot 1906, and step chamber pressure at plot 1908. Pump piston position may vary between the top-dead-center (TDC) and bottom-dead-center (BDC) positions of pump piston 220 as indicated by plot 1902. For the sake of simplicity, the spill valve position of plot 1904 is shown in FIG. 19 as either open or closed. The open position occurs when SACV 236 is de-energized or deactivated. The closed position occurs when SACV 236 is energized or activated. As mentioned in previous operating sequences, when the SACV is energized, the SACV functions as a check valve impeding the flow of fuel from the compression chamber of the DI pump towards the pump passage via the SACV.

However, for simplicity, operating sequence depicts this position as closed instead of "checked".

Line 1903 represents regulation pressure of compression chamber 238 of DI pump 1814 (e.g., pressure relief setting of eighth pressure relief valve 1836+lift pump output pressure), line 1905 represents an output pressure of the lift pump (e.g., LPP 212) relative to compression chamber pressure, line 1907 represents a regulation pressure of the step room e.g., combined pressure of the pressure relief set-point of eighth pressure relief valve 1836 and the lift pump pressure, and line 1909 represents the output pressure of the lift pump (e.g., LPP 212) relative to step chamber pressure. As such, separate numbers (and lines) are used to indicate the lift pump pressure for enabling clarity. However, the output pressure of the lift pump is the same whether represented by line 1905 or line 1909. It will be noted that the regulation pressure in each of the compression chamber and the step chamber may be the same, though represented as distinct lines 1903 and 1907. Furthermore, while the plot of pump piston position 1902 is shown as a straight line, this plot may exhibit more oscillatory behavior. For the sake of simplicity and clarity, straight lines are used in FIG. 19 while it is understood that other plot profiles are possible.

Similar to operating sequences such as 500 of FIG. 5, operating sequence 1900 of FIG. 19 includes three compression strokes, e.g., from t1 to t3, from t4 to t5, and from t6 to t7. The first compression stroke (from t1 to t3) comprises holding the spill valve at open (e.g., de-energized) for the first half of the first compression stroke and closing it at t2 (e.g., energizing to close) for the remainder of the first compression stroke. The second compression stroke from t4 to t5 includes holding the spill valve at open (e.g., de-energized) through the entire second compression stroke while the third compression stroke from t6 to t7 includes maintaining the spill valve at closed (e.g., energized) through the complete third compression stroke. A 100% duty cycle may be commanded to the DI pump during the third compression stroke such that the spill valve is energized at the start of the third compression stroke allowing substantially 100% of the fuel in the compression chamber to be trapped, and delivered to the direct injector fuel rail 250. Operating sequence 1900, like operating sequence 500, also includes three suction strokes (from t3 to t4, from t5 to t6, and from t7 till end of plot). Each suction stroke ensues a preceding corresponding compression stroke as shown in FIG. 19.

Operating sequence 1900 illustrates regulating (e.g., maintaining) the step room to the regulation pressure of the step room (line 1907), such as the combined pressure of the pressure relief set-point of eighth pressure relief valve 1836 and the lift pump pressure, during each of the three compression and three suction strokes. As depicted, the pressure in the step room may be maintained at the regulation pressure that is higher than lift pump output pressure through each pump stroke.

As the first compression stroke begins at t1, compression chamber increases to the regulation pressure while the spill valve is open. Herein, fuel exits the compression chamber via the spill valve and enters the step room. If the step room is filled, excess fuel may be stored in the accumulator and/or may be returned to low pressure passage 218 after flowing through eighth pressure relief valve 1836. Step chamber pressure may also be at the regulation pressure since it receives pressurized fuel from the compression chamber.

As spill valve is energized to close (e.g., function as a check valve) at t2, trapped fuel in compression chamber is delivered to the DI fuel rail and compression chamber pressure rises significantly. Step room pressure may drop slightly and remain below the regulation pressure (line 1907) through the remaining part of the first compression stroke after the spill valve is closed, particularly if the step chamber is not filled. Once the spill valve is closed, the step room is replenished by stored fuel from the accumulator and the pressure in the step room remains slightly below the regulation pressure. During the following suction stroke that begins at t3, pressure in the step room rises to that of the regulation pressure of the step room as fuel is pushed out of the step room into the accumulator and then through the eighth pressure relief valve. Step chamber pressure between t3 and t4 may be at the regulation pressure as set by eighth pressure relief valve 1836.

Further, between t3 and t4 (first suction stroke), compression chamber pressure drops to that of lift pump output pressure as fuel is supplied to the compression chamber via the lift pump. Compression chamber may increase to, and remain at the regulation pressure in the second compression stroke as the spill valve is maintained open for the entire duration of the second compression stroke. Step chamber pressure is also maintained constant at the regulation pressure through the second compression stroke since step room receives fuel from the compression chamber, as described above. In the third compression stroke, the spill valve is energized to close at the beginning of the third compression stroke at t6. The step chamber may experience a pressure drop, as indicated by 1917, since fuel may not be received from the compression chamber. However, step room pressure returns to regulation pressure as the accumulator replenishes the step chamber with fuel. Step room pressure is maintained at the regulation pressure during the subsequent suction stroke (third suction stroke) as compression chamber reduces to lift pump pressure.

In this way, pressure in the step chamber is regulated by the accumulator to a substantially constant pressure during each of the compression stroke and the suction stroke of the DI pump 1814. The substantially constant pressure may be the regulation pressure represented by line 1907 of operating sequence 1900 (e.g., combined pressure of relief setting of eighth pressure relief valve 1836 and lift pump pressure). Thus, the step chamber may be regulated to the substantially constant pressure that may be higher than lift pump output pressure.

Turning now to tenth embodiment 2000 of the fuel system including HPP 2014. Tenth embodiment 2000 may be similar to ninth embodiment in that an accumulator supplies fuel to the step chamber 1826. Further, the step chamber may be held at a substantially constant pressure through pump cycles. However, the function of the accumulator may be performed by port fuel injector (PFI) fuel rail 2050. For example, the PFI rail 2050 may be formed of a compliant material that stores fuel. In one example, PFI rail 2050 may be formed of thin stainless steel (e.g., 1 mm thickness) material. In another example, the PFI rail may also have a polygon cross-section. In yet another example, the PFI fuel rail may have thinner walls, and a non-circular cross-section. As such, in the tenth embodiment 2000 of the fuel system, PFI fuel rail 2050 may flex under PFI pressures.

Further, PFI rail 2050 may be fluidically coupled to step chamber 2026 via port conduit 2038. Thus, PFI rail receives fuel directly from step room 2026, and may not receive fuel directly from either lift pump 212 or compression chamber 238.

Tenth embodiment 2000 includes PFDI engine 1010 fueled by port injectors 1052 and direct injectors 252. As in the ninth embodiment, lift pump 212 delivers fuel to compression chamber 238 during a suction stroke. Fuel in step chamber 1826 of DI pump 2014 may be expelled through conduit 2043 towards node 2034. As such, ninth check valve 1844 blocks fuel flow from step chamber 1826 along step room passage 1842 towards node 1866.

At node 2034, if fuel pressure is lower than ninth pressure relief valve 2036, fuel may flow from node 2034 towards PFI rail 2050 via port conduit 2038. However, if fuel pressure is higher than relief setting of ninth pressure relief valve 2036, fuel may flow from node 2034 towards ninth pressure relief valve 2036 along relief conduit 2032. The relief setting of ninth pressure relief valve 2036 may be the same as the relief setting of eighth pressure relief valve 1836 in FIG. 18.

As in the ninth embodiment 1800 of FIG. 18, ninth pressure relief valve 2036 may be biased to regulate pressure in each of the compression chamber, the step chamber, as well as in the accumulator, which is the PFI rail 2050. Thus, fuel flowing out of step chamber towards PFI rail 2050 may be at the regulation pressure set by ninth pressure relief valve 2036. Thus, PFI rail receives fuel from step chamber during the suction stroke at a pressure higher than the lift pump pressure (e.g., combined pressure of lift pump pressure and pressure relief setting of ninth pressure relief valve 2036).

In a compression stroke, similar to the ninth embodiment 1800, if spill valve 236 is open, reflux fuel from compression chamber 238 may flow through SACV 236, and at node 1866 enter step room passage 1842. This reflux fuel may flow through ninth check valve 1844 into step chamber 1826. Once the step room is filled, excess fuel may flow into accumulator PFI rail 2050 through port conduit 2038. Again, if pressure of the reflux fuel is higher than relief setting of ninth pressure relief valve 2036, fuel may flow from node 2034 towards ninth pressure relief valve 2036 along relief conduit 2032. Once the SACV 236 is closed during the compression stroke, the step room may be supplied fuel by the accumulator PFI rail 2050. Herein, fuel may stream from PFI rail 2050 along port conduit 2038 towards node 2034. From node 2034, fuel to replenish step room may flow through conduit 2043 into step room 1826.

Thus, an example method may comprise delivering fuel from a step chamber of a high pressure fuel pump to a port injection fuel rail at a pressure that is higher than an output pressure of a lift pump during a suction stroke, the port injection rail not receiving fuel directly from either the lift pump or a compression chamber of the high pressure fuel pump. The method may further comprise regulating a pressure of the step chamber via a pressure relief valve positioned downstream of the step chamber. Herein, the port injection fuel rail may function as an accumulator. Further, the port injection fuel rail may supply fuel to the step chamber such as during a compression stroke when a spill valve is closed. A pressure in a compression chamber of the high pressure fuel pump may be regulated by the pressure relief valve during a compression stroke in the high pressure fuel pump. Furthermore, the pressure in the compression chamber of the high pressure fuel pump may be regulated by the pressure relief valve during the compression stroke when a solenoid activated check valve positioned at an inlet of the compression chamber of the high pressure pump is in pass-through mode.

Figure 20:
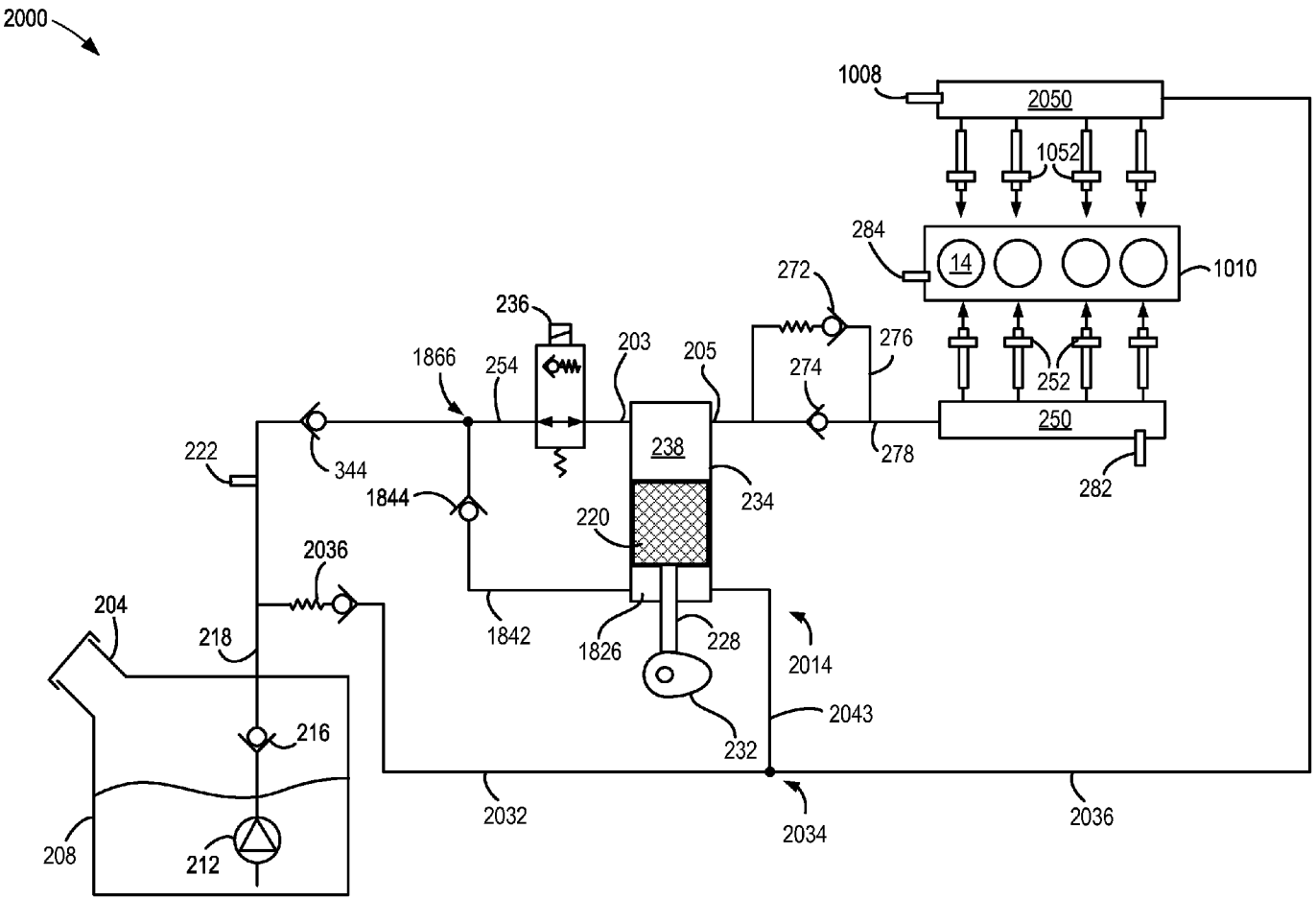
FIGS. 20 and 21 are a tenth example embodiment and an eleventh example embodiment, respectively, of the fuel system.
Figure 21:
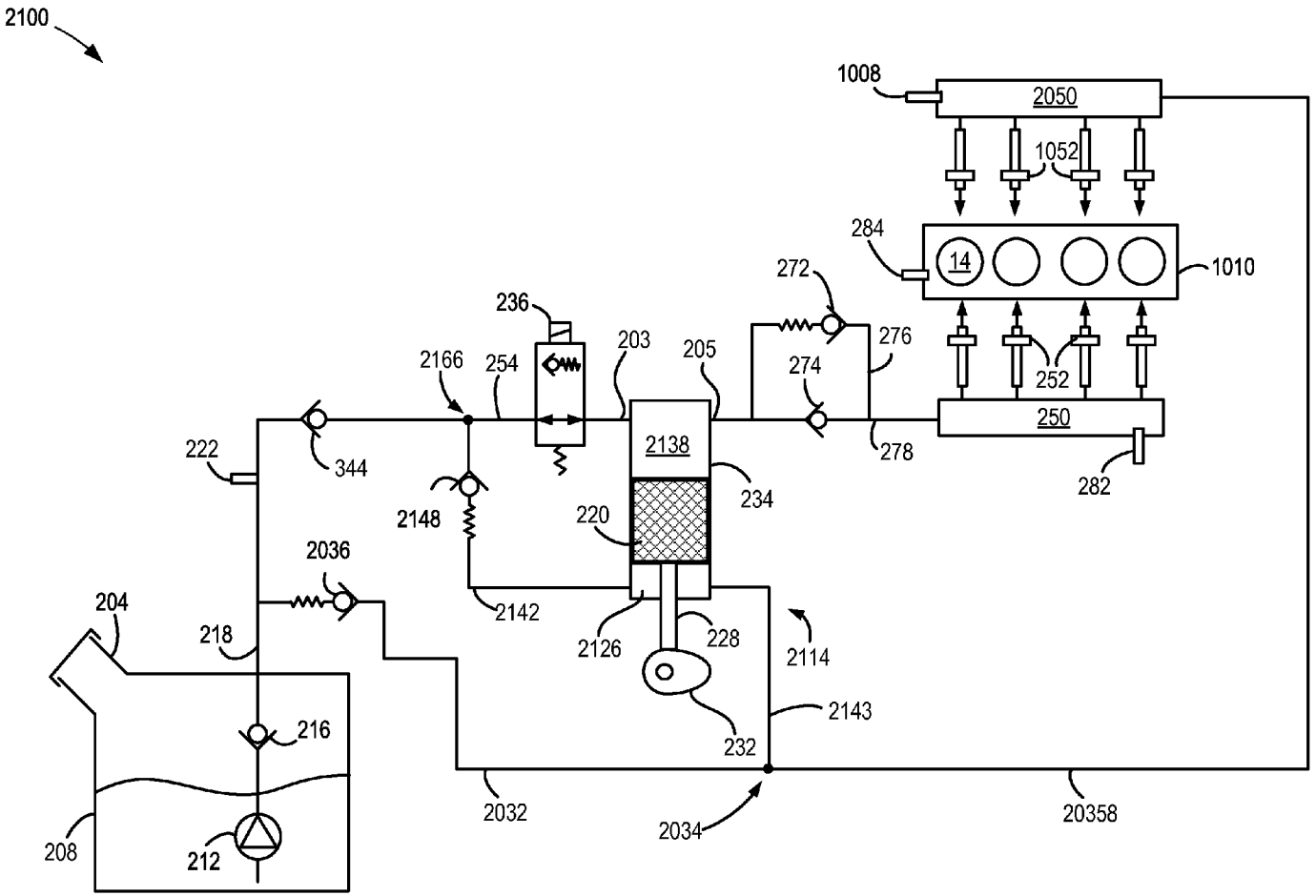

FIG. 21 depicts eleventh embodiment 2100 of the fuel system with DI pump 2114 which is similar to tenth embodiment 2000 of FIG. 20. Eleventh embodiment 2100, however, includes an additional pressure relief valve biased to regulate pressure only in the compression chamber 2138. Thus, tenth pressure relief valve 2148 is included in eleventh embodiment 2100 to increase default pressure in the compression chamber (and DI rail 250) when the spill valve is open during a compression stroke. Tenth pressure relief valve 2148 is fluidically coupled to step room passage 2142 and is positioned between node 2166 and step chamber 2126. Fuel may flow through tenth pressure relief valve 2148 when pressure in pump passage 254 is higher than a relief setting of tenth pressure relief valve 2148. Thus, the compression chamber 2138 may be pressurized by each of ninth pressure relief valve 2036 and tenth pressure relief valve 2148. The pressure relief setting of tenth pressure relief valve 2148 may be distinct from that of ninth pressure relief valve 2036. Alternatively, the pressure relief setting of tenth pressure relief valve 2148 may be similar to that of ninth pressure relief valve 2036.

It will be noted that tenth embodiment 2000 and eleventh embodiment 2100 of the fuel system may include certain components (e.g., controller 202, drivers for the injectors, etc.) shown in earlier embodiments though these components are not depicted in FIGS. 20 and 21 for the sake of clarity.

Thus, an example system may comprise a port fuel direct injection (PFDI) engine, a direct injection fuel pump including a piston, a compression chamber, a step chamber arranged below a bottom surface of the piston, a cam for moving the piston, and a solenoid activated check valve positioned at an inlet of the compression chamber of the direct injection fuel pump, a lift pump fluidically coupled to the direct injection fuel pump, a first pressure relief valve (e.g., tenth pressure relief valve 2148 of FIG. 21) biased to regulate pressure in the compression chamber during a compression stroke in the direct injection fuel pump (e.g., when SACV 236 is open), a direct injector fuel rail fluidically coupled to an outlet of the compression chamber of the direct injection pump, a port injector fuel rail fluidically coupled to the step chamber of the direct injection fuel pump, the port injector fuel rail functioning as an accumulator, and a second pressure relief valve (such as ninth pressure relief valve 2036 of FIG. 21) biased to regulate pressure in each of the port injector fuel rail, the step chamber, and the compression chamber (e.g., when SACV 236 is open during compression stroke) of the direct injection fuel pump. The port injector fuel rail may not be directly coupled to either the compression chamber of the direct injection fuel pump or the lift pump. The first pressure relief valve (e.g., tenth pressure relief valve 2148 of FIG. 21) may not be biased to regulate pressure in the step chamber of the direct injection fuel pump. Further, the first pressure relief valve (e.g., tenth pressure relief valve 2148 of FIG. 21) may not be biased to regulate pressure in the port injector fuel rail.

Referring now to FIG. 22, it depicts example operating sequence 2200 of DI pump 2014 of tenth embodiment 2000 of the fuel system. As such, operating sequence 2200 of DI pump 2014 may be similar to operating sequence 1900 of FIG. 19 except operating sequence 1900 may not include port injections.

Operating sequence 2200 includes time plotted along the horizontal axis and time increases from the left to the right of the horizontal axis. Operating sequence 2200 depicts pump piston position at plot 2202, a spill valve (e.g., SACV 236) position at plot 2204, compression chamber pressure at plot 2206, step chamber pressure at plot 2208, changes in fuel rail pressure (FRP) in the port injector (PFI) fuel rail at plot 2210, and port injections at plot 2212. Pump piston position may vary between the top-dead-center (TDC) and bottom-dead-center (BDC) positions of pump piston 220 as indicated by plot 2202. For the sake of simplicity, the spill valve position of plot 2204 is shown in FIG. 22 as either open or closed. The open position occurs when SACV 236 is de-energized or deactivated. The closed position occurs when SACV 236 is energized or activated. When the SACV is energized, the SACV functions as a check valve impeding the flow of fuel from the compression chamber of the DI pump towards the pump passage via the SACV. However, for simplicity, operating sequence depicts this position as closed instead of "checked".

Line 2203 represents regulation pressure of compression chamber 238 of DI pump 2014 (e.g., pressure relief setting of ninth pressure relief valve 2036+lift pump output pressure), line 2205 represents an output pressure of the lift pump (e.g., LPP 212) relative to compression chamber pressure, line 2207 represents a regulation pressure of the step room e.g., combined pressure of the pressure relief set-point of ninth pressure relief valve 2036 and the lift pump pressure, and line 2209 represents the output pressure of the lift pump (e.g., LPP 212) relative to step chamber pressure. Line 2211 represents the regulation pressure of the PFI rail which may be similar to the regulation pressure of the compression chamber (line 2203) and the regulation pressure of the step chamber (line 2207). Line 2213 represents the output pressure of the lift pump (e.g., LPP 212) relative to PFI rail pressure. As such, separate numbers (and lines) are used to indicate the lift pump pressure for enabling clarity. However, the output pressure of the lift pump is the same whether represented by line 2205, line 2209 or line 2213. It will be noted that the regulation pressure in each of the compression chamber, the PFI rail, and the step chamber may be the same, though represented as distinct lines 2203, 2207, and 2211. Furthermore, while the plot of pump piston position 2202 is shown as a straight line, this plot may exhibit more oscillatory behavior. For the sake of simplicity, straight lines are used in FIG. 22 while it is understood that other plot profiles are possible.

Operating sequence 2200 of FIG. 22 includes three compression strokes, e.g., from t1 to t4, from t5 to t7, and from t8 to t10. The first compression stroke (from t1 to t4) comprises holding the spill valve at open (e.g., de-energized) for a first half of the first compression stroke and closing it at t2 (e.g., energized to close) for the remainder of the first compression stroke. The second compression stroke from t5 to t7 includes holding the spill valve at open (e.g., de-energized) through the entire second compression stroke while the third compression stroke from t8 to t10 includes maintaining the spill valve at closed (e.g., energized) through the complete third compression stroke. A 100% duty cycle may be commanded to the DI pump during the third compression stroke such that the spill valve is energized at the start of the third compression stroke allowing substantially 100% of the fuel in the compression chamber to be trapped, and delivered to the direct injector fuel rail 2050.

Operating sequence 2200 also includes three suction strokes (from t4 to t5, from t7 to t8, and from t10 till t11). Each suction stroke ensues a preceding corresponding compression stroke as shown in FIG. 22. Since engine 1010 is depicted as a four cylinder engine, each pump cycle (including one compression stroke and one suction stroke) may comprise a single port injection. Accordingly, a port injection is shown at t3 during the first compression stroke, at t6 during the second compression stroke, and at t9 during the third compression stroke.

Operating sequence 2200 illustrates regulating the step room to a single, substantially constant pressure, e.g., regulation pressure represented by line 2207, such as the combined pressure of the relief set-point of ninth pressure relief valve 2036 and the lift pump pressure, during each of the three compression and three suction strokes. As depicted, the pressure in the step room may be maintained at the regulation pressure through each pump stroke. Pressure in the step room may reduce slightly when the spill valve is closed during a compression stroke (as shown between t2 and t4, and between t8 and t10) but the PFI rail functioning as accumulator may refill the step chamber. Accordingly, pressure in the step chamber drops slightly below the regulation pressure of the step chamber (line 2207). However, step room pressure may be returned to the regulation pressure in the ensuing suction stroke.

Pressure in the PFI rail may also be maintained at the regulation pressure of line 2211 since the PFI rail may receive fuel from the step chamber during each of the compression stroke (as long as spill valve is open and the step chamber is filled) and the suction stroke. The port injections at t3, however, reduce FRP since the spill valve is closed during the first compression stroke between t2 and t4, and the PFI rail delivers fuel to the step chamber (at 2215) to maintain the regulation pressure in the step chamber. The port injection at t6 may not reduce FRP since the port injector fuel rail may receive fuel from the compression chamber (via the step chamber) since the spill valve is open. The port injection at t9, like that at t3, causes a decrease in FRP. This is because the step chamber may receive fuel from the accumulator PFI rail during the third compression stroke, as no fuel is received form the compression chamber. Further still, the PFI rail may not receive fuel from the step chamber. FRP in PFI rail may be returned to the regulation pressure in the ensuing suction strokes as the step chamber refills the accumulator PFI rail.

Thus, an example method may comprise regulating a pressure in a step chamber of a direct injection fuel pump to a substantially constant pressure during each of a compression stroke and a suction stroke in the direct injection fuel pump. Herein, the substantially constant pressure in the step chamber may be higher than an output pressure of a lift pump, the lift pump supplying fuel to the direct injection pump. The substantially constant pressure in the step chamber may be maintained by an accumulator positioned downstream of the step chamber. In one example, such as in the tenth and eleventh embodiments, the accumulator may also function as a port injector fuel rail. In other words, the port injector fuel rail may serve as the accumulator. The method may also include regulating a pressure of the accumulator by a pressure relief valve situated downstream of the accumulator. The pressure relief valve may be biased to regulate pressure in not only the accumulator, but also the step chamber and a compression chamber of the DI pump. The step chamber may receive fuel from the compression chamber of the direct injection fuel pump during a compression stroke in the direct injection pump. The step chamber may receive fuel from the compression chamber during the compression stroke when a solenoid activated check valve arranged at an inlet of the compression chamber of the direct injection pump is in a pass-through mode. The step chamber may receive fuel from the accumulator during the compression stroke when the solenoid activated check valve arranged at the inlet of the direct injection pump is closed.

Referring now to FIG. 23, it depicts example operating sequence 2300 of DI pump 2114 of eleventh embodiment 2100 of the fuel system. As such, operating sequence 2300 of DI pump 2114 may be similar to operating sequence 2200 of FIG. 22 except that compression chamber 2138 in DI pump 2114 has a higher regulation pressure than the regulation pressure of compression chamber 238 of DI pump 2014.

Operating sequence 2300 includes time plotted along the horizontal axis and time increases from the left to the right of the horizontal axis. Operating sequence 2300 depicts pump piston position at plot 2302, a spill valve (e.g., SACV 236) position at plot 2304, compression chamber pressure at plot 2306, step chamber pressure at plot 2308, changes in fuel rail pressure (FRP) in the port injector (PFI) fuel rail at plot 2310, and port injections at plot 2312. Pump piston position may vary between the top-dead-center (TDC) and bottom-dead-center (BDC) positions of pump piston 220 as indicated by plot 2302. For the sake of simplicity, the spill valve position of plot 2304 is shown in FIG. 23 as either open or closed. The open position occurs when SACV 236 is de-energized or deactivated. The closed position occurs when SACV 236 is energized or activated. When the SACV is energized, the SACV functions as a check valve impeding the flow of fuel from the compression chamber of the DI pump towards the pump passage via the SACV. However, for simplicity, operating sequence depicts this position as closed instead of "checked".

Line 2303 represents regulation pressure of compression chamber 2138 of DI pump 2114 (e.g., combined pressure of pressure relief setting of ninth pressure relief valve 2036, pressure relief setting of tenth pressure relief valve 2148, and lift pump output pressure), line 2305 represents a combined pressure of pressure relief setting of ninth pressure relief valve 2036 and lift pump pressure (provided for comparison), line 2307 represents an output pressure of the lift pump (e.g., LPP 212) relative to compression chamber pressure, line 2309 represents a regulation pressure of the step room e.g. combined pressure of the pressure relief set-point of ninth pressure relief valve 2036 and the lift pump pressure, and line 2311 represents the output pressure of the lift pump (e.g., LPP 212) relative to step chamber pressure. Line 2313 represents the regulation pressure of the PFI rail which may be similar to the regulation pressure of the step chamber (line 2309). Line 2315 represents the output pressure of the lift pump (e.g., LPP 212) relative to PFI rail pressure. As such, separate numbers (and lines) are used to indicate the lift pump pressure for enabling clarity. However, the output pressure of the lift pump is the same whether represented by line 2307, line 2311 or line 2315. It will be noted that the regulation pressure in each of the PFI rail and the step chamber may be the same, though represented as distinct lines 2309, and 2313. Further still, the regulation pressure of compression chamber 2138 of DI pump 2114 may be higher than each of the regulation pressure in each of the PFI rail and the step chamber. Furthermore, while the plot of pump piston position 2302 is shown as a straight line, this plot may exhibit more oscillatory behavior. For the sake of simplicity and clarity, straight lines are used in FIG. 23 while it is understood that other plot profiles are possible.

Operating sequence 2300 of FIG. 23 is very similar to operating sequence 2200 of FIG. 22 and mainly differs in the regulation pressure of compression chamber (line 2303) being higher than the regulation pressure of compression chamber in FIG. 22. As such, the inclusion of tenth pressure relief valve 2148 in the eleventh embodiment enables a higher default (e.g., regulation) pressure in the compression chamber 2138 as well as higher default pressure in DI rail 250. Thus, in the first half of the first compression stroke from t1 to t4, when the spill valve is open (e.g., de-energized), pressure in the compression chamber attains the higher regulation pressure. Once the spill valve is energized to close at t2, compression chamber rises higher than line 2303 until t4. During the second compression stroke from t5 to t7 since the spill valve is open (e.g., de-energized) through the entire second compression stroke, compression chamber pressure is at the regulation pressure (line 2303) through the second compression stroke. Compression chamber pressure in the third compression stroke from t8 to t10 may be higher than the regulation pressure at a pressure desired by the direct injector fuel rail 2050.

The step room in the eleventh embodiment may be regulated to a single, substantially constant pressure, e.g., regulation pressure represented by line 2309, such as the combined pressure of the relief set-point of ninth pressure relief valve 2036 and the lift pump pressure, during each of the three compression and three suction strokes. Pressure in the step room may reduce slightly (e.g., by 5%) below regulation pressure when the spill valve closed (as indicated in operating sequence 2300 between t2 and t4, and between t8 and t10) but the accumulator PFI rail may fill the step chamber once the spill valve is energized. Accordingly, pressure in the step chamber drops slightly below the regulation pressure of the step chamber (line 2309). Further, pressure in the step room may return to the regulation pressure in the ensuing suction stroke(s).

Pressure in the PFI rail may also be maintained at the regulation pressure of line 2313 since the PFI rail may receive fuel from the step chamber during each of the compression stroke (from compression chamber as long as spill valve is open and step room is filled) and the suction stroke. The port injections at t3, however, reduce FRP since the spill valve is closed during the first compression stroke between t2 and t4, and the PFI rail delivers fuel to the step chamber to maintain the regulation pressure in the step chamber. The port injection at t6 may not reduce FRP since the port injector fuel rail may receive fuel from the compression chamber (via the step chamber) since the spill valve is open throughout. The port injection at t9, like that at t3, causes a decrease in FRP. This is because the step chamber may receive fuel from the accumulator PFI rail during the third compression stroke, as no fuel is received form the compression chamber. FRP in PFI rail may be returned to the regulation pressure in the ensuing suction strokes as the step chamber refills the accumulator PFI rail.

In this way, the embodiments of the fuel systems described above (FIGS. 2, 3, 4, 8, 10, 12, 13, 14, 18, 20, and 21) enable a pressurized step chamber of the DI pump. The step chamber may be pressurized by the accumulator, by including one or more pressure relief valves biased to regulate pressure in the step chamber, and/or by receiving pressurized fuel from the compression chamber. As such, the step chamber may be pressurized to a pressure higher than the lift pump pressure. In other words, the regulation pressures may be higher than the lift pump output pressure since the regulation pressure may be a combined pressure of the lift pump pressure and the relief setting of the pressure relief valves, biased to regulate pressure in the step chamber and, in some cases, the compression chamber. By using an accumulator fluidically coupled to the step room along with a pressure relief valve, the step chamber may be maintained at a substantially constant pressure that is higher than lift pump pressure. Accordingly, lubrication of the pump may be enhanced, overheating of fuel may be reduced, and durability of the pump may be improved. Further still, some embodiments include coupling the step chamber to the PFI rail such that the port fuel injectors receive pressurized fuel (since the step chamber is at the regulation pressure) from the step chamber during suction strokes in the DI pump. As such, the PFI rail may receive pressurized fuel from the compression chamber when the SACV is open.

Figure 24:
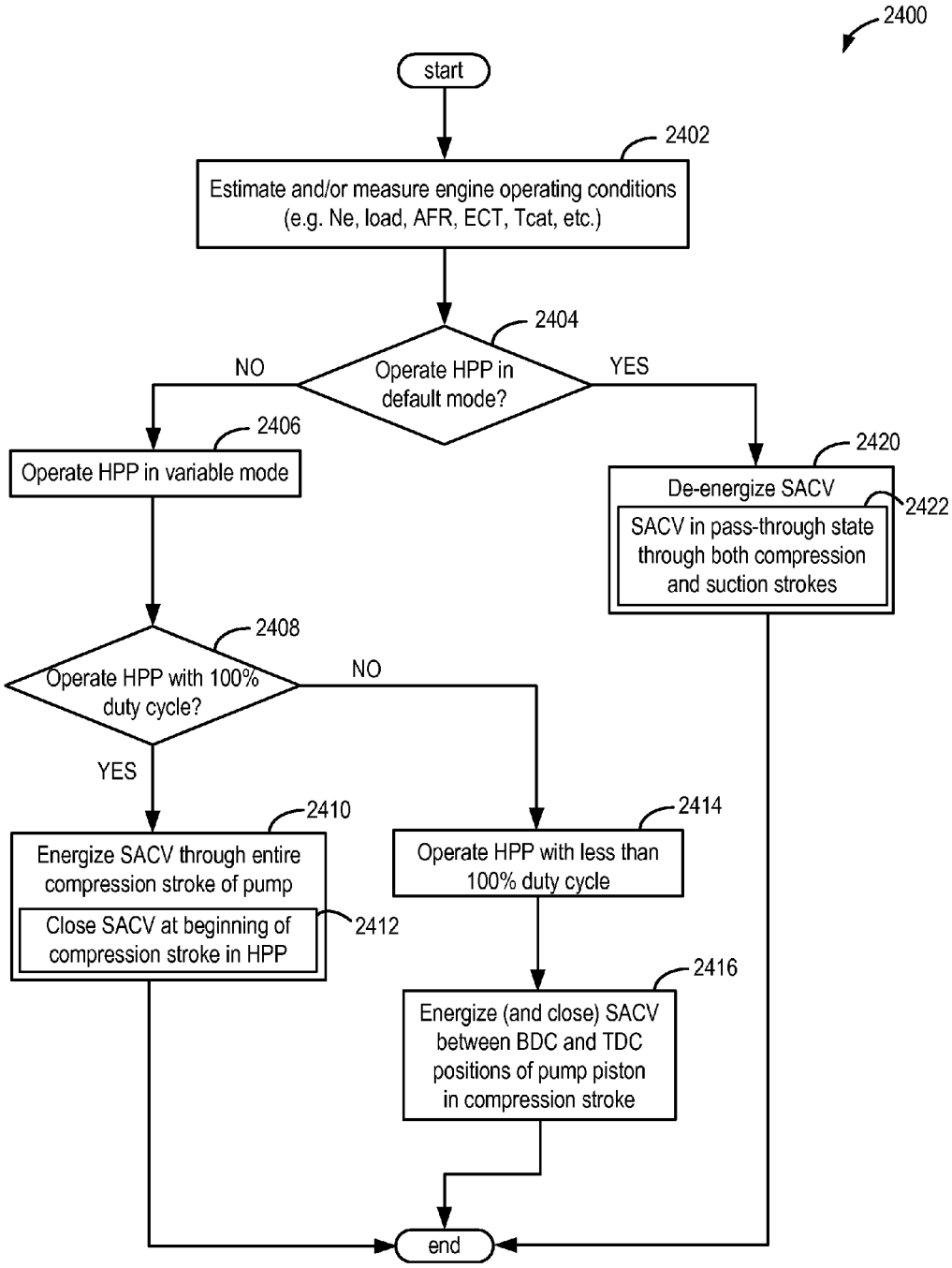
FIG. 24 presents an example flow chart illustrating a control operation of a solenoid activated check valve in a high pressure pump included in the fuel system.

Turning now to FIG. 24, it depicts an example routine 2400 illustrating an example control of DI fuel pump operation in the variable pressure mode and in the default pressure mode. Instructions for carrying out routine 2400 may be executed by a controller, such as controller 12 of FIG. 1 or controller 202 of FIG. 2, based on instructions stored on a memory of the controller and in conjunction with signals received from sensors of the engine system, such as the sensors described earlier with reference to FIG. 1. The controller may employ engine actuators of the engine system to adjust engine operation, according to the methods described below.

At 2402, engine operating conditions may be estimated and/or measured. For example, engine conditions such as engine speed, engine fuel demand, boost, driver demanded torque, engine temperature, air charge, etc. may be determined. At 2404, routine 2400 determines if the HPP (e.g., DI fuel pumps of the various embodiments) can be operated in the default pressure mode. The HPP may be operated in default pressure mode, in one example, if the engine is idling. In another example, the HPP may function in default pressure mode if the vehicle is decelerating. If it is determined that the DI fuel pump can be operated in default pressure mode, routine 2400 progresses to 2420 to deactivate and de-energize the solenoid activated check valve (such as SACV 236 of DI pumps described earlier). To elaborate, the solenoid within the SACV may be de-energized to a pass-through state such that fuel may flow through the SACV both upstream from and downstream of SACV.

If, however, it is determined at 2404 that the HPP may not be operated in default pressure mode, routine 2400 continues to 2406 to operate the HPP in variable pressure mode. The variable pressure mode of HPP operation may be used during non-idling conditions, in one example. In another example, the variable pressure mode may be used when torque demand is greater, such as during acceleration of a vehicle. As mentioned earlier, variable pressure mode may include controlling HPP operation electronically by actuating and energizing the solenoid activated check valve based on desired duty cycle.

Next, at 2408, routine 2400 determines if current torque demand (and fuel demand) includes a demand for full pump strokes. Full pump strokes may include operating the DI fuel pump at 100% duty cycle wherein a substantially large portion of fuel is delivered to the DI fuel rail. An example 100% duty cycle operation of the various DI pumps is depicted in each third compression stroke of example operating sequences shown earlier.

If it is confirmed that full pump strokes (e.g., 100% duty cycle) are desired, routine 2400 continues to 2410, where the SACV may be energized for an entire stroke of the pump. As such, the SACV may be energized (and closed) through an entire compression stroke. Thus, at 2412, the SACV may be energized and closed at a beginning of a compression stroke (such as at the beginning of each third compression stroke in the operating sequences described earlier).

If, on the other hand, it is determined at 2408 that full pump strokes are (or 100% duty cycle operation is) not desired, routine 2400 progresses to 2414 to operate the DI pump in a reduced pump stroke or at less than 100% duty cycle. Next, at 2416, the controller may energize and close the SACV at a time between BDC position and TDC position of the pump piston in the compression stroke. For example, the DI pump may be operated with a 20% duty cycle wherein the SACV is energized to close when 80% of the compression stroke is complete to pump about 20% volume of the DI pump. In another example, the DI pump may be operated with a 60% duty cycle, wherein the SACV may be closed when 40% of the compression stroke is complete. Herein, 60% of the DI pump volume may be pumped into the DI fuel rail. An example of a reduced pump stroke or a less than 100% duty cycle operation (also termed, reduced duty cycle operation) of the HP pump was previously described in reference to first compression strokes in each operating sequence where the SACV is closed at time t2.

Figure 25:
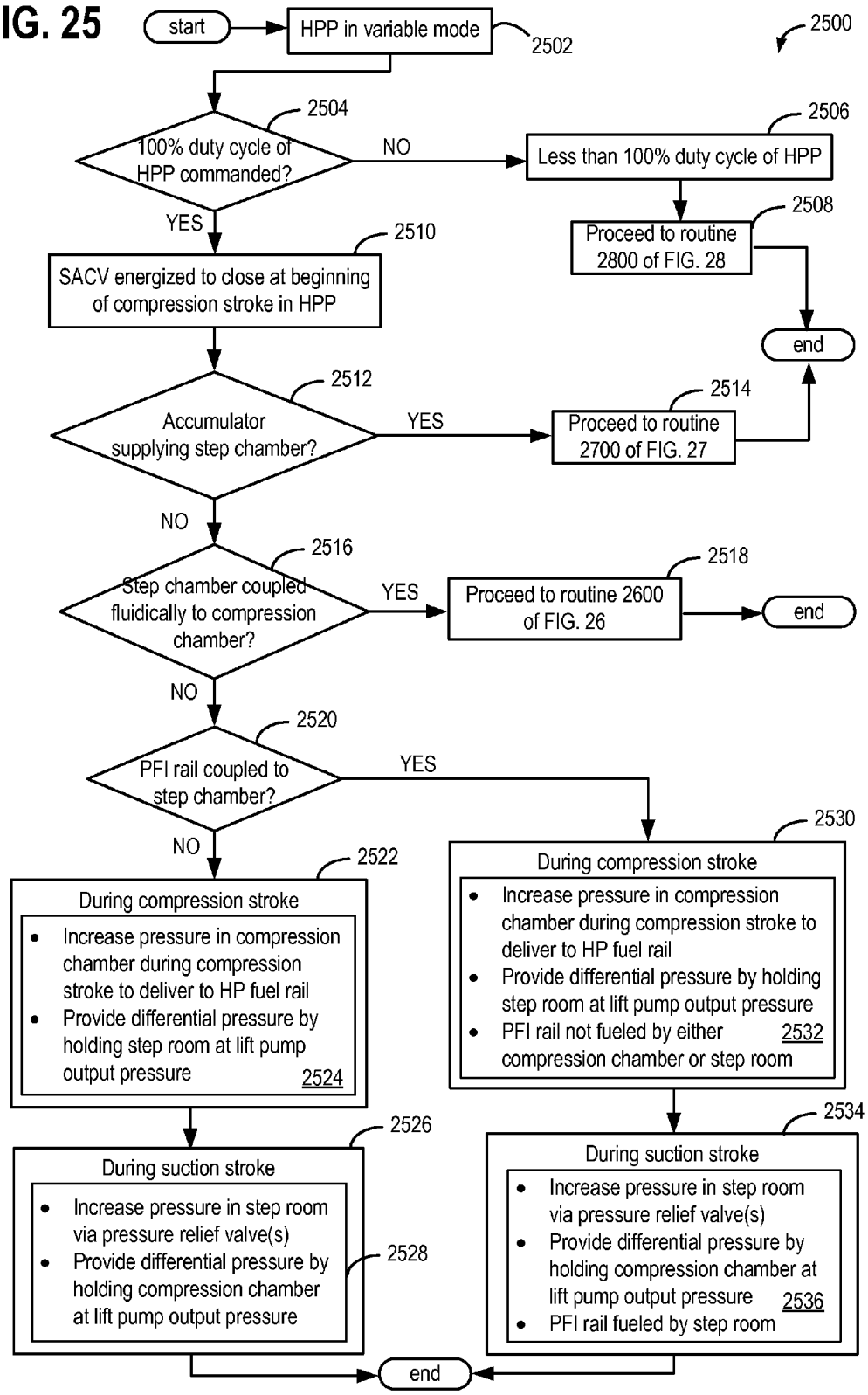
FIGS. 25, 26, 27, 28, 29, 30, 31, 32, and 33 depict example flow charts for changes in pressure in the high pressure pump included in the various embodiments of the fuel system introduced earlier.

Turning now to FIG. 25, it illustrates an example routine 2500 to describe pressure changes in each of a compression chamber and a step chamber of a DI pump when a 100% duty cycle is commanded to the DI pump. Specifically, routine 2500 describes changes in pressure when the step chamber is not fluidically coupled to either the compression chamber or an accumulator.

It will be noted that the controller (such as controller 12 of FIG. 1) may neither command nor perform routine 2500. Routine 2500 merely illustrates variations in pressure in the DI pump due to hardware such as pressure relief valves, piping, and check valves, etc. in the various embodiments of the fuel system. Similarly, the controller (such as controller 12 of FIG. 1) may neither command nor perform routines described in FIGS. 26, 27, 28, 29, 30, 31, 32, and 33. Routines described in FIGS. 26, 27, 28, 29, 30, 31, 32, and 33 merely illustrate variations in pressure in the DI pump(s) due to hardware such as pressure relief valves, piping, and check valves, etc. in the specific embodiments of the fuel system.

At 2502, routine 2500 establishes that the DI pump is in variable mode. At 2504, it may be determined if a 100% duty cycle is commanded. If yes, at 2510, it is determined that the SACV may be energized to close at the beginning of a compression stroke in the DI pump. If no, routine 2500 continues to 2506 to establish that the DI pump is operating in a less than 100% duty cycle mode. Further, at 2508, routine 2500 proceeds to routine 2800 of FIG. 28 and routine 2500 ends.

At 2512, routine 2500 confirms if the DI pump includes an accumulator fueling the step room (such as in the fuel system embodiments of FIGS. 18, 20, and 21). If yes, then at 2514, routine 2500 proceeds to routine 2700 of FIG. 27, and routine 2500 ends. If no, routine 2500 continues to 2516 to determine if the step chamber in the DI fuel pump is fluidically coupled to the compression chamber (such as in the embodiments depicted in FIGS. 8, 10, and 14). If yes, routine 2500 continues to 2518 to proceed to routine 2600 of FIG. 26. If no, routine 2500 proceeds to 2520. At 2520, routine 2500 confirms if a PFI rail is fluidically coupled to the step chamber such that the PFI rail receives fuel from the step chamber. If no, routine 2500 continues to 2522. Thus, the embodiments described below include embodiments shown in FIGS. 2, 3, and 4, which may include fuel systems where the step chamber is not fluidically coupled to a PFI rail or an accumulator, or the compression chamber.

At 2522, pressure changes during a compression stroke in the DI fuel pumps of the above embodiments are described. At 2524, during a compression stroke in the DI pump, pressure in the compression chamber may be increased to a pressure desired by the DI fuel rail, which is higher than the regulation pressure of the compression chamber. Further, pressure in the step room may be at the lift pump pressure enabling a differential pressure in the DI pumps and ensuing lubrication. At 2526, pressure changes during a suction stroke in the DI fuel pumps of the above embodiments are described. At 2528, pressure in the step room may be increased to the regulation pressure based on presence of one or more pressure relief valves biased to regulate pressure in the step room. Differential pressure may exist between the step room and the compression chamber as compression chamber pressure is reduced to that of lift pump output pressure. Thus, lubrication can occur in the DI pump during both pump strokes.

If at 2520, it is determined that a PFI rail is fluidically coupled to the step room, routine 2500 progresses to 2530. Thus, the embodiments described below may include those fuel systems where the step chamber is fluidically coupled to a PFI rail, but not to an accumulator, and where the step room does not receive fuel from the compression chamber, such as embodiments shown in FIGS. 12 and 13.

At 2530, pressure changes during a compression stroke in the DI fuel pumps of the above embodiments are described. At 2532, during a compression stroke in the DI pump, pressure in the compression chamber may be increased to a pressure desired by the DI fuel rail, which is higher than the regulation pressure of the compression chamber. Further, pressure in the step room may be at the lift pump pressure enabling a differential pressure in the DI pumps and ensuing lubrication. Further still, the PFI rail may not be fueled by either the compression chamber (since spill valve is closed) or the step room. Accordingly, any port injections during this period may cause a reduction in FRP.

At 2534, pressure changes during a suction stroke in the DI fuel pumps of the above embodiments are described. At 2536, pressure in the step room may be increased to the regulation pressure based on presence of one or more pressure relief valves biased to regulate pressure in the step room. Differential pressure may exist between the step room and the compression chamber as compression chamber pressure is reduced to that of lift pump output pressure. Thus, lubrication can occur in the DI pump during both pump strokes. Further still, the PFI rail is fueled by the step room. Accordingly, if FRP in the PFI rail has reduced due to previous port injections with spill valve closed, the FRP may be restored to the regulation pressure of the PFI rail in the ensuing suction strokes. Thus, when a 100% duty cycle is commanded, the PFI rail may receive fuel from the step room during the suction strokes.

Figure 26:
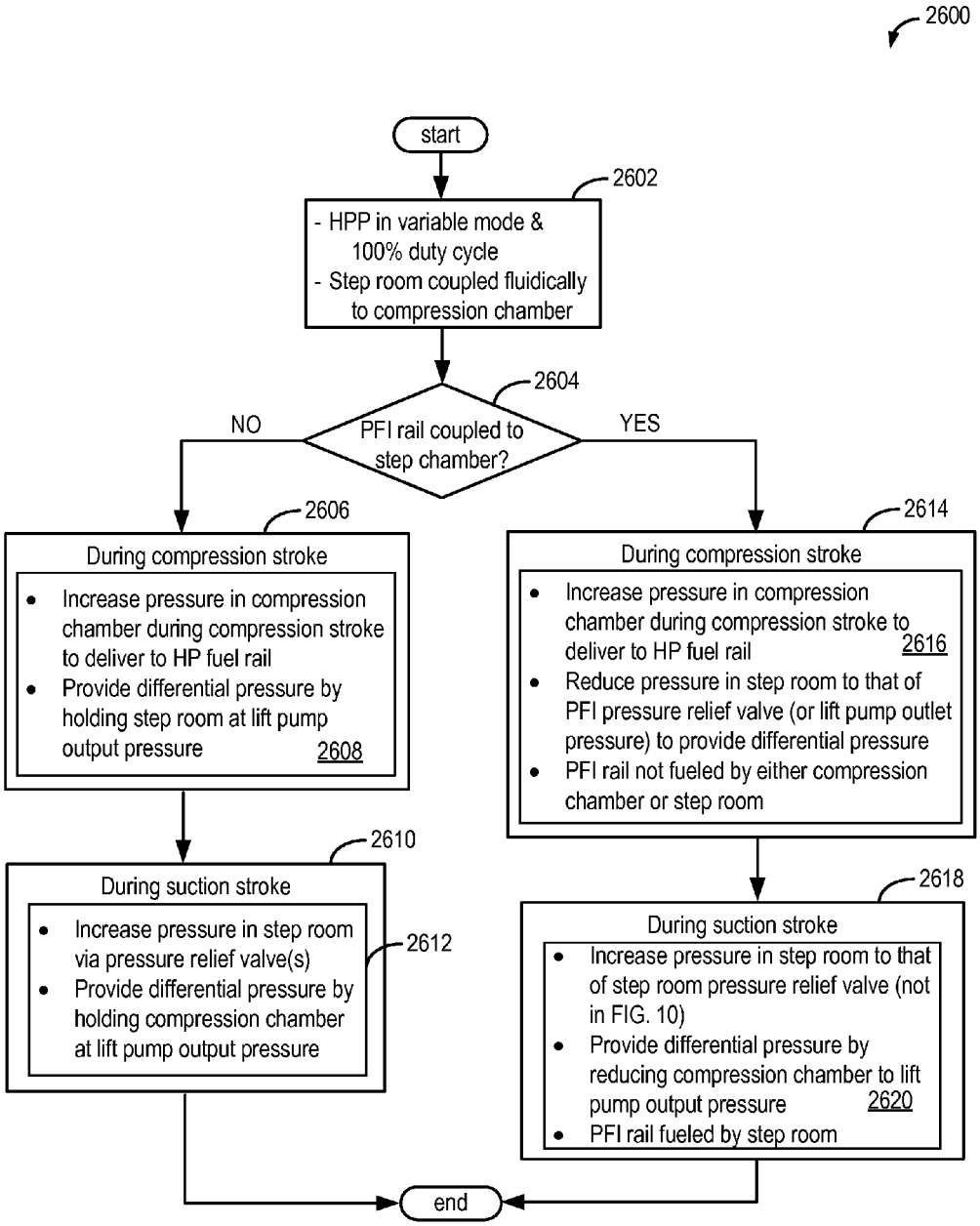

Turning now to routine 2600 of FIG. 26, it describes changes in pressure during a 100% duty cycle in the DI pump embodiments wherein the step chamber is fluidically coupled to the compression chamber. As such, the step room may receive fuel from the compression chamber during a compression stroke when the spill valve is open.

At 2602, routine 2600 establishes that the DI pump is operating in the variable mode with 100% duty cycle commanded. Further, the step room may be fluidically coupled to the compression chamber. Next at 2604, routine 2600 determines if a PFI rail is in fluidic communication with the step chamber. If no, routine 2600 proceeds to 2606. Thus, pressure changes described below may apply to those embodiments of fuel systems where the step chamber is fluidically coupled to a compression chamber but not fluidically coupled to a PFI rail, or an accumulator, such as the embodiment shown in FIG. 8.

At 2606, pressure changes during a compression stroke in the DI fuel pump of the above embodiment (FIG. 8) is described. At 2608, during a compression stroke in the DI pump, pressure in the compression chamber may be increased to a pressure desired by the DI fuel rail, which is higher than the regulation pressure of the compression chamber. As such, fuel at this desired pressure may be delivered to the DI fuel rail. Further, pressure in the step room may be at the lift pump pressure enabling a differential pressure in the DI pumps and ensuing lubrication. At 2610, pressure changes during a suction stroke in the DI fuel pump of the embodiment of FIG. 8 is described. At 2612, pressure in the step room may be increased to the regulation pressure based on presence of the pressure relief valve (e.g., common pressure relief valve 846) biased to regulate pressure in the step room (and the compression chamber when spill valve is open). Differential pressure may exist between the step room and the compression chamber as compression chamber pressure is reduced to that of lift pump output pressure. Thus, lubrication can occur in the DI pump during both pump strokes when a 100% duty cycle is commanded.

If at 2604, it is determined that a PFI rail is fluidically coupled to the step room, routine 2600 progresses to 2614. Thus, pressure changes described below may include those in the embodiments where the step chamber is fluidically coupled to a PFI rail, but not to an accumulator, and where the step room is also fluidically coupled to the compression chamber, such as embodiment shown in FIG. 14. The PFI rail in the embodiment shown in FIG. 10 may not receive fuel from the step chamber of the DI pump 1014. However, pressure changes described below may apply to the embodiment of FIG. 10 unless where specifically pointed out.

At 2614, pressure changes during a compression stroke in the DI fuel pumps of the above embodiments are described. At 2616, during a compression stroke in the DI pump, pressure in the compression chamber may be increased to a pressure desired by the DI fuel rail, which is higher than the regulation pressure of the compression chamber. Further, pressure in the step room may be reduced to that of either the lift pump pressure or the regulation pressure of the PFI rail enabling a differential pressure in the DI pumps and ensuing lubrication. Further still, the PFI rail may not be fueled by either the compression chamber (since spill valve is closed) or the step room of FIGS. 10 and 14. Accordingly, any port injections during this period may cause a reduction in FRP.

At 2618, pressure changes during a suction stroke in the DI fuel pumps of FIGS. 10 and 14 are described. At 2620, pressure in the step room may be increased to the regulation pressure of the step room (in FIG. 14) based on presence of one or more pressure relief valves biased to regulate pressure in the step room. Differential pressure may exist between the step room and the compression chamber as compression chamber pressure is reduced to that of lift pump output pressure. However, in the embodiment of FIG. 10, pressure in the step room may be at the pressure of the lift pump. Thus, lubrication can occur in the DI pump of FIG. 14 during both pump strokes, but not in the DI pump of FIG. 10.

Further still, the PFI rail is fueled by the step room during the suction stroke in the embodiment of FIG. 14 alone. In the embodiment of FIG. 10, the PFI rail may not receive fuel from the step room during the suction stroke. Thus, when a 100% duty cycle is commanded, the PFI rail may receive fuel from the step room during the suction strokes only in the embodiment depicted in FIG. 14. However, in the embodiment of FIG. 10, the PFI rail may not receive fuel from the step room during the suction stroke but the compression chamber of DI pump 1014 may receive fuel from the step room during the suction stroke.

Figure 27:
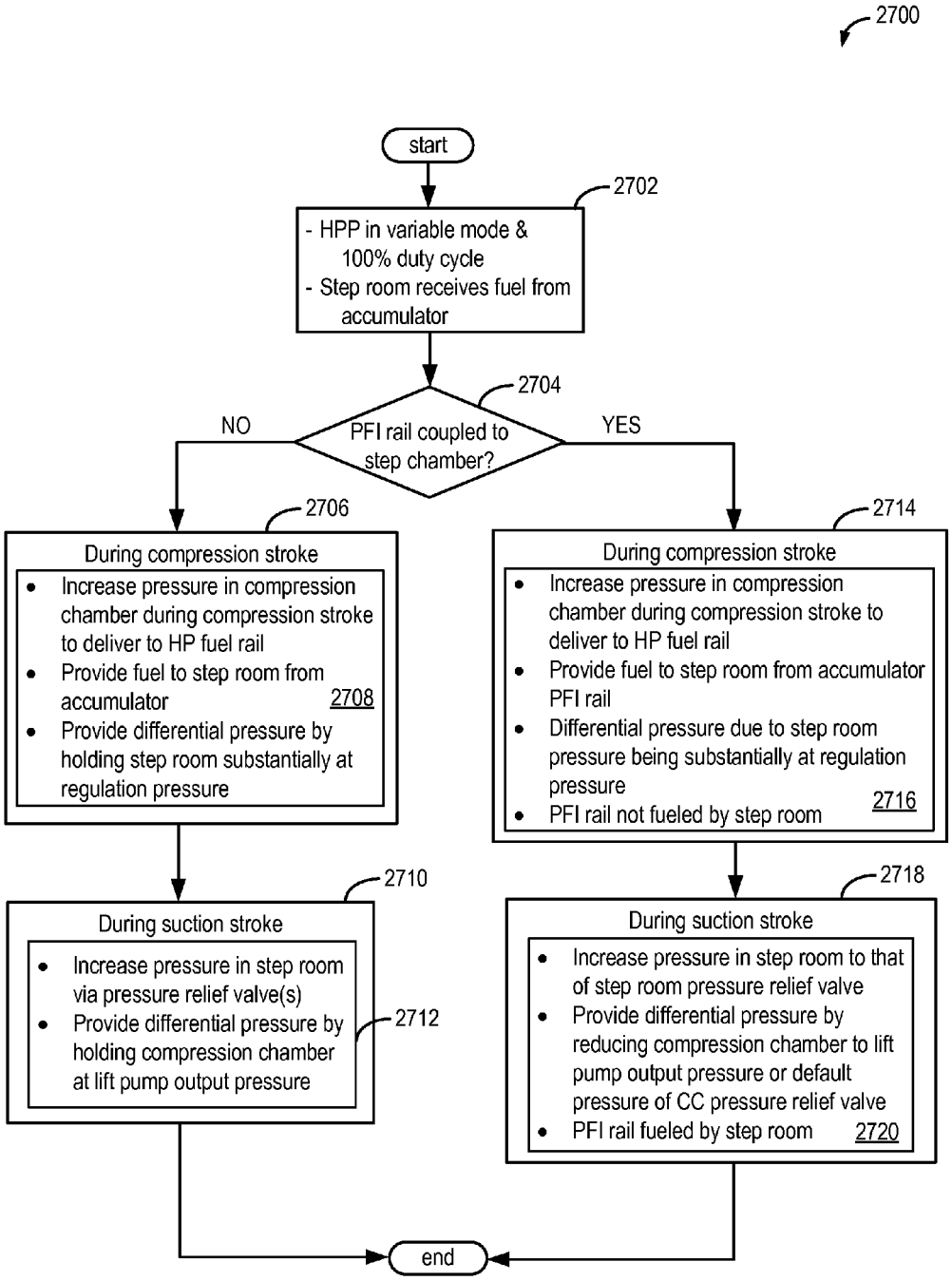

Turning now to routine 2700 of FIG. 27, it describes changes in pressure in the DI pump embodiments wherein the step chamber is fluidically coupled to an accumulator (or a PFI rail functioning as an accumulator) during a 100% duty cycle. As such, the step room may receive fuel from the accumulator and may supply fuel to the accumulator (or PFI rail serving as accumulator).

At 2702, routine 2700 establishes that the DI pump is operating in the variable mode with 100% duty cycle commanded. Further, the step room may be fluidically coupled to the accumulator. Next at 2704, routine 2700 determines if a PFI rail is in fluidic communication with the step chamber. If no, routine 2700 proceeds to 2706. Thus, pressure changes described below may apply to those embodiments of fuel systems where the step chamber is fluidically coupled to an accumulator but not fluidically coupled to a PFI rail, such as the embodiment shown in FIG. 18. The step room may also be fluidically coupled to the compression chamber.

At 2706, pressure changes during a compression stroke in the DI fuel pump of the above embodiment (FIG. 18) is described. At 2708, during a compression stroke in the DI pump, pressure in the compression chamber may be increased to a pressure desired by the DI fuel rail, which is higher than the regulation pressure of the compression chamber. As such, fuel at this desired pressure may be delivered to the DI fuel rail. Since the spill valve is closed, the accumulator may supply fuel to the step room to maintain the step room at substantially a constant pressure. As such, the pressure in the step room may be slightly lower (e.g., within 5%) than the constant regulation pressure as it receives fuel from the accumulator. Differential pressure in the pump occurs because the step room may be substantially at the regulation pressure based on the relief setting of a pressure relief valve such as eighth pressure relief valve 1836.

At 2710, pressure changes during a suction stroke in the DI fuel pump of the embodiment of FIG. 18 is described. At 2712, pressure in the step room may be at the regulation pressure based on presence of the pressure relief valve (e.g., eighth pressure relief valve 1846) biased to regulate pressure in the step room (and the compression chamber when spill valve is open). Differential pressure may exist between the step room and the compression chamber as compression chamber pressure is reduced to that of lift pump output pressure. Thus, lubrication can occur in the DI pump during both pump strokes when a 100% duty cycle is commanded.

If at 2704, it is determined that a PFI rail is fluidically coupled to the step room, routine 2700 progresses to 2714. Herein, the PFI rail may function as the accumulator. Thus, pressure changes described below may include those in the embodiments where the step chamber is fluidically coupled to an accumulator PFI rail, and where the step room is also fluidically coupled to the compression chamber, such as embodiment shown in FIGS. 20 and 21.

At 2714, pressure changes during a compression stroke in the DI fuel pumps of the above embodiments are described. At 2716, during a compression stroke in the DI pump, pressure in the compression chamber may be increased to a pressure desired by the DI fuel rail, which is higher than the regulation pressure of the compression chamber. Further, pressure in the step room may be maintained at substantially the regulation pressure of the step room based on the relief set-point of the ninth pressure relief valve 2036 enabling a differential pressure in the DI pumps and ensuing lubrication. The step room may receive fuel from the accumulator PFI rail and step room pressure may be maintained substantially constant at its regulation pressure. The DI pump may have a differential pressure between the step room and the compression chamber. Further still, the PFI rail may not be fueled by the step room. Accordingly, any port injections during this period may cause a reduction in FRP (e.g., t3 in operating sequence 2200).

At 2718, pressure changes during a suction stroke in the DI fuel pumps of FIGS. 20 and 21 are described. At 2720, pressure in the step room may be increased to the regulation pressure of the step room based on presence of the ninth pressure relief valve biased to regulate pressure in the step room (and the PFI rail). Differential pressure may exist between the step room and the compression chamber as compression chamber pressure is reduced to that of lift pump output pressure. Thus, lubrication can occur in the DI pump during both pump strokes. Further still, the PFI rail is fueled by the step room. As such, FRP in the PFI rail may be restored to the regulation pressure of the PFI due to fueling from the step room. Thus, when a 100% duty cycle is commanded, the PFI rail may receive fuel from the step room during the suction strokes, and in turn, the PFI rail may supply fuel to the step room during the compression strokes. This enables a substantially constant pressure in the step chamber.

Figure 28:
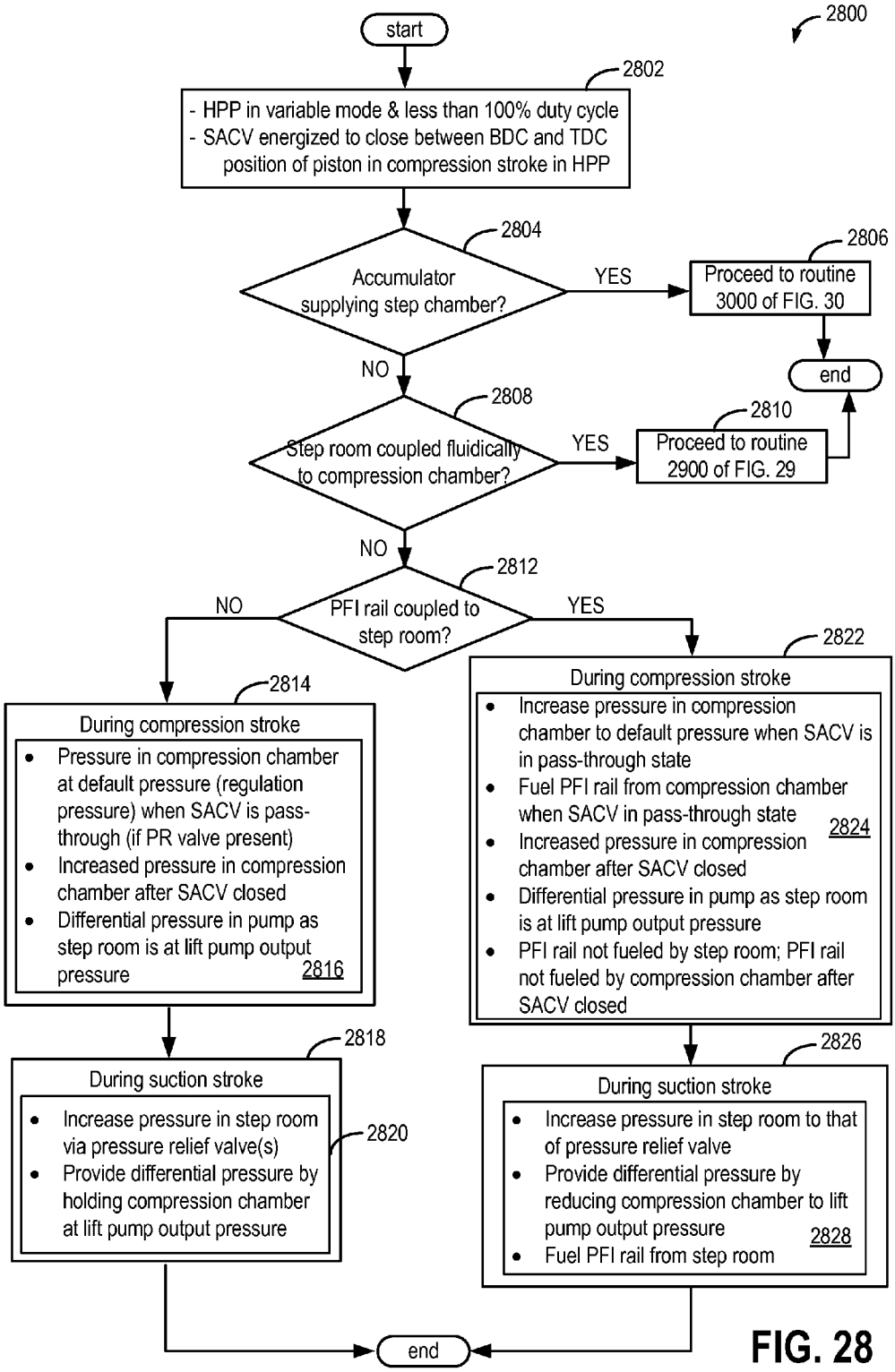

Turning now to FIG. 28, it depicts routine 2800 illustrating pressure changes in each of a compression chamber and a step chamber of a DI pump when a duty cycle less than 100% is commanded to the DI pump. Specifically, routine 2800 presents changes in pressure when the step chamber is not fluidically coupled to either the compression chamber or an accumulator.

At 2802, routine 2800 establishes that the DI pump is operating in variable mode (where the SACV is not in pass-through mode for an entire duration of a compression stroke) with a duty cycle of less than 100% being commanded. Thus, the SACV may be energized to close between BDC and TDC positions of the pump piston. Next at 2804, routine 2800 confirms if the fuel system includes an accumulator supplying fuel to the step chamber, e.g. such as in the embodiments depicted in FIGS. 18, 20, and 21. If yes, routine 2800 continues to 2806 to proceed to routine 3000 of FIG. 30 and then routine 2500 ends. If no, routine 2800 progresses to 2808 to check if the step room in the DI pump is fluidically coupled to the compression chamber. If yes, at 2810, routine 2800 proceeds to routine 2900 of FIG. 29, and then ends.

If no, routine 2800 continues to 2812 to determine if the DI pump supplies fuel to a PFI rail from the step chamber. Herein, it may be confirmed if the step chamber is fluidically coupled to a PFI rail. If it is determined that a PFI rail is not coupled to the step room, routine 2800 continues to 2814. Thus, the embodiments described below may include those fuel systems where the step chamber is not fluidically coupled to a PFI rail or an accumulator, and where the step room is not fluidically coupled to the compression chamber, such as embodiments shown in FIGS. 2, 3, and 4.

At 2814, pressure changes during a compression stroke in the DI fuel pumps of the above embodiments are described. At 2816, during a compression stroke in the DI pump, pressure in the compression chamber may be increased to the regulation pressure of the compression chamber (e.g., default pressure) when the spill valve is in pass-through mode. The regulation pressure may be based on the pressure relief setting of a pressure relief valve biased to regulate pressure in the compression chamber (such as second pressure relief valve 326 in FIGS. 3 and 4). If a pressure relief valve that regulates pressure in the compression chamber is not present, as in FIG. 2, compression chamber pressure may be at lift pump pressure. Once the spill valve closes between BDC and TDC, pressure in the compression chamber rises to higher than the regulation pressure based on pressure desired by the DI fuel rail, and fuel may be delivered to the DI rail. Further, pressure in the step room may be at the lift pump pressure enabling a differential pressure in the DI pumps and enabling lubrication. At 2818, pressure changes during a suction stroke in the DI fuel pumps of the above embodiments (e.g., FIGS. 2, 3, 4) are described. At 2820, pressure in the step room may be increased to the regulation pressure based on presence of one or more pressure relief valves biased to regulate pressure in the step room (e.g., first pressure relief valve 246 (of FIGS. 2 and 3) and pressure relief valve 448 and pressure relief valve 446 of FIG. 4). Differential pressure may exist between the step room and the compression chamber as compression chamber pressure is reduced to that of lift pump output pressure. Thus, lubrication can occur in the DI pump during both compression and suction strokes with less than 100% duty cycle of the DI pump.

If at 2812, it is determined that a PFI rail is fluidically coupled to the step room, routine 2800 progresses to 2822. Thus, the embodiments described below may include those fuel systems where the step chamber is fluidically coupled to a PFI rail, but not to an accumulator, and where the step room is not fluidically coupled to (and does not receive fuel from) the compression chamber, such as embodiments shown in FIGS. 12 and 13. As such, the PFI rail may be fluidically coupled to the compression chamber too.

At 2822, pressure changes during a compression stroke in the DI fuel pumps of the above embodiments are described. At 2824, during a compression stroke in the DI pump, compression chamber pressure increases to the regulation pressure of the compression chamber, based on one or more pressure relief valves (e.g., fourth pressure relief valve 1246 alone in FIG. 12, and fourth pressure relief valve 1246 and fifth pressure relief valve 1346 in FIG. 13) when the SACV is in pass-through mode. The PFI rail may receive fuel from the compression chamber at the regulation pressure of the PFI rail when the SACV is in pass-through state. The step room, however, may be at the lift pump pressure, enabling a pressure differential in the DI pump. Further still, the PFI rail is not fueled by the step room during the compression stroke. Once the SACV is energized to close based on the desired duty cycle (less than 100%), pressure in the compression chamber rises to a pressure desired by the DI fuel rail, which is higher than the regulation pressure of the compression chamber. As such, this fuel may be delivered to the DI rail from the compression chamber alone. Further, the PFI rail may not be fueled by either the compression chamber (since spill valve is closed) or the step room. Accordingly, any port injections during this period (after spill valve is closed) may cause a reduction in FRP of the PFI rail (e.g., at t3 in operating sequence 1500).

At 2826, pressure changes during a suction stroke in the DI fuel pumps of the above embodiments are described. At 2828, pressure in the step room may be increased to the regulation pressure based on presence of one or more pressure relief valves (e.g., fourth pressure relief valve 1246 in FIGS. 12 and 13) biased to regulate pressure in the step room. Differential pressure may exist between the step room and the compression chamber as compression chamber pressure is reduced to that of lift pump output pressure. Thus, lubrication can occur in the DI pump during both pump strokes. Further still, the PFI rail may receive fuel from the step room. As such, FRP in the PFI rail may be returned to its default pressure since the fuel from the step room is pressurized. Thus, when a less than 100% duty cycle is commanded, the PFI rail may receive pressurized fuel from the step room during the suction strokes and may also receive pressurized fuel from the compression chamber when the SACV is open. Pumping volume of the DI pump is thus approximately doubled.

Figure 29:
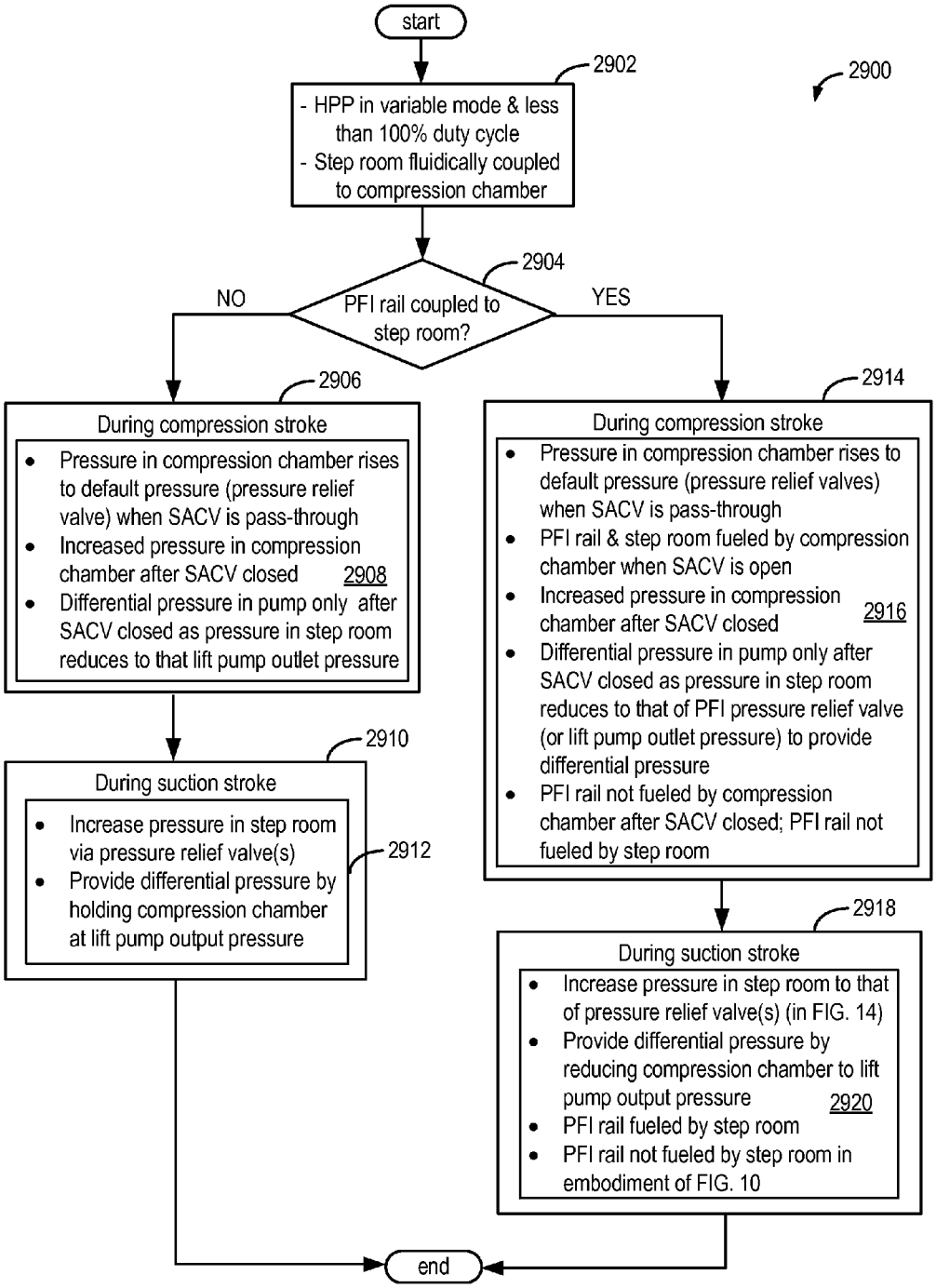

Referring now to FIG. 29, it presents routine 2900 that describes changes in pressure during a less than 100% duty cycle in the DI pump embodiments wherein the step chamber is fluidically coupled to the compression chamber. As such, the step room may receive fuel from the compression chamber during a compression stroke when the spill valve is open.

At 2902, routine 2900 establishes that the DI pump is operating in the variable mode with a duty cycle that is less than 100%. Further, the step room may be fluidically coupled to the compression chamber. Next at 2904, routine 2900 determines if a PFI rail is in fluidic communication with the step chamber. If no, routine 2900 proceeds to 2906. Thus, pressure changes described below may apply to those embodiments of fuel systems where the step chamber is fluidically coupled to a compression chamber but not fluidically coupled to either a PFI rail, or an accumulator, such as the embodiment shown in FIG. 8.

At 2906, pressure changes during a compression stroke in the DI fuel pump of the above embodiment (FIG. 8) is described. At 2908, during a compression stroke in the DI pump, pressure in the compression chamber may increase to the regulation pressure based on relief setting of common pressure relief valve 846 when the SACV is in pass-through mode. This regulation pressure may be the default pressure in the compression chamber and in the DI rail. When the SACV is open, fuel from the compression chamber may flow into the step chamber and pressurize the step chamber to the regulation pressure of the compression chamber. Once the SACV is closed, pressure in the step room decreases to that of the lift pump pressure. Further, compression chamber pressure may increase to a pressure desired by the DI fuel rail, which is higher than the regulation pressure of the compression chamber. Thus, a differential pressure may be formed in the DI pump after the SACV is closed. However, lubrication of the DI pump may occur throughout the compression stroke as the pressure in the step room may be higher than vapor pressure before the SACV closed, and after the SACV closes, the differential pressure further enables lubrication. At 2910, pressure changes during a suction stroke in the DI fuel pump of the embodiment of FIG. 8 are described. At 2912, pressure in the step room may be increased to the regulation pressure based on presence of the pressure relief valve (e.g., common pressure relief valve 846) biased to regulate pressure in the step room (and the compression chamber when spill valve is open). Differential pressure may exist between the step room and the compression chamber as compression chamber pressure is reduced to that of lift pump output pressure. Thus, lubrication can occur in the DI pump during both pump strokes.

If at 2904, it is determined that a PFI rail is fluidically coupled to the step room, routine 2900 progresses to 2914. Thus, pressure changes described below may include those in the embodiments where the step chamber is fluidically coupled to a PFI rail, but not to an accumulator, and where the step room is also fluidically coupled to the compression chamber, such as embodiment shown in FIG. 14. The PFI rail in the embodiment shown in FIG. 10 may not receive fuel from the step chamber of the DI pump 1014. However, pressure changes described below may apply to the embodiment of FIG. 10 unless specifically pointed out.

At 2914, pressure changes during a compression stroke in the DI fuel pumps of the above embodiments are described.

At 2916, during a compression stroke in the DI pump, pressure in the compression chamber may be increased to the regulation pressure of the compression chamber based on one or more pressure relief valves (e.g., third pressure relief valve 1046 of FIG. 10, or sixth pressure relief valve 1446 and seventh pressure relief valve 1436 of FIG. 14) when the SACV is in pass-through mode. The step chamber may receive pressurized fuel (at regulation pressure of compression chamber) when the SACV is open. Further, the PFI rail may also receive pressurized fuel (at regulation pressure of compression chamber) when the SACV is open.

Upon closing the SACV, compression chamber pressure may rise to a pressure desired by the DI fuel rail, which is higher than the regulation pressure of the compression chamber, and fuel may be delivered to the DI rail from the compression chamber. Further, pressure in the step room may be reduced to that of either the regulation pressure of the PFI rail or the lift pump pressure enabling a differential pressure in the DI pumps and ensuing lubrication. Further still, the PFI rail may not be fueled by either the compression chamber (since spill valve is closed) or the step room of FIGS. 10 and 14. Accordingly, any port injections during this period (such as at t3 in operating sequence 1700) may cause a reduction in FRP.

At 2918, pressure changes during a suction stroke in the DI fuel pumps of FIGS. 10 and 14 are described. At 2920, pressure in the step room may be increased to the regulation pressure of the step room (only in FIG. 14) based on presence of one or more pressure relief valves (e.g., sixth pressure relief valve 1446 and seventh pressure relief valve 1436 of FIG. 14) biased to regulate pressure in the step room. Differential pressure may exist between the step room and the compression chamber as compression chamber pressure is reduced to that of lift pump output pressure. However, in the embodiment of FIG. 10, pressure in the step room may be at the pressure of the lift pump during the suction stroke. Thus, lubrication can occur in the DI pump of FIG. 14 during both pump strokes, but not in the DI pump of FIG. 10. Further still, the PFI rail is fueled by the step room in the embodiment of FIG. 14 alone. The PFI rail receives pressurized fuel from the step room. In the embodiment of FIG. 10, the PFI rail may not receive fuel from the step room. Thus, when duty cycle less than 100% is commanded, the PFI rail may receive fuel from the step room during the suction strokes in FIG. 14. However, in the embodiment of FIG. 10, the PFI rail may not receive fuel from the step room but the compression chamber of DI pump 1014 may receive fuel from the step room during the suction strokes.

Figure 30:
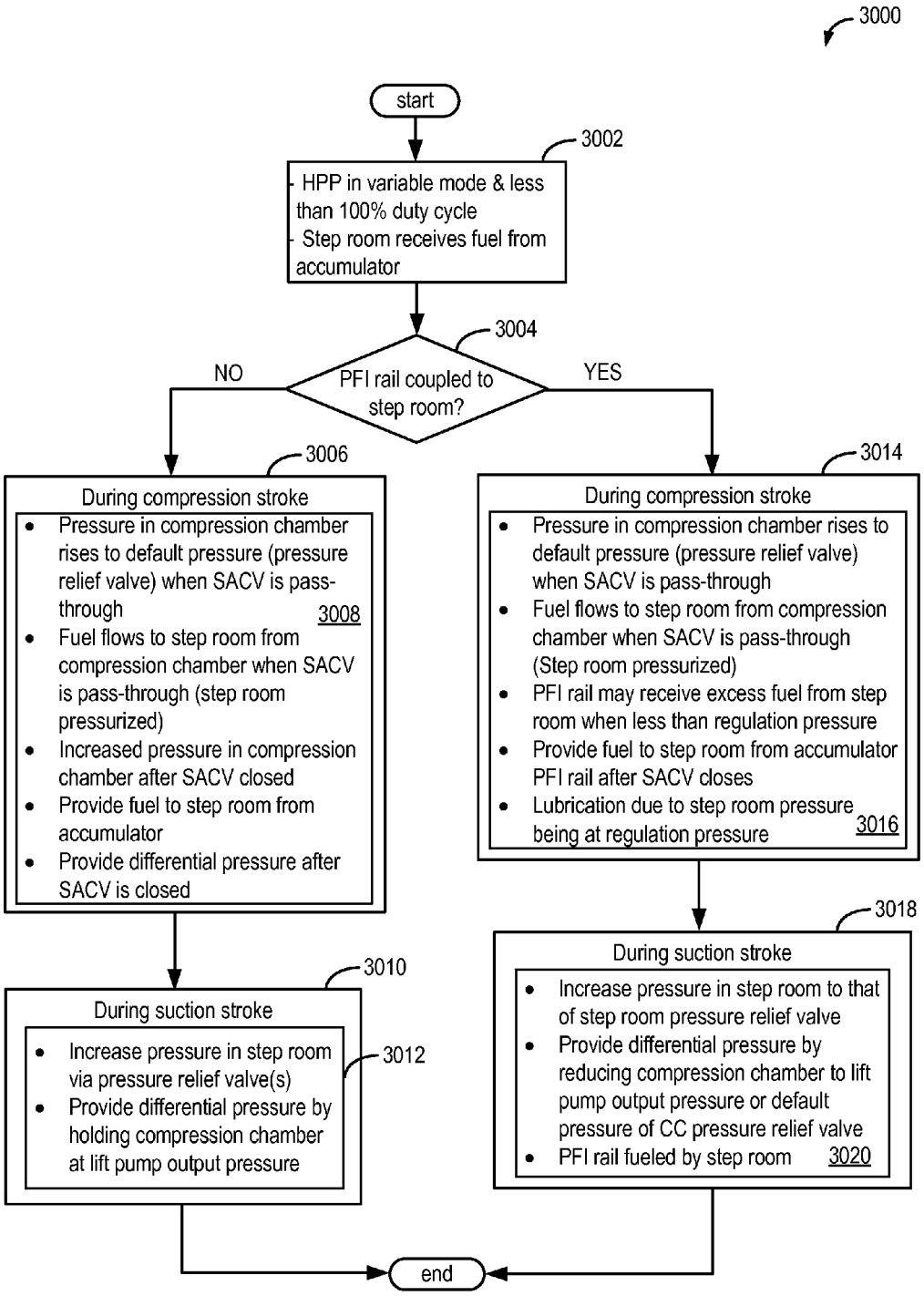

Turning now to routine 3000 of FIG. 30, it describes changes in pressure in the DI pump embodiments wherein the step chamber is fluidically coupled to an accumulator (or a PFI rail functioning as an accumulator) when a duty cycle less than 100% is commanded to the DI pump. As such, the step room may receive fuel from the accumulator and may also supply fuel to the accumulator (or PFI rail serving as accumulator).

At 3002, routine 3000 establishes that the DI pump is operating in the variable mode with a less than 100% duty cycle being commanded. Further, the step room may be fluidically coupled to the accumulator. Next at 3004, routine 3000 determines if a PFI rail is in fluidic communication with the step chamber. If no, routine 3000 proceeds to 3006. Thus, pressure changes described below may apply to those embodiments of fuel systems where the step chamber is fluidically coupled to an accumulator but not fluidically coupled to a PFI rail such as the embodiment shown in FIG. 18. The step room may also be fluidically coupled to the compression chamber.

At 3006, pressure changes during a compression stroke in the DI fuel pump of the above embodiment (FIG. 18) are described. At 3008, during a compression stroke in the DI pump, pressure in the compression chamber may rise to the regulation pressure when the SACV is open. The regulation pressure of the compression chamber may be based on the relief setting of a pressure relief valve such as eighth pressure relief valve 1836 in FIG. 18. Step room may be pressurized to the regulation pressure of the compression chamber since the step room receives fuel from the compression chamber when the SACV is in pass-through mode.

Once the SACV closes between BDC and TDC positions, compression chamber pressure may be increased to a pressure desired by the DI fuel rail, which is higher than the regulation pressure of the compression chamber. As such, fuel at this desired pressure may be delivered to the DI fuel rail. Since the spill valve is closed and the step chamber no longer receives fuel from the compression chamber, the accumulator may supply fuel to the step room to maintain the step room at a constant pressure if the step room experiences a reduction in pressure after the SACV closes, as shown at 2215 of FIG. 22. This constant pressure may be the regulation pressure based on the relief setting of eighth pressure relief valve 1836 in FIG. 18. Lubrication of the DI pump may occur because the step room is at the regulation pressure that is higher than vapor pressure of the fuel prior to SACV closure, and after the SACV closes, a differential pressure is formed between the compression chamber and the step room.

At 3010, pressure changes during a suction stroke in the DI fuel pump of the embodiment of FIG. 18 are described. At 3012, pressure in the step room may be increased to the regulation pressure based on presence of the pressure relief valve (e.g., eighth pressure relief valve 1846) biased to regulate pressure in the step room (and the compression chamber when spill valve is open). Differential pressure may exist between the step room and the compression chamber as compression chamber pressure is reduced to that of lift pump output pressure. Thus, lubrication can occur in the DI pump during both pump strokes when a less than 100% duty cycle is commanded.

If at 3004, it is determined that a PFI rail is fluidically coupled to the step room, routine 3000 progresses to 3014. Herein, the PFI rail may function as the accumulator. Thus, pressure changes described below may include those in the embodiments where the step chamber is fluidically coupled to an accumulator PFI rail, and where the step room is also fluidically coupled to the compression chamber, such as embodiment shown in FIGS. 20 and 21.

At 3014, pressure changes during a compression stroke in the DI fuel pumps of the above embodiments are described. At 3016, during a compression stroke in the DI pump, pressure in the compression chamber may rise to the regulation pressure when the SACV is open. The regulation pressure of the compression chamber may be based on the relief setting of a pressure relief valve such as ninth pressure relief valve 2036 alone in FIG. 20 and ninth pressure relief valve 2036 together with tenth pressure relief valve 2148 in FIG. 21. The step room may be pressurized to the regulation pressure of the step chamber since the step room receives fuel from the compression chamber when the SACV is in pass-through mode. If the step room is filled, excess fuel may flow to the PFI rail when fuel pressure is lower than the relief setting of the ninth pressure relief valve 2036.

Once the SACV closes, pressure in the compression chamber may be increased to a pressure desired by the DI fuel rail, which is higher than the regulation pressure of the compression chamber. Further, the step room may receive fuel from the accumulator PFI rail if the step room is not completely filled allowing step room pressure to be maintained substantially constant at its regulation pressure. Further, pressure in the step room may be maintained at substantially the regulation pressure of the step room based on the relief set-point of the ninth pressure relief valve 2036 enabling a differential pressure in the DI pumps and ensuing lubrication. Further still, the PFI rail may not be fueled by the step room once the SACV closes. As such, the PFI rail may have to supply fuel to the step chamber. Accordingly, any port injections during this period may cause a reduction in FRP (e.g., t3 in operating sequence 2200).

At 3018, pressure changes during a suction stroke in the DI fuel pumps of FIGS. 20 and 21 are described. At 3020, pressure in the step room may be increased to the regulation pressure of the step room based on presence of the ninth pressure relief valve 2036 biased to regulate pressure in the step room (and the PFI rail). Differential pressure may exist between the step room and the compression chamber as compression chamber pressure is reduced to that of lift pump output pressure. Further still, the PFI rail is fueled by the step room. As such, FRP in the PFI rail may be returned to the regulation pressure of the PFI rail due to fuel (e.g. pressurized) received from the step room. Thus, when a less than 100% duty cycle is commanded, the PFI rail may receive fuel from the step room during the suction strokes, and in turn, the PFI rail may supply fuel to the step room during the compression strokes after the SACV closes. Furthermore, lubrication can occur in the DI pump during both pump strokes as the forward direction based on pump piston movement may have a pressure that is higher than lift pump pressure (and fuel vapor pressure).

Figure 31:
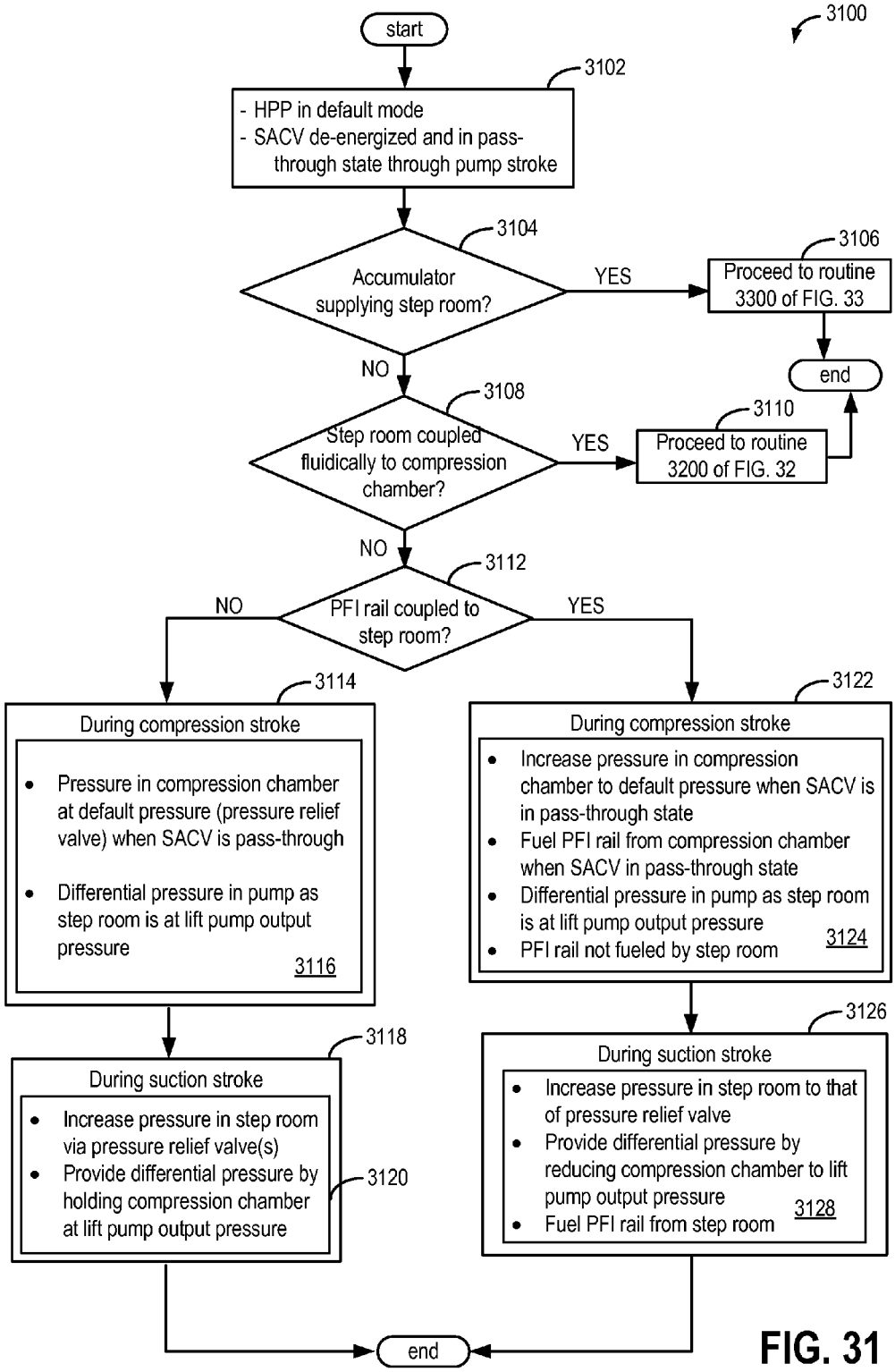

Turning now to FIG. 31, it depicts routine 3100 illustrating pressure changes in each of a compression chamber and a step chamber of a DI pump when a default mode is commanded to the DI pump. Specifically, routine 3100 presents changes in pressure when the step chamber is not fluidically coupled to either the compression chamber or an accumulator.

At 3102, routine 3100 establishes that the DI pump is operating in default mode (where the SACV is in pass-through mode for an entire duration of a compression stroke). Thus, the SACV may be de-energized and open between BDC and TDC positions of the pump piston during the delivery stroke. As such, the DI pump may operate in the default pressure mode and supply fuel at a default pressure to the DI rail, when the direct injectors are deactivated. Next at 3104, routine 3100 confirms if the fuel system includes an accumulator supplying fuel to the step chamber, e.g., such as in the embodiments depicted in FIGS. 18, 20, and 21. If yes, routine 3100 continues to 3106 to proceed to routine 3300 of FIG. 33 and then routine 3100 ends. If no, routine 3100 progresses to 3108 to check if the step room in the DI pump is fluidically coupled to the compression chamber. If yes, routine 3100 moves to 3110 wherein it proceeds to routine 3200 of FIG. 32, and then ends.

If no, routine 3100 continues to 3112 to determine if the DI pump supplies fuel to a PFI rail from the step chamber. Herein, it may be confirmed if the step chamber is fluidically coupled to a PFI rail. If it is determined that a PFI rail is not coupled to the step room, routine 3100 continues to 3114. Thus, the embodiments described below may include those fuel systems where the step chamber is not fluidically coupled to a PFI rail or an accumulator, and where the step room is not fluidically coupled to the compression chamber, such as embodiments shown in FIGS. 2, 3, and 4.

At 3114, pressure changes during a compression stroke in the DI fuel pumps of the above embodiments are described. At 3116, during a compression stroke in the DI pump, pressure in the compression chamber may be increased to the regulation pressure of the compression chamber (e.g., default pressure) since the spill valve is in pass-through mode. The regulation pressure may be based on the pressure relief setting of a pressure relief valve biased to regulate pressure in the compression chamber (such as second pressure relief valve 326 in FIG. 3). If a pressure relief valve that regulates pressure in the compression chamber is not present, as in FIG. 2, compression chamber pressure may be at lift pump pressure. Further, pressure in the step room may be at the lift pump pressure enabling a differential pressure in the DI pumps and enabling lubrication. At 3118, pressure changes during a suction stroke in the DI fuel pumps of the above embodiments are described. At 3120, pressure in the step room may be increased to the regulation pressure based on presence of one or more pressure relief valves biased to regulate pressure in the step room (e.g., first pressure relief valve 246 of FIGS. 2 and 3, and pressure relief valve 448 and pressure relief valve 446 of FIG. 4). Differential pressure may exist between the step room and the compression chamber as compression chamber pressure is reduced to that of lift pump output pressure. Thus, lubrication can occur in the DI pump during both compression and suction strokes with less than 100% duty cycle of the DI pump. In the embodiment of FIG. 2, lubrication may be lowered during the default mode in the compression stroke since both the compression chamber and the step chamber are at the lift pump pressure.

If at 3112, it is determined that a PFI rail is fluidically coupled to the step room, routine 3100 progresses to 3122. Thus, the embodiments described below may include those fuel systems where the step chamber is fluidically coupled to a PFI rail, but not to an accumulator, and where the step room is not fluidically coupled to (and does not receive fuel from) the compression chamber, such as embodiments shown in FIGS. 12 and 13. As such, the PFI rail may be fluidically coupled to the compression chamber too.

At 3122, pressure changes during a compression stroke in the DI fuel pumps of the above embodiments are described. At 3124, during a compression stroke in the DI pump, compression chamber pressure increases to the regulation pressure of the compression chamber, based on one or more pressure relief valves (e.g., fourth pressure relief valve 1246 alone in FIG. 12, and fourth pressure relief valve 1246 and fifth pressure relief valve 1346 in FIG. 13) when the SACV is in pass-through mode. The PFI rail may receive fuel from the compression chamber at the regulation pressure of the PFI rail through the entire compression stroke as the SACV is open throughout. Accordingly, any port injections during this period (when spill valve is open) may not cause a reduction in FRP of the PFI rail. The step room, however, may be at the lift pump pressure, enabling a pressure differential in the DI pump. Further still, the PFI rail is not fueled by the step room during the compression stroke.

At 3126, pressure changes during a suction stroke in the DI fuel pumps of the above embodiments are described. At 3128, pressure in the step room may be increased to the regulation pressure based on presence of one or more pressure relief valves (e.g., fourth pressure relief valve 1246 in FIGS. 12 and 13) biased to regulate pressure in the step room. Differential pressure may exist between the step room and the compression chamber as compression chamber pressure is reduced to that of lift pump output pressure. Thus, lubrication can occur in the DI pump during both pump strokes. Further still, the PFI rail may receive fuel from the step room. As such, FRP in the PFI rail may be at its default pressure through both compression and suction strokes in the default mode of pump operation. Thus, when default mode is commanded, the PFI rail may receive pressurized fuel through the entire pump cycle: from the step room during the suction strokes and from the compression chamber during the compression strokes.

Figure 32:
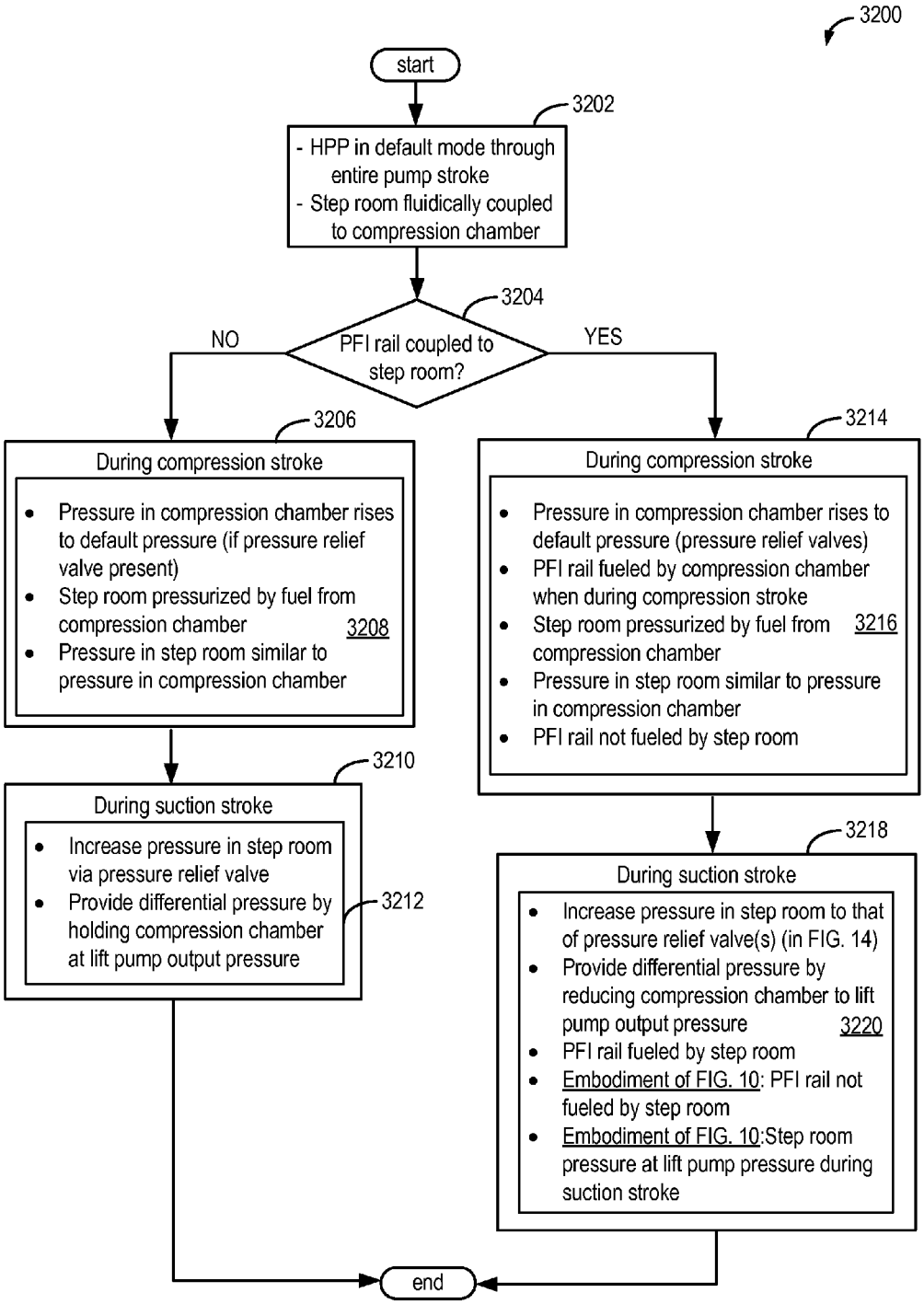

Referring now to FIG. 32, it presents routine 3200 that describes changes in pressure during a default mode in the DI pump embodiments wherein the step chamber is fluidically coupled to the compression chamber. As such, the step room may receive fuel from the compression chamber during a compression stroke when the spill valve is open.

At 3202, routine 3200 establishes that the DI pump is operating in the default mode with the SACV being in pass-through state through the entire compression stroke. Further, the step room may be fluidically coupled to the compression chamber. Next at 3204, routine 3200 determines if a PFI rail is in fluidic communication with the step chamber. If no, routine 3200 proceeds to 3206. Thus, pressure changes described below may apply to those embodiments of fuel systems where the step chamber is fluidically coupled to a compression chamber but not fluidically coupled to either a PFI rail, or an accumulator, such as the embodiment shown in FIG. 8.

At 3206, pressure changes during a compression stroke in the DI fuel pump of the above embodiment (FIG. 8) are described. At 3208, during a compression stroke in the DI pump, pressure in the compression chamber may increase to the regulation pressure based on relief setting of common pressure relief valve 846. As such, the compression chamber pressure may be maintained at the regulation pressure (e.g., relief setting of common pressure relief valve 846+lift pump pressure) through the compression stroke as the SACV is in pass-through mode. This regulation pressure may be the default pressure in the compression chamber and in the DI rail. When the SACV is open, fuel from the compression chamber may flow into the step chamber and pressurize the step chamber to the regulation pressure of the compression chamber. Thus, step chamber pressure may be substantially similar to (e.g., within 5% of) compression chamber pressure. Though a differential pressure may not exist in the DI pump, lubrication of the DI pump may occur throughout the compression stroke as the pressure in the step room may be higher than vapor pressure. At 3210, pressure changes during a suction stroke in the DI fuel pump of the embodiment of FIG. 8 are described. At 3212, pressure in the step room may continue to be at the regulation pressure based on presence of the pressure relief valve (e.g., common pressure relief valve 846) biased to regulate pressure in the step room (and the compression chamber when spill valve is open). Differential pressure may exist between the step room and the compression chamber as compression chamber pressure is reduced to that of lift pump output pressure during the suction stroke. Thus, lubrication can occur in the DI pump during both pump strokes.

If at 3204, it is determined that a PFI rail is fluidically coupled to the step room, routine 3200 progresses to 3214. Thus, pressure changes described below may include those in the embodiments where the step chamber is fluidically coupled to a PFI rail, but not to an accumulator, and where the step room is also fluidically coupled to the compression chamber, such as embodiment shown in FIG. 14. The PFI rail in the embodiment shown in FIG. 10 may not receive fuel from the step chamber of the DI pump 1014. However, pressure changes described below may apply to the embodiment of FIG. 10 unless specifically pointed out.

At 3214, pressure changes during a compression stroke in the DI fuel pumps of the above embodiments are described. At 3216, during a compression stroke in the DI pump, pressure in the compression chamber may increase to the regulation pressure of the compression chamber based on one or more pressure relief valves (e.g., third pressure relief valve 1046 of FIG. 10, or sixth pressure relief valve 1446 and seventh pressure relief valve 1436 of FIG. 14) when the SACV is in pass-through mode. The step chamber may receive pressurized fuel (at regulation pressure of compression chamber) through the compression stroke as the SACV is open throughout the compression stroke. Further, the PFI rail may also receive pressurized fuel (at regulation pressure of PFI rail) through the compression stroke since the SACV is open. Accordingly, any port injections during a compression stroke in default mode (such as at t6 in operating sequence 1700 or at t6 in operating sequence 1100) may not cause a reduction in FRP.

At 3218, pressure changes during a suction stroke in the DI fuel pumps of FIGS. 10 and 14 are described. At 3220, pressure in the step room may rise to the regulation pressure of the step room (only in embodiment of FIG. 14) based on presence of one or more pressure relief valves (e.g., sixth pressure relief valve 1446 and seventh pressure relief valve 1436 of FIG. 14) biased to regulate pressure in the step room. Differential pressure may exist in DI pump 1414 between the step room and the compression chamber as compression chamber pressure is reduced to that of lift pump output pressure. Thus, lubrication can occur in the DI pump 1414 during both pump strokes. However, pressure in the step room of FIG. 10 may be at lift pump pressure during the suction strokes. Thus, the step room and the compression chamber of DI pump 1014 may be at the same pressure during the suction strokes.

Further still, the PFI rail is fueled by the step room in the embodiment of FIG. 14 alone. The PFI rail receives pressurized fuel from the step room. In the embodiment of FIG. 10, the PFI rail may not receive fuel from the step room. Thus, during default mode operation, the PFI rail may receive fuel from the step room during the suction strokes in FIG. 14. However, in the embodiment of FIG. 10, the PFI rail may not receive fuel from the step room during the suction strokes. Nonetheless, the compression chamber of DI pump 1014 in FIG. 10 may receive fuel from the step room during the suction strokes. Furthermore, the PFI rail may be fueled during the entire compression stroke when the DI pump is in default operating mode.

Figure 33:
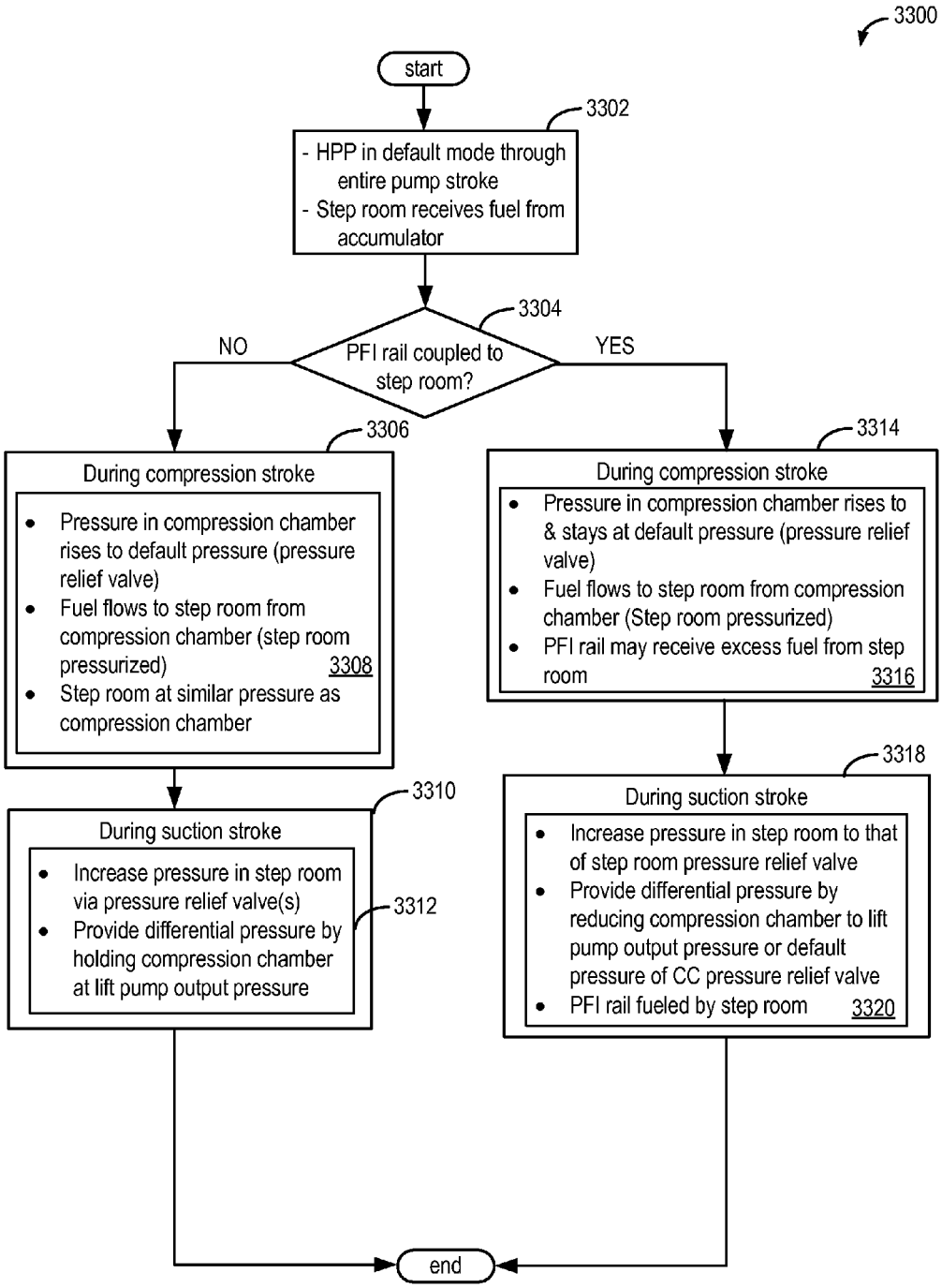

Turning now to routine 3300 of FIG. 33, it describes changes in pressure in the DI pump embodiments wherein the step chamber is fluidically coupled to an accumulator (or a PFI rail functioning as an accumulator) when a default mode is commanded to the DI pump. As such, the step room may receive fuel from the accumulator and may also supply fuel to the accumulator (or PFI rail serving as accumulator).

At 3302, routine 3300 establishes that the DI pump is operating in the default mode. As such, the SACV may be commanded to (e.g., de-energized) to pass-through mode through the entire compression stroke. Further, at 3302 it may be established that the step room may be fluidically coupled to the accumulator. Next at 3304, routine 3300 determines if a PFI rail is in fluidic communication with the step chamber. If no, routine 3300 proceeds to 3306. Thus, pressure changes described below may apply to those embodiments of fuel systems where the step chamber is fluidically coupled to an accumulator but not fluidically coupled to a PFI rail, such as the embodiment shown in FIG. 18. The step room may also be fluidically coupled to the compression chamber.

At 3306, pressure changes during a compression stroke in the DI fuel pump of the above embodiment (FIG. 18) are described. At 3308, during a compression stroke in the DI pump, pressure in the compression chamber may rise to the regulation pressure (e.g., default pressure) when the SACV is open. The regulation pressure of the compression chamber may be based on the relief setting of a pressure relief valve such as eighth pressure relief valve 1836 in FIG. 18. Step room may be pressurized to the regulation pressure of the compression chamber since the step room receives fuel from the compression chamber with the SACV being in pass-through mode. Pressure in each of the compression chamber and the step chamber may be similar, e.g., at the regulation pressure described above, through the entire compression stroke. Since the spill valve is open throughout the stroke and the step chamber receives pressurized fuel from the compression chamber, the accumulator may not supply fuel to the step room in the compression stroke. If the step room is filled, excess fuel may flow to the accumulator if fuel pressure is lower than the relief setting of the eighth pressure relief valve 1836. If pressure is higher than the relief setting of the eighth pressure relief valve 1836, fuel may flow through the eighth pressure relief valve 1836 into the low pressure passage 218.

At 3310, pressure changes during a suction stroke in the DI fuel pump of the embodiment of FIG. 18 is described. At 3312, pressure in the step room may rise to the regulation pressure based on presence of the pressure relief valve (e.g., eighth pressure relief valve 1846) biased to regulate pressure in the step room (and the compression chamber when spill valve is open). Differential pressure may exist between the step room and the compression chamber as compression chamber pressure is reduced to that of lift pump output pressure. Lubrication of the DI pump may occur through both pump strokes in the default mode because the step room is at the regulation pressure that is higher than vapor pressure of the fuel during the suction stroke, and the compression chamber is at a pressure higher than vapor pressure during the compression stroke.

If at 3304, it is determined that a PFI rail is fluidically coupled to the step room, routine 3300 progresses to 3314. Herein, the PFI rail may function as the accumulator. Thus, pressure changes described below may include those in the embodiments where the step chamber is fluidically coupled to an accumulator PFI rail, and where the step room is also fluidically coupled to the compression chamber, such as embodiment shown in FIGS. 20 and 21.

At 3314, pressure changes during a compression stroke in the DI fuel pumps of the above embodiments are described. At 3316, during a compression stroke in the DI pump, pressure in the compression chamber may rise to the regulation pressure and be at the regulation pressure throughout the compression stroke. The regulation pressure of the compression chamber may be based on the relief setting of a pressure relief valve such as ninth pressure relief valve 2036 alone in FIG. 20 and ninth pressure relief valve 2036 together with tenth pressure relief valve 2148 in FIG. 21. The step room may also be pressurized (to the regulation pressure of the step chamber) since the step room receives fuel from the compression chamber when the SACV is in pass-through mode. Herein, the step room may not receive fuel from the accumulator PFI rail as step room pressure may be maintained substantially constant at its regulation pressure by the fuel received from the compression chamber.

If the step room is filled, excess fuel may flow to the PFI rail when fuel pressure is lower than the relief setting of the ninth pressure relief valve 2036. Accordingly, any port injections during default operation may not cause a reduction in FRP (e.g., t6 in operating sequence 2200 or t6 in operating sequence 2300). If fuel pressure is higher than the relief setting of the ninth pressure relief valve 2036, fuel may flow therethrough into the low pressure passage 218.

At 3318, pressure changes during a suction stroke in the DI fuel pumps of FIGS. 20 and 21 are described. At 3320, pressure in the step room may increase to the regulation pressure of the step room based on presence of the ninth pressure relief valve 2036 biased to regulate pressure in the step room (and the PFI rail). Differential pressure may exist between the step room and the compression chamber as compression chamber pressure is reduced to that of lift pump output pressure. Further still, the PFI rail is fueled by the step room. As such, FRP in the PFI rail may continue at the regulation pressure of the PFI rail due to fuel (e.g., pressurized) received from the step room in the compression stroke and in the suction stroke. Further, as mentioned earlier, the accumulator PFI rail may not supply fuel to the step room during default operation. Furthermore, lubrication can occur in the DI pump during both pump strokes as the forward direction based on pump piston movement may have a pressure that is higher than lift pump pressure (and fuel vapor pressure).

In this way, lubrication of a direct injection (DI) fuel pump may be enhanced. In some examples, lubrication and cooling may be enhanced by enabling differential pressure in the DI fuel pump. In other examples, lubrication may be enhanced by pressurizing a step chamber of the DI fuel pump. Specifically, the step chamber may be pressurized to a pressure higher than fuel vapor pressure (e.g., lift pump output pressure). By pressurizing the step room to higher than fuel vapor pressure, fuel evaporation may be reduced. The technical effect of enhancing lubrication may be improved durability of the DI fuel pump. Further, in the embodiments where the port injector fuel rail is fueled by each of the step chamber and the compression chamber of the DI fuel pump, high pressure port fuel injection may be provided even at larger fuel flow rates. Pressurizing the step room can enable higher pressures in the port injector fuel rail. By enhancing the pressure in the port injector fuel rail, fuel injections may be atomized adequately, enabling improved power and reduced emissions.

The above described embodiments may provide lubrication of the DI pump during a compression stroke via pressurizing the compression chamber as well as a suction stroke via pressurizing the step room. A default pressure may be provided to the DI fuel rail during idle conditions or conditions when the direct fuel injectors are deactivated. In some embodiments, circulation of fuel may occur through the step room reducing overheating of fuel therein. Further, some of the embodiments above include a DI pump that provides an increased fuel flow rate to the PFI rail by pumping fuel to the PFI rail with both sides of the pump piston.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A system, comprising:

a port fuel direct injection (PFDI) engine;

a direct injection fuel pump including a piston, a compression chamber, a step chamber arranged below a bottom surface of the piston, a cam for moving the piston, and a solenoid activated check valve positioned at an inlet of the compression chamber of the direct injection fuel pump;

a lift pump fluidically coupled to the direct injection fuel pump;

a first pressure relief valve biased to regulate pressure in the compression chamber during a compression stroke in the direct injection fuel pump;

a direct injector fuel rail fluidically coupled to an outlet of the compression chamber of the direct injection pump;

a port injector fuel rail fluidically coupled to the step chamber of the direct injection fuel pump, the port injector fuel rail functioning as an accumulator; and a second pressure relief valve biased to regulate pressure in each of the port injector fuel rail, the step chamber, and the compression chamber of the direct injection fuel pump.

2. The system of claim 1, wherein the port injector fuel rail is not directly coupled to either the compression chamber of the direct injection fuel pump or the lift pump.

3. The system of claim 2, wherein the first pressure relief valve is not biased to regulate pressure in the step chamber of the direct injection fuel pump.

4. The system of claim 1, wherein the lift pump is electrically actuated, and wherein the direct injection fuel pump is actuated by the PFDI engine and not electrically actuated.

5. The system of claim 4, further comprising a controller having executable instructions stored in a non-transitory memory for adjusting a position of the solenoid activated check valve during the compression stroke of the direct injection fuel pump based on a desired fuel rail pressure of the direct injector fuel rail.

6. A method, comprising:

regulating a pressure in a step chamber of a direct injection fuel pump to a substantially constant pressure during each of a compression stroke and a suction stroke in the direct injection fuel pump.

7. The method of claim 6, wherein the substantially constant pressure in the step chamber is higher than an output pressure of a lift pump, the lift pump supplying fuel to the direct injection fuel pump.

8. The method of claim 7, wherein the substantially constant pressure in the step chamber is maintained by an accumulator positioned downstream of the step chamber.

9. The method of claim 8, wherein the accumulator also functions as a port injector fuel rail.

10. The method of claim 8, wherein a pressure of the accumulator is regulated by a pressure relief valve situated downstream of the accumulator.

11. The method of claim 8, wherein the step chamber receives fuel from a compression chamber of the direct injection fuel pump during a compression stroke in the direct injection fuel pump.

12. The method of claim 11, wherein the step chamber receives fuel from the compression chamber during the compression stroke when a solenoid activated check valve arranged at an inlet of the compression chamber of the direct injection fuel pump is in a pass-through mode.

13. The method of claim 12, wherein the step chamber receives fuel from the accumulator during the compression stroke when the solenoid activated check valve arranged at the inlet of the direct injection fuel pump is closed.

14. The method of claim 13, wherein the solenoid activated check valve arranged at the inlet of the direct injection fuel pump is closed when pumping fuel to a direct injector fuel rail.

15. The method of claim 6, wherein the direct injection fuel pump is driven by an engine and supplies fuel to the engine.

16. A method, comprising:

delivering fuel from a step chamber of a high pressure fuel pump to a port injection fuel rail at a pressure that is higher than an output pressure of a lift pump during a suction stroke, the port injection fuel rail not receiving fuel directly from either the lift pump or a compression chamber of the high pressure fuel pump.

17. The method of claim 16, further comprising regulating a pressure of the step chamber via a pressure relief valve positioned downstream of the step chamber.

18. The method of claim 17, wherein the port injection fuel rail functions as an accumulator, and wherein the port injection fuel rail supplies fuel to the step chamber.

19. The method of claim 17, wherein a pressure in a compression chamber of the high pressure fuel pump is regulated by the pressure relief valve during a compression stroke in the high pressure fuel pump.

20. The method of claim 19, wherein the pressure in the compression chamber of the high pressure fuel pump is regulated by the pressure relief valve during the compression stroke when a solenoid activated check valve positioned at an inlet of the compression chamber of the high pressure fuel pump is in pass-through mode.

* * * * *